US011724524B2

(12) United States Patent
Suzuki et al.

(10) Patent No.: US 11,724,524 B2
(45) Date of Patent: Aug. 15, 2023

(54) DETECTION DEVICE, IMAGE FORMING APPARATUS, AND NON-TRANSITORY COMPUTER READABLE MEDIUM

(71) Applicant: FUJIFILM Business Innovation Corp., Tokyo (JP)

(72) Inventors: Hiroyuki Suzuki, Kanagawa (JP); Naohito Otsuki, Kanagawa (JP); Takehiko Koizumi, Kanagawa (JP); Yuta Chino, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/712,695

(22) Filed: Apr. 4, 2022

(65) Prior Publication Data

US 2023/0065191 A1 Mar. 2, 2023

(30) Foreign Application Priority Data

Aug. 25, 2021 (JP) ..... 2021-137602

(51) Int. Cl.
*G03G 15/00* (2006.01)
*B41J 11/00* (2006.01)

(52) U.S. Cl.
CPC ..... *B41J 11/0095* (2013.01); *G03G 15/50* (2013.01)

(58) Field of Classification Search
CPC .. G03G 15/50; G03G 15/234; G03G 15/6529; G03G 15/6564; B41J 3/60; B41J 11/0095
USPC ..... 399/38, 309, 401
See application file for complete search history.

(56) References Cited

U.S. PATENT DOCUMENTS 9,507,307 B2 * 11/2016 Ishihara ..... G03G 15/2028
2009/0269091 A1 10/2009 Yuasa
2010/0226667 A1 9/2010 Ogihara et al.
2012/0301198 A1 * 11/2012 Momiyama ..... B65H 5/062 271/226

FOREIGN PATENT DOCUMENTS

JP 4133702 B2 8/2008
JP 2009155039 * 7/2009
JP 2017-114659 A 6/2017

OTHER PUBLICATIONS

Oct. 11, 2022 Extended Search Report issued in European Patent Application No. 22169644.6.

* cited by examiner

*Primary Examiner* — Hoan H Tran
(74) *Attorney, Agent, or Firm* — Oliff PLC

(57) ABSTRACT

A detection device includes a transport passage along which a medium is transported and a detection unit that detects a leading edge portion and a trailing edge portion of the medium in the transport passage while transportation of the medium is stopped and while the medium is pulled in a pulling direction along the transport passage.

30 Claims, 25 Drawing Sheets

DETECTION DEVICE, IMAGE FORMING APPARATUS, AND NON-TRANSITORY COMPUTER READABLE MEDIUM

CROSS-REFERENCE TO RELATED APPLICATIONS

This application is based on and claims priority under 35 USC 119 from Japanese Patent Application No. 2021-137602 filed Aug. 25, 2021.

BACKGROUND

(i) Technical Field

The present disclosure relates to a detection device, an image forming apparatus, and a non-transitory computer readable medium.

(ii) Related Art

Japanese Patent No. 4133702 discloses an image forming apparatus including an image forming unit that forms an image, a sheet reversing unit used to perform double-sided printing, a guide unit used to retain the position of a paper sheet in the sheet reversing unit, and a sheet-position retaining unit. A paper sheet whose length in a transporting direction thereof is longer than the length of a transport passage in the sheet reversing unit may be transported into the transport passage. In such a case, the sheet-position retaining unit continuously retains the position of the paper sheet with the guide unit from when the paper sheet has entirely entered the transport passage and when the transportation of the paper sheet is stopped so that a trailing edge of the paper sheet is at a reversing start position. Then, when the next image forming operation is ready to be started, the sheet-position retaining unit stops retaining the position of the paper sheet and releases the paper sheet.

Japanese Unexamined Patent Application Publication No. 2017-114659 discloses a sheet-length measurement device including a rotating body that rotates in contact with a sheet material, a measurement mechanism that measures an amount of rotation of the rotating body, and position sensing mechanisms disposed upstream and downstream of the rotating body in a transporting direction of the sheet material. Each of the position sensing mechanisms includes a sensing member line including plural sensing members arranged in a line. Each position sensing mechanism is disposed to cross side edges of the sheet material in a width direction, and is at an angle with respect to the transporting direction of the sheet material. A sheet length of the sheet material is determined based on the amount of rotation of the rotating body measured by the measurement mechanism and positions of edge portions of the sheet material sensed by the position sensing mechanisms.

SUMMARY

Aspects of non-limiting embodiments of the present disclosure relate to an increase in accuracy of detection of a leading edge portion and a trailing edge portion of a medium compared to when the leading edge portion and the trailing edge portion are detected while the medium is being transported along a transport passage.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a detection device including a transport passage along which a medium is transported and a detection unit that detects a leading edge portion and a trailing edge portion of the medium in the transport passage while transportation of the medium is stopped and while the medium is pulled in a pulling direction along the transport passage.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure will now be described with reference to the drawings.

Image Forming Apparatus 10

Figure 1:
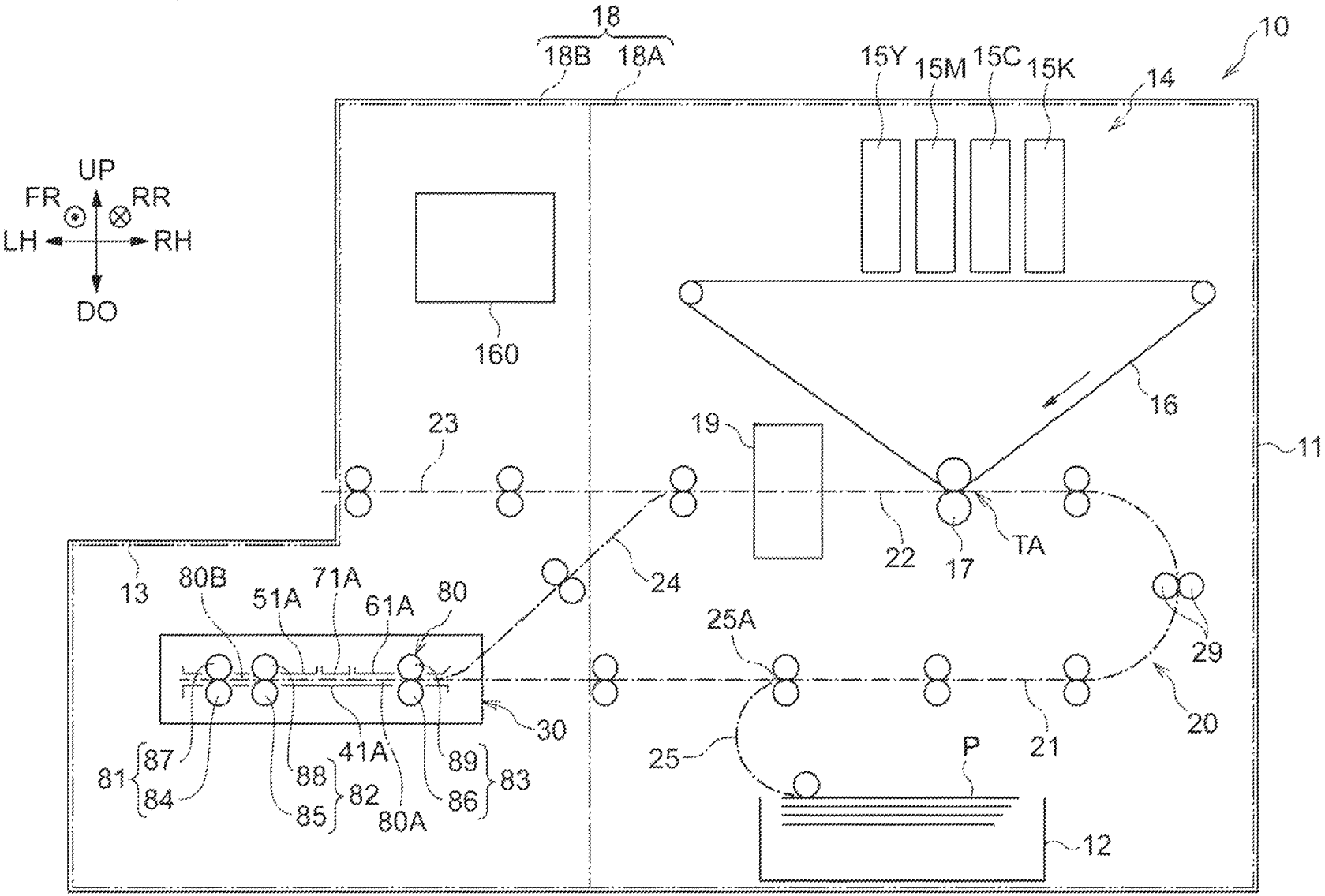
FIG. 1 is a schematic diagram illustrating the structure of an image forming apparatus according to an exemplary embodiment.

The structure of an image forming apparatus 10 according to the exemplary embodiment will be described. FIG. 1 is a schematic diagram illustrating the structure of the image forming apparatus 10 according to the present exemplary embodiment.

In the drawings, arrow UP shows an upward (vertically upward) direction of the apparatus, and arrow DO shows a downward (vertically downward) direction of the apparatus. In addition, arrow LH shows a leftward direction of the apparatus, and arrow RH shows a rightward direction of the apparatus. In addition, arrow FR shows a forward direction of the apparatus, and arrow RR shows a rearward direction of the apparatus. These directions are defined for convenience of description, and the structure of the apparatus is not limited to theses directions. The directions of the apparatus may be referred to without the term "apparatus". For example, the "upward direction of the apparatus" may be referred to simply as the "upward direction".

In addition, in the following description, the term "up-down direction" may be used to mean either "both upward and downward directions" or "one of the upward and downward directions". The term "left-right direction" may be used to mean either "both leftward and rightward directions" or "one of the leftward and rightward directions". The left-right direction may also be referred to as a lateral direction or a horizontal direction. The term "front-rear direction" may be used to mean either "both forward and rearward directions" or "one of the forward and rearward directions". The front-rear direction corresponds to a width direction described below, and may also be referred to as a lateral direction or a horizontal direction. The up-down direction, the left-right direction, and the front-rear direction cross each other (more specifically, are orthogonal to each other).

In the figures, a circle with an X in the middle represents an arrow going into the page, and a circle with a dot in the middle represents an arrow coming out of the page.

The image forming apparatus 10 illustrated in FIG. 1 is an apparatus that forms an image. More specifically, the image forming apparatus 10 is an inkjet image forming apparatus that forms an image on a medium P by using ink. Still more specifically, as illustrated in FIG. 1, the image forming apparatus 10 includes an image forming apparatus body 11, a medium storage unit 12, a medium output unit 13, an image forming unit 14, a heating unit 19, a transport mechanism 20, a detection device 30, and a control device 160.

The medium P, components of the image forming apparatus 10, an image forming operation performed by the image forming apparatus 10, etc., will now be described.

Medium P

The medium P is an object on which an image is formed by the image forming unit 14. The medium P may be, for example, a paper sheet or a film. The paper sheet may be, for example, a sheet of cardboard paper or coated paper. The film may be, for example, a resin film or a metal film. In the present exemplary embodiment, a paper sheet, for example, is used as the medium P. The type of the medium P is not limited to the above-described types, and various types of media P may be used.

The size of the medium P may be, for example, greater than A3, and sizes such as A2, A1, A0, and B series may be used. The size of the medium P is not limited to the above-described sizes, and media P having various sizes may be used.

A length of the medium P in a transporting direction will be referred to as a transporting-direction dimension. A direction that crosses (more specifically, that is orthogonal to) the transporting direction of the medium P will be referred to as a width direction, and a length of the medium P in the width direction will be referred to as a width-direction dimension.

In the present exemplary embodiment, an upstream edge portion of the medium P in the transporting direction may be referred to as a trailing edge portion or an upstream edge portion. A downstream edge portion of the medium P in the transporting direction may be referred to as a leading edge portion or a downstream edge portion. Edge portions of the medium P in the width direction may be referred to as side edge portions.

Image Forming Apparatus Body 11

As illustrated in FIG. 1, components of the image forming apparatus 10 are disposed in the image forming apparatus body 11. More specifically, for example, the medium storage unit 12, the image forming unit 14, the heating unit 19, the transport mechanism 20, and the detection device 30 are disposed in the image forming apparatus body 11. The image forming apparatus body 11 includes a housing 18 divided into plural sections 18A and 18B. The medium storage unit 12, the image forming unit 14, and the heating unit 19 are disposed in section 18A of the housing 18. The detection device 30 is disposed in section 18B of the housing 18.

The detection device 30 is removably disposed in the image forming apparatus body 11. In other words, the detection device 30 is detachably attached to the image forming apparatus body 11. The position of the detection device 30 will be described below.

Medium Storage Unit 12

The medium storage unit 12 is a unit that stores media P in the image forming apparatus 10. The media P stored in the medium storage unit 12 are supplied to the image forming unit 14.

Medium Output Unit 13

The medium output unit 13 is a unit of the image forming apparatus 10 to which each medium P is output. The medium output unit 13 receives the medium P having an image formed thereon by the image forming unit 14.

Image Forming Unit 14

The image forming unit 14 illustrated in FIG. 1 is an example of an image forming unit that forms an image on the medium P. The image forming unit 14 forms an image on the medium P by using ink. More specifically, as illustrated in FIG. 1, the image forming unit 14 includes discharge portions 15Y, 15M, 15C, and 15K (hereinafter denoted by 15Y to 15K), a transfer body 16, and a facing member 17 that faces the transfer body 16.

In the image forming unit 14, the discharge portions 15Y to 15K discharge ink droplets of respective colors, which are yellow (Y), magenta (M), cyan (C), and black (K), toward the transfer body 16 to form images on the transfer body 16. In addition, in the image forming unit 14, the images of respective colors formed on the transfer body 16 are transferred to the medium P that passes through a transfer position TA between the transfer body 16 and the facing member 17. As a result, an image is formed on the medium P. The transfer position TA may be regarded as an image formation position at which the image is formed on the medium P.

An example of the image forming unit does not necessarily have the structure of the image forming unit 14. For example, an example of the image forming unit may instead be structured such that the discharge portions 15Y to 15K discharge ink droplets directly toward the medium P instead of the transfer body 16.

Image Forming Unit 214

Figure 2:
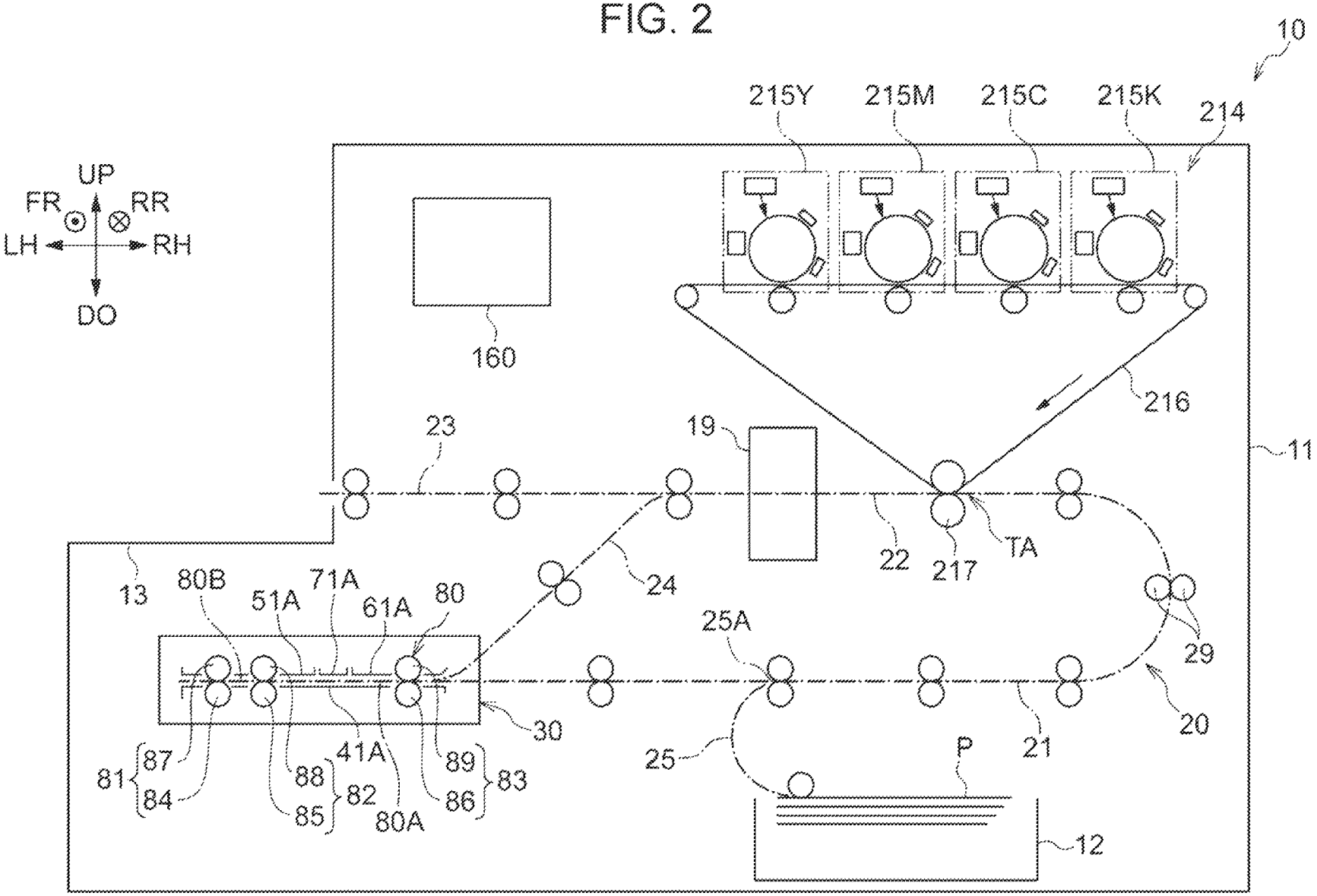
FIG. 2 is a schematic diagram illustrating the structure of the image forming apparatus according to the exemplary embodiment in which an electrophotographic image forming unit is used.

As illustrated in FIG. 2, an example of the image forming unit may instead be an electrophotographic image forming unit 214 that forms an image on the medium P by using toner.

As illustrated in FIG. 2, the image forming unit 214 includes toner image forming units 215Y, 215M, 215C, and 215K (hereinafter denoted by 215Y to 215K), a transfer body 216, and a transfer member 217.

In the image forming unit 214, the toner image forming units 215Y to 215K perform charging, exposure, developing, and transfer processes to form toner images of respective colors, which are yellow (Y), magenta (M), cyan (C), and black (K), on the transfer body 216. The transfer member 217 transfers the toner images of the respective colors formed on the transfer body 216 to the medium P that passes through a transfer position TA between the transfer body 216 and the transfer member 217. As a result, an image is formed on the medium P. Thus, an example of the image forming apparatus may instead be an electrophotographic image forming apparatus.

An example of the image forming unit may instead be structured such that, for example, the toner image forming units 215Y to 215K form the toner images directly on the medium P instead of the transfer body 216.

Heating Unit 19

The heating unit 19 illustrated in FIG. 1 is an example of a heating unit that heats the medium P on which an image is formed. For example, the heating unit 19 heats the medium P by using a heating source (not illustrated) in a contactless manner to dry the image formed of ink.

An example of the heating unit is not limited to the above-described heating unit 19. An example of the heating unit may instead be, for example, a device that heats the medium P by coming into contact with the medium P without affecting the image. Various types of heating units may be used.

In the electrophotographic image forming apparatus including the image forming unit 214, the heating unit 19 functions, for example, as a fixing device that fixes the toner images by applying heat.

Transport Mechanism 20

The transport mechanism 20 is a mechanism that transports the medium P. For example, the transport mechanism 20 transports the medium P by using a transport member 29 including, for example, transport rollers. The transport member 29 may instead be, for example, a transport belt. The transport member 29 may be any member capable of transporting the medium P by applying transporting force to the medium P.

The transport mechanism 20 transports the medium P from the medium storage unit 12 to the image forming unit 14 (more specifically, to the transfer position TA). The transport mechanism 20 further transports the medium P from the image forming unit 14 to the heating unit 19. The transport mechanism 20 further transports the medium P from the heating unit 19 to the medium output unit 13. The transport mechanism 20 also transports the medium P from the heating unit 19 to the image forming unit 14.

Thus, the image forming apparatus 10 includes a transport path 21 from the medium storage unit 12 to the image forming unit 14, a transport path 22 from the image forming unit 14 to the heating unit 19, and a transport path 23 from the heating unit 19 to the medium output unit 13. The image forming apparatus 10 also includes a transport path 24 from the heating unit 19 to the image forming unit 14.

The transport path 24 is a transport path along which the medium P having an image formed on one side thereof is returned to the image forming unit 14 (more specifically, to the transfer position TA). The transport path 24 also serves as a transport path that reverses the medium P having an image formed on one side thereof.

The transport path 21 and the transport path 24 include a common portion (more specifically, a downstream portion in the transporting direction). Accordingly, a transport path 25 along which the medium P is transported from the medium storage unit 12 may be regarded as being connected to the transport path 24 and configured to supply the medium P from the medium storage unit 12 to the transport path 24. Therefore, a position at which the transport path 25 is connected to the transport path 24 may be regarded as a supply position 25A at which a new medium P fed from the medium storage unit 12 is supplied to the transport path 24 and transported toward the image forming unit 14. In other words, according to the present exemplary embodiment, the medium P is supplied from the supply position 25A toward the image forming unit 14 through the transport path 24.

Image Forming Operation of Image Forming Apparatus 10

In the image forming apparatus 10, the medium P is transported from the medium storage unit 12 to the image forming unit 14 (more specifically, to the transfer position TA) along the transport path 21, and the image forming unit 14 forms a first image, which may hereinafter be referred to as "front image", on one side (i.e., the front side) of the medium P. When an image is to be formed only on one side of the medium P, the medium P having the front image formed on one side thereof is transported through the heating unit 19 and output to the medium output unit 13.

When images are to be formed on both sides of the medium P, the medium P having the front image formed on one side thereof is transported through the heating unit 19 and then along the transport path 24, so that the medium P is reversed and returned to the image forming unit 14 (more specifically, to the transfer position TA). Then, the image forming unit 14 forms a second image, which may hereinafter be referred to as "back image", on the other side (i.e., the back side) of the medium P that has been heated. In other words, the image forming unit 14 forms an image again. After that, the medium P is transported through the heating unit 19 and output to the medium output unit 13.

Position of Medium Storage Unit 12

As illustrated in FIG. 1, the medium storage unit 12 is disposed below the transport path 24. Therefore, each of the media P stored in the medium storage unit 12 is supplied to the supply position 25A of the transport path 24 from below.

Figure 3:
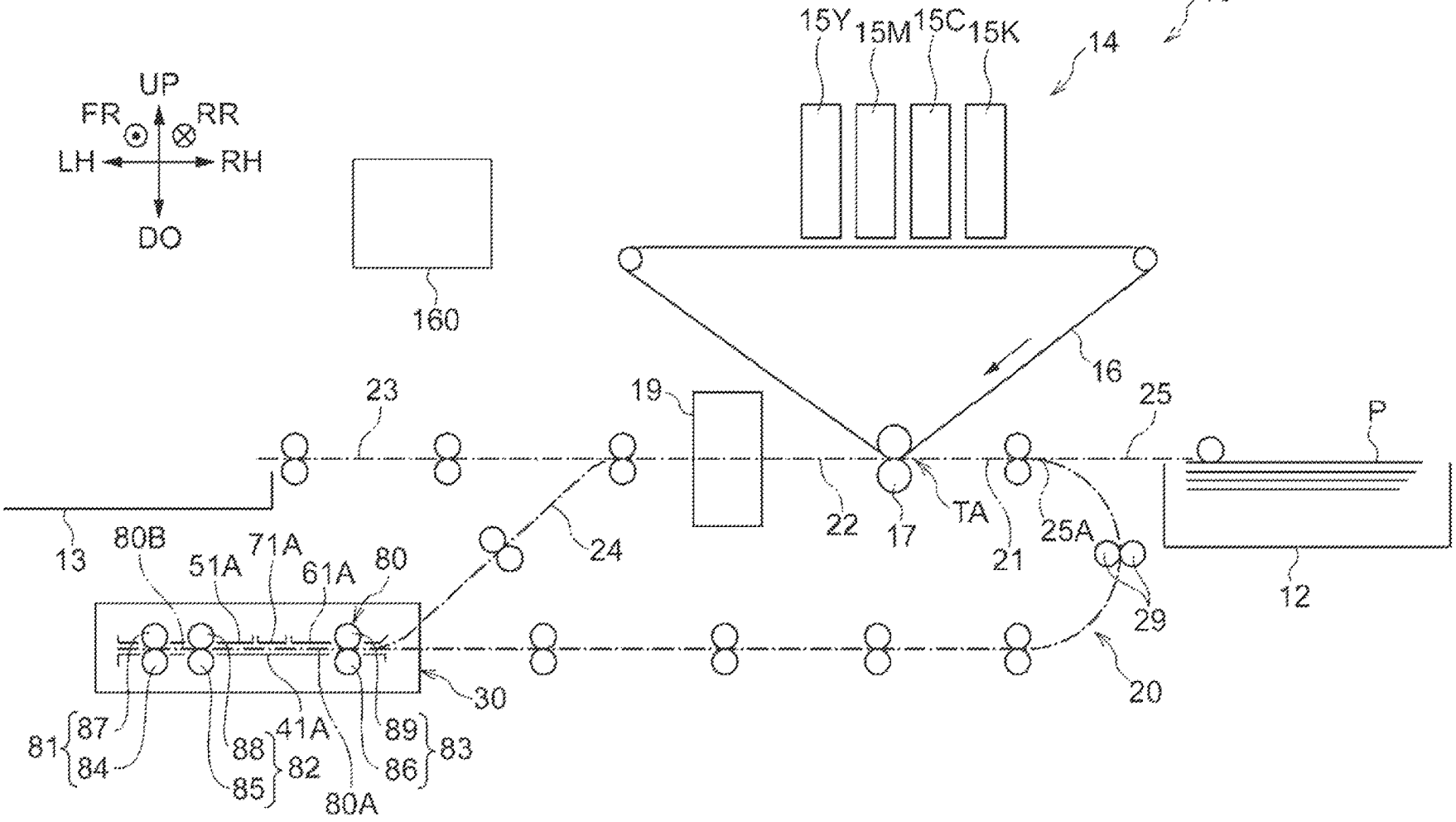
FIG. 3 is a schematic diagram illustrating the structure of the image forming apparatus according to the exemplary embodiment in which a medium storage unit is disposed on a side of a transport path.

As illustrated in FIG. 3, the medium storage unit 12 may instead be disposed on a side of the transport path 24. In this case, each of the media P stored in the medium storage unit 12 is supplied to the supply position 25A of the transport path 24 in a sideways direction (from the right side in FIG. 3). In the structure illustrated in FIG. 3, the medium storage unit 12 is disposed on a side of the image forming unit 14 (more specifically, the transfer position TA). Accordingly, each medium P is supplied to the image forming unit 14 (more specifically, to the transfer position TA) in a sideways direction. In FIG. 3, the image forming apparatus body 11 is omitted.

Detection Device 30

Figure 4:
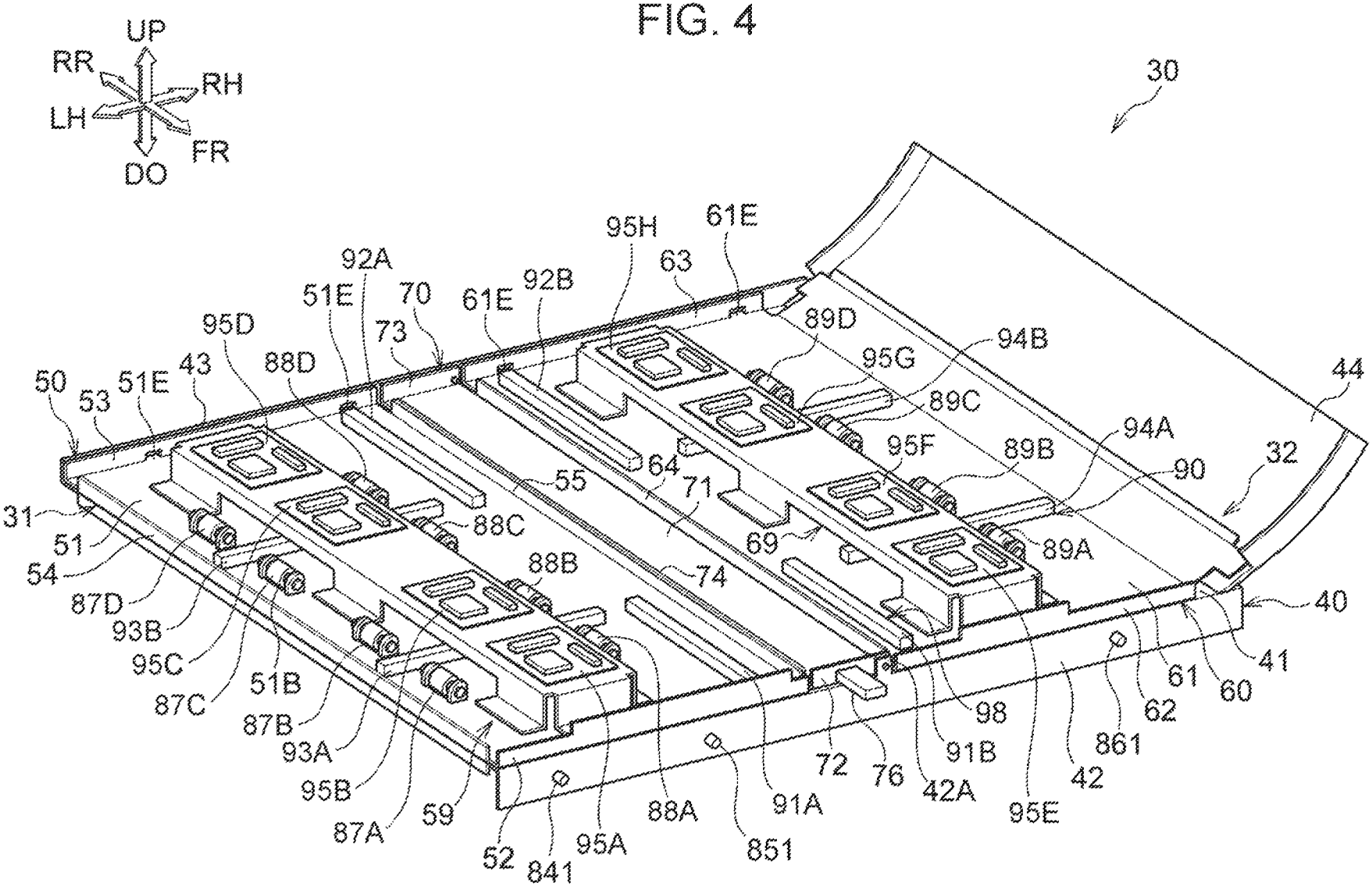
FIG. 4 is a perspective view illustrating the structure of a detection device according to the exemplary embodiment.
Figure 5:
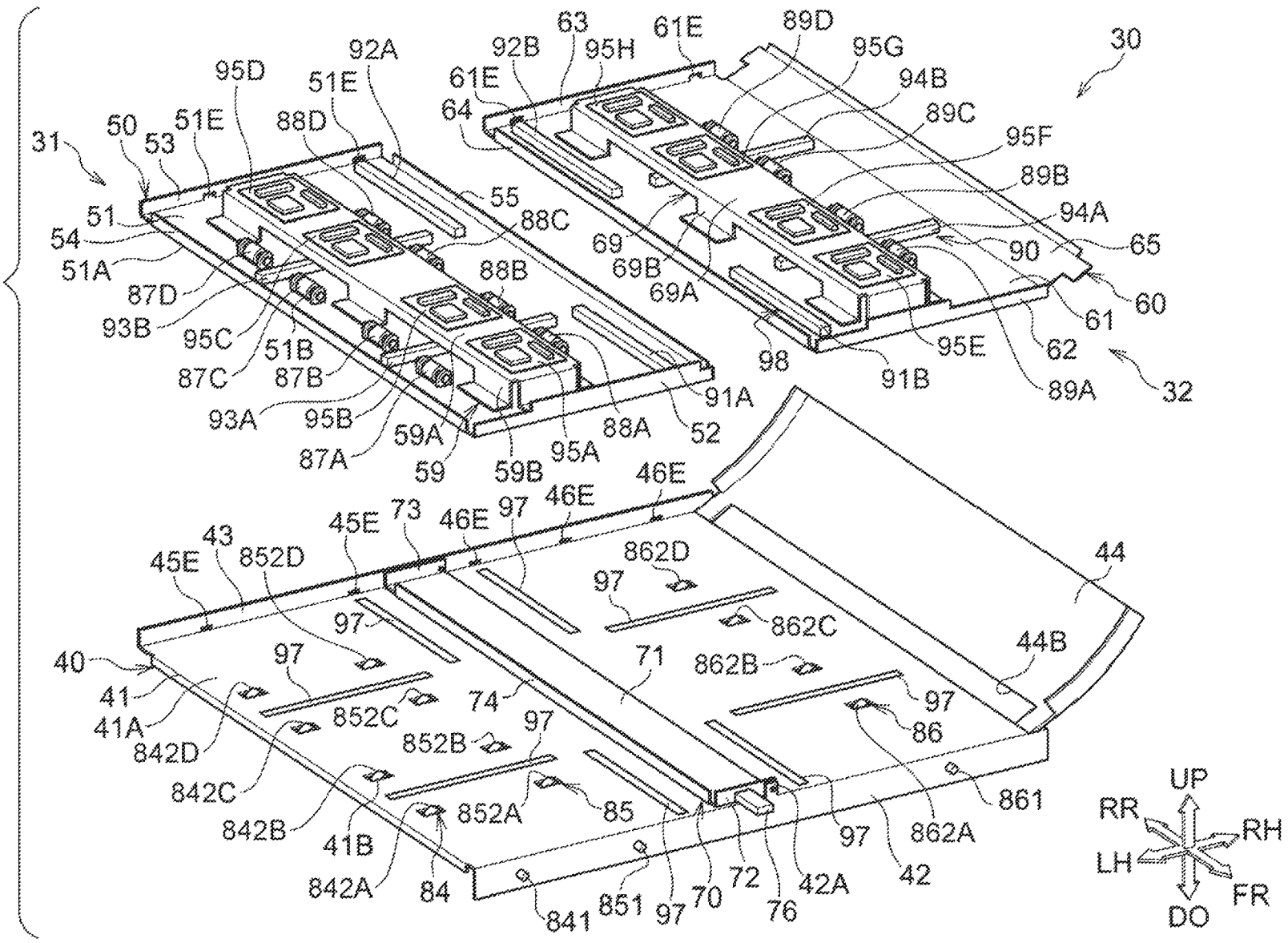
FIG. 5 is a perspective view illustrating the detection device according to the exemplary embodiment in which a first unit and a second unit are removed from a detection device body.
Figure 6:
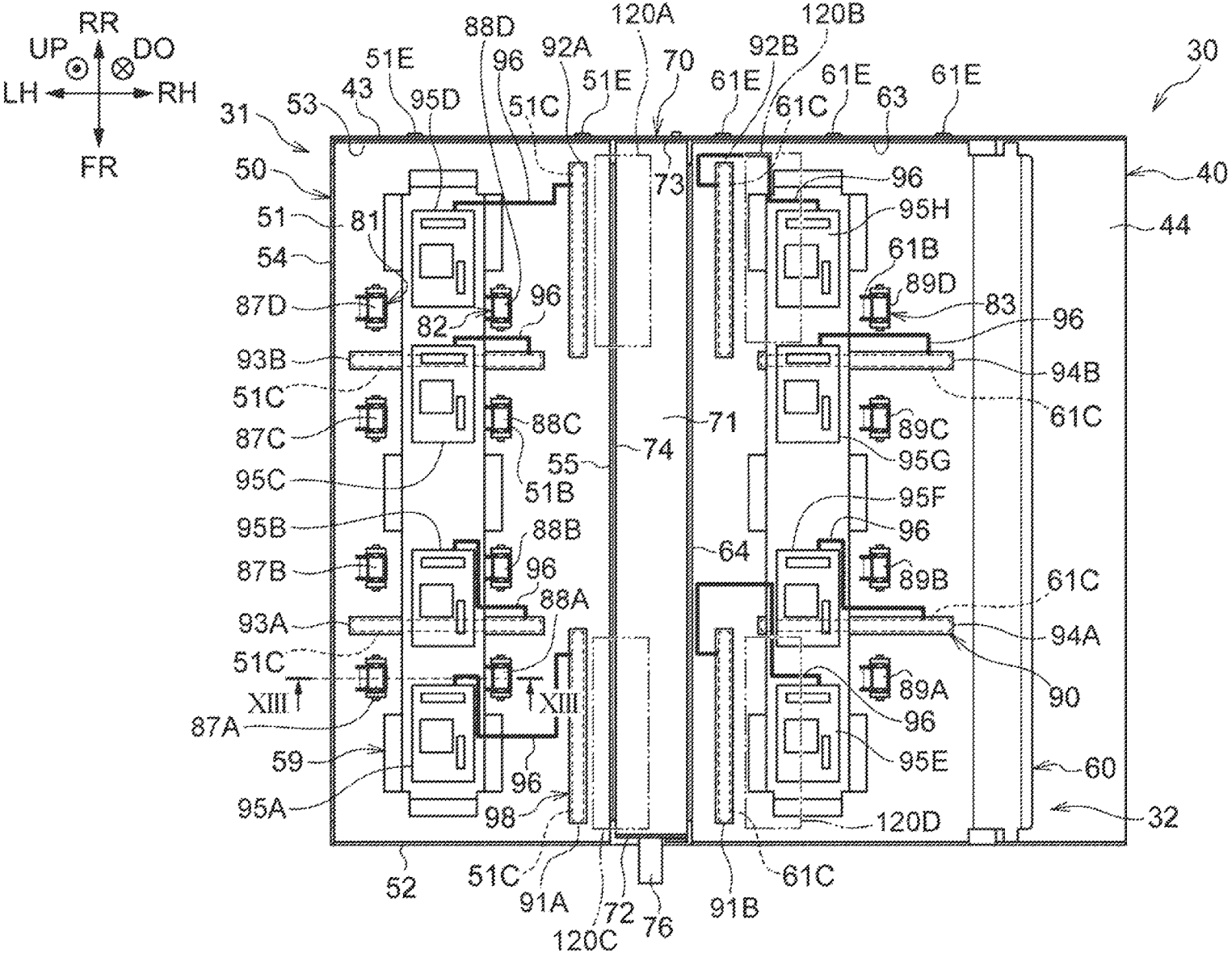
FIG. 6 is a plan view illustrating the structure of the detection device according to the exemplary embodiment.

The detection device 30 illustrated in FIG. 1 is an example of a detection device that detects edge portions of the medium P. FIG. 4 is a perspective view illustrating the structure of the detection device 30. FIG. 5 is a perspective view illustrating the detection device 30 in which a first unit 31 and a second unit 32 are removed from a detection device body 40. FIG. 6 is a plan view illustrating the structure of the detection device 30.

With regard to the detection device 30, the expression "detect (or sense) an edge portion" does not necessarily mean that the edge of the medium P itself is directly detected (or sensed), and may also mean that a mark (for example, a trim mark) on the edge portion of the medium P, for example, is detected (or sensed). The mark is at a predetermined distance from the edge of the medium P so that the distance from the edge of the medium P is known.

As illustrated in FIGS. 4 and 5, the detection device 30 includes the detection device body 40, the first unit 31, the second unit 32, an opening-closing portion 70, a transport unit 80 (see FIG. 1), a leading/trailing edge detection unit 90, a side edge detection unit 98, pressing members 110 (110A to 110D) (see FIGS. 12 and 13), pressing members 120 (120A to 120D) (see FIG. 6), and a trailing edge sensor 99. The shape of the detection device 30 and the structures of components of the detection device 30 will now be described. The control device 160, the position of the detection device 30 in the image forming apparatus 10, and removal of the detection device 30 from the image forming apparatus body 11 will also be described.

Shape of Detection Device 30

As illustrated in FIG. 4, the overall shape of the detection device 30 is such that the length thereof in the left-right direction, which corresponds to the transporting-direction dimension, and the length thereof in the front-rear direction, which corresponds to the width-direction dimension, are greater than the length thereof in the up-down direction. In other words, the detection device 30 has a flat shape that is thin in the up-down direction and extends in the front-rear and left-right directions (more specifically, horizontal directions). In addition, the size of the detection device 30 is at least greater than A3 because the medium P that is transported has a size of greater than A3. The shape of the detection device 30 is not limited to a flat shape, and may be various shapes.

Detection Device Body 40

As illustrated in FIG. 5, the detection device body 40 has a shape similar to the overall shape of the detection device 30, that is, a flat shape that is thin in the up-down direction and extends in the front-rear and left-right directions. More specifically, the detection device body 40 includes a plate body 41, a front plate 42, a rear plate 43, and a guide plate 44. The detection device body 40 is made of, for example, a metal material, such as a metal plate, a resin material, or other materials.

The plate body 41 has the shape of a plate that extends in the front-rear and left-right directions and that has a thickness in the up-down direction. The upper surface of the plate body 41 serves as a transport path surface 41A. The plate body 41 has plural openings 41B in which roller portions 842 (842A to 842D), 852 (852A to 852D), and 862 (862A to 862D), which will be described below, are disposed. In the present exemplary embodiment, twelve openings 41B, for example, are formed. Plural reflection plates 97, which will be described below, are arranged on the upper surface of the plate body 41. In the present exemplary embodiment, eight reflection plates 97, for example, are provided.

The front plate 42 is a plate that extends downward from the front end of the plate body 41, and is formed integrally with the plate body 41. The front plate 42 has the shape of a plate having a thickness in the front-rear direction. The front plate 42 supports driving rollers 84, 85, and 86 described below in a rotatable manner (see FIG. 11).

A support portion 42A that supports the opening-closing portion 70 is provided on the front plate 42. The support portion 42A may be formed by, for example, partially cutting the plate body 41 and raising the cut portion.

The rear plate 43 is a plate that extends upward from the rear end of the plate body 41, and is formed integrally with the plate body 41. The rear plate 43 has the shape of a plate having a thickness in the front-rear direction. As described below, the rear plate 43 functions as a positioning portion for positioning the first unit 31 and the second unit 32. The rear plate 43 has plural insertion holes 45E for receiving projections 51E described below and plural insertion holes 46E for receiving projections 61E described below. In the present exemplary embodiment, for example, two insertion holes 45E and three insertion holes 46E are formed. The insertion holes 45E and 46E are long holes that extend in the left-right direction.

The guide plate 44 is connected to the right end of the plate body 41 and extends rightward and upward from the right end of the plate body 41. The guide plate 44 has a function of guiding the medium P toward the plate body 41 (i.e., leftward). A bottom end portion of the guide plate 44 has an opening 44B through which the medium P transported rightward (i.e., in a second transporting direction described below) from the plate body 41 passes. The guide plate 44 has a relatively small curvature. More specifically, the curvature of the guide plate 44 is, for example, less than the curvature of the transport path 25. Therefore, the medium P transported along the guide plate 44 is not easily bent. As a result, scratch marks are not easily formed on the medium P and the image formed on the medium P when the medium P slides along the guide plate 44.

First Unit 31

As illustrated in FIGS. 4 and 5, the first unit 31 is disposed above the detection device body 40. More specifically, the first unit 31 is disposed above a left portion of the detection device body 40. Still more specifically, the first unit 31 constitutes an upper left portion of the detection device 30.

The first unit 31 includes a unit body 50 and a substrate support 59. The first unit 31 also includes driven rollers 87 (87A to 87D) and 88 (88A to 88D) (described below) of the transport unit 80; sensors 91A, 92A, 93A, and 93B (described below) of the leading/trailing edge detection unit 90 and the side edge detection unit 98; and sensor substrates 95A, 95B, 95C, and 95D. The first unit 31 is made of, for example, a metal material, such as a metal plate, a resin material, or other materials.

As illustrated in FIG. 5, the unit body 50 includes a plate body 51, a front plate 52, a rear plate 53, a left plate 54, and a right plate 55. The plate body 51 has the shape of a plate that extends in the front-rear and left-right directions and that has a thickness in the up-down direction. The lower surface of the plate body 51 serves as a transport path surface 51A (see FIGS. 5, 7A, 7B, and 13). The plate body 51 has openings 51B in which the driven rollers 87 and 88 are disposed and openings 51C (see FIG. 6) in which the sensors 91A, 92A, 93A, and 93B are disposed. The plate body 51 is disposed above the plate body 41 of the detection device body 40 and faces the plate body 41 with a gap therebetween (see FIGS. 7A, 7B, and 13).

The front plate 52 is a plate that extends upward from the front end of the plate body 51. The rear plate 53 is a plate that extends upward from the rear end of the plate body 51. The front plate 52 and the rear plate 53 each have the shape of a plate having a thickness in the front-rear direction.

The left plate 54 is a plate that extends upward from the left end of the plate body 51. The right plate 55 is a plate that extends upward from the right end of the plate body 51. The left plate 54 and the right plate 55 each have the shape of a plate having a thickness in the left-right direction.

Figure 7A:
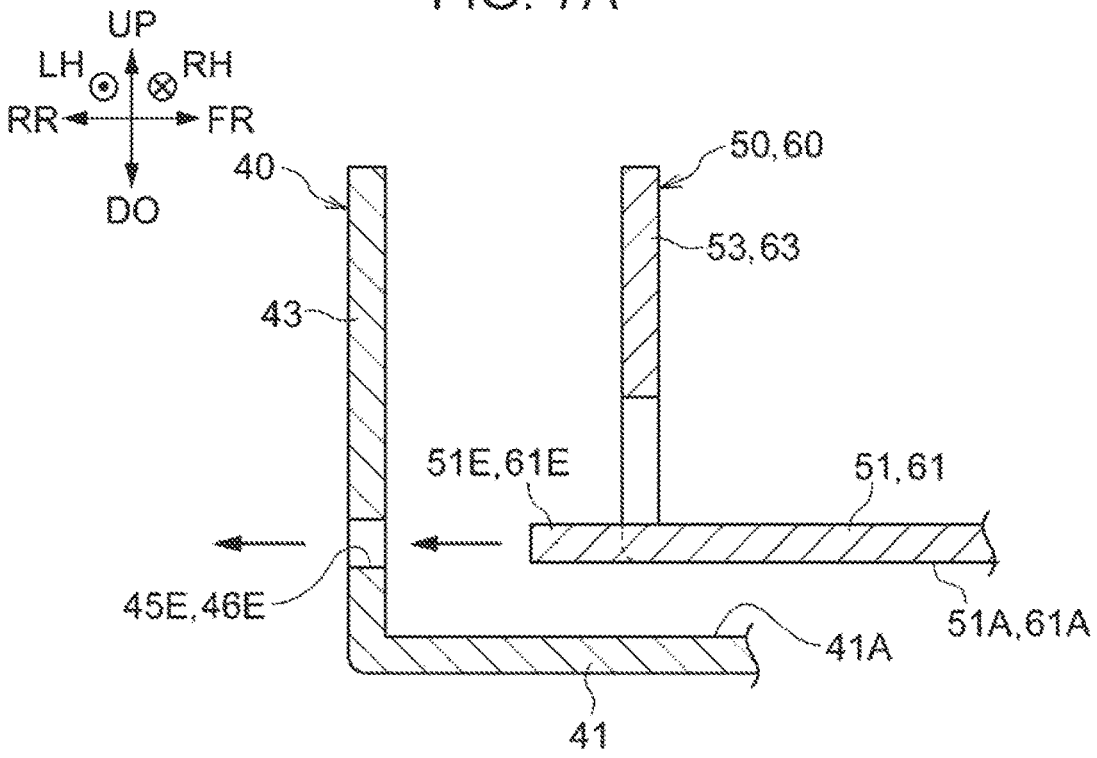
FIGS. 7A and 7B are sectional views used to describe positioning in a rear region of the detection device according to the exemplary embodiment.
Figure 7B:
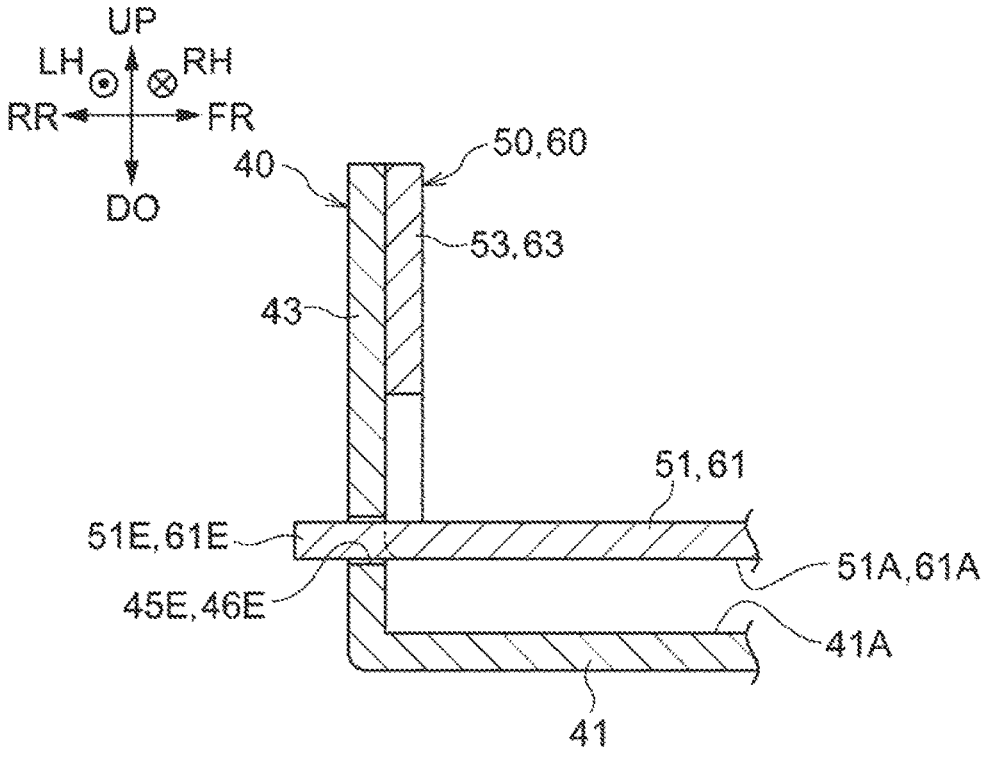

As illustrated in FIGS. 5, 6, 7A, and 7B, the projections 51E to be inserted through the insertion holes 45E in the rear plate 43 of the detection device body 40 are provided at the rear end of the plate body 51. The projections 51E are on the same plane as the plate body 51, and project rearward from the rear plate 53. The projections 51E are formed by, for example, partially cutting the rear plate 53 and raising the cut portions. As illustrated in FIGS. 7A and 7B, in a rear region of the first unit 31, the projections 51E are inserted through the insertion holes 45E, and the rear plate 53 abuts on the rear plate 43 of the detection device body 40.

Figure 8:
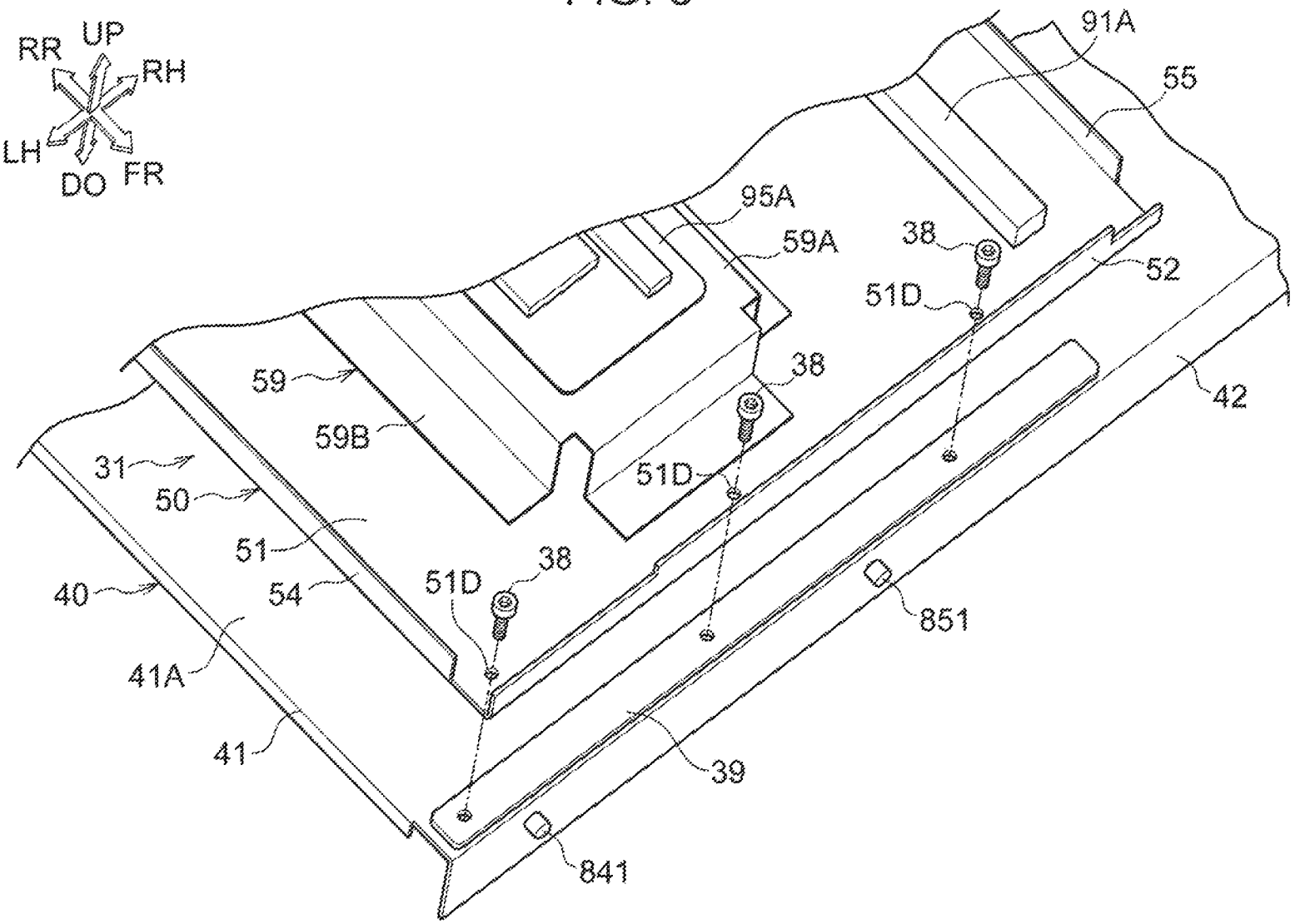
FIG. 8 is a perspective view used to describe positioning in a front region of the detection device according to the exemplary embodiment.
Figure 9A:
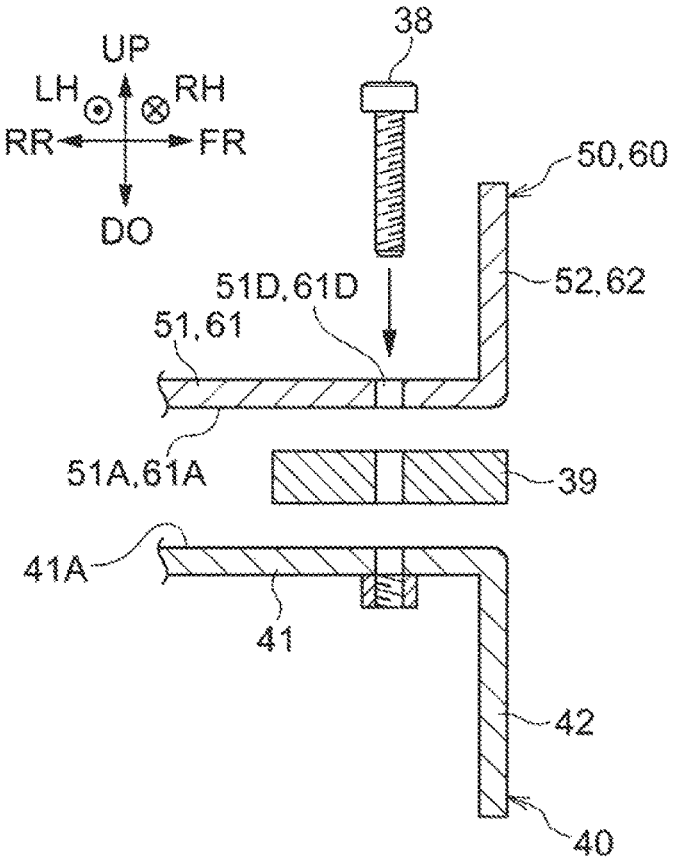
FIGS. 9A and 9B are sectional views used to describe positioning in the front region of the detection device according to the exemplary embodiment.
Figure 9B:
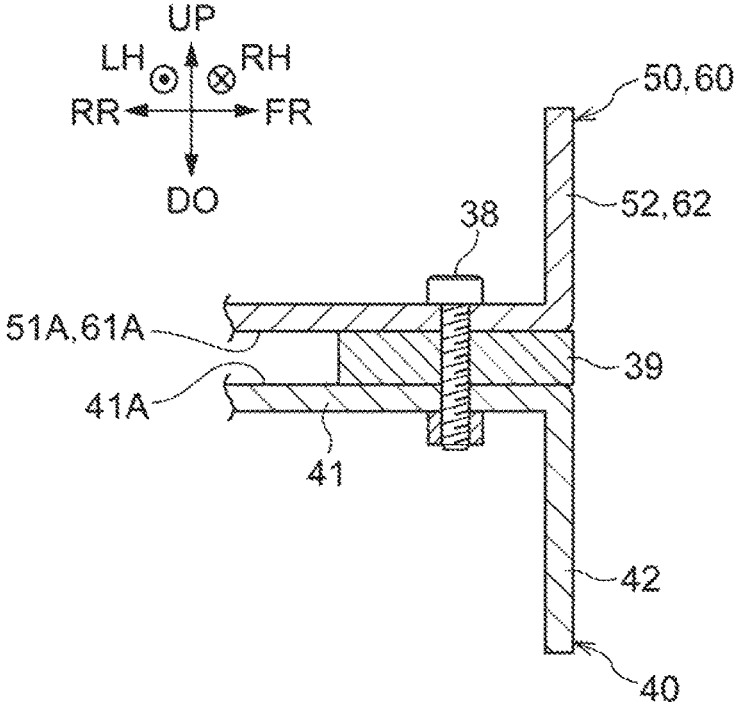

Referring to FIGS. 8, 9A, and 9B, a front portion of the plate body 51 has plural through holes 51D for receiving fastening members 38, such as bolts. The through holes 51D are arranged in the left-right direction. In a front region of the first unit 31, the plate body 51 of the first unit 31 and the plate body 41 of the detection device body 40 are fastened together with the fastening members 38 such that a spacer 39 is disposed between the plate body 51 and the plate body 41.

The rear plate 53 abuts on the rear plate 43 of the detection device body 40 so that the first unit 31 is positioned with respect to the detection device body 40 in the front-rear direction. In addition, the projections 51E are inserted through the insertion holes 45E, and the plate body 51 and the plate body 41 are fastened together with the fastening members 38 with the spacer 39 disposed therebetween. Accordingly, the first unit 31 is positioned with respect to the detection device body 40 in the up-down and left-right directions.

The first unit 31 may be removed from the detection device body 40 by removing the fastening members 38. In other words, the first unit 31 is removably attached to the detection device body 40. In the present exemplary embodiment, as described above, the first unit 31 is attached to the detection device body 40 with the fastening members 38. However, an attachment member used to attach the first unit 31 to the detection device body 40 is not limited to the fastening members 38. The attachment member may instead be, for example, a clamp. The attachment member may be any member capable of attaching the first unit 31 to the detection device body 40.

As illustrated in FIGS. 4 and 5, the substrate support 59 has a function of supporting the sensor substrates 95 (95A to 95D) described below. More specifically, as illustrated in FIG. 5, the substrate support 59 includes an attachment plate 59A and connection plates 59B. The attachment plate 59A is disposed above the plate body 51. The sensor substrates 95 are attached to the attachment plate 59A. The connection plates 59B extend downward from the attachment plate 59A and are connected to the plate body 51.

Second Unit 32

As illustrated in FIGS. 4 and 5, the second unit 32 is disposed above the detection device body 40. More specifically, the second unit 32 is disposed above a right portion of the detection device body 40. Still more specifically, the second unit 32 constitutes an upper right portion of the detection device 30. Thus, an upper portion of the detection device 30 is dividable into the first unit 31 and the second unit 32.

The second unit 32 includes a unit body 60 and a substrate support 69. The second unit 32 also includes driven rollers 89 (89A to 89D) (described below) of the transport unit 80; sensors 91B, 92B, 94A, and 94B (described below) of the leading/trailing edge detection unit 90 and the side edge detection unit 98; and sensor substrates 95E, 95F, 95G, and 95H. The second unit 32 is made of, for example, a metal material, such as a metal plate, a resin material, or other materials.

As illustrated in FIG. 5, the unit body 60 includes a plate body 61, a front plate 62, a rear plate 63, a left plate 64, and a right plate 65. The plate body 61 has the shape of a plate that extends in the front-rear and left-right directions and that has a thickness in the up-down direction. The lower surface of the plate body 61 serves as a transport path surface 61A (see FIGS. 5, 7A, and 7B). The plate body 61 has openings 61B in which the driven rollers 89 are disposed and openings 61C (see FIG. 6) in which the sensors 91B, 92B, 94A, and 94B are disposed. The plate body 61 is disposed above the plate body 41 of the detection device body 40 and faces the plate body 41 with a gap therebetween (see FIGS. 7A and 7B).

The front plate 62 is a plate that extends upward from the front end of the plate body 61. The rear plate 63 is a plate that extends upward from the rear end of the plate body 61. The front plate 62 and the rear plate 63 each have the shape of a plate having a thickness in the front-rear direction.

The left plate 64 is a plate that extends upward from the left end of the plate body 61. The right plate 65 is a plate that extends upward along the guide plate 44 from the right end of the plate body 61. The left plate 64 has the shape of a plate having a thickness in the left-right direction.

As illustrated in FIGS. 5, 6, 7A, and 7B, the projections 61E to be inserted through the insertion holes 46E in the rear plate 43 of the detection device body 40 are provided at the rear end of the plate body 61. The projections 61E are on the same plane as the plate body 61, and project rearward from the rear plate 63. The projections 61E are formed by, for example, partially cutting the rear plate 63 and raising the cut portions. As illustrated in FIGS. 7A and 7B, in a rear region of the second unit 32, the projections 61E are inserted through the insertion holes 46E, and the rear plate 63 abuts on the rear plate 43 of the detection device body 40.

Referring to FIGS. 9A and 9B, a front portion of the plate body 61 has plural through holes 61D for receiving fastening members 38, such as bolts. The through holes 61D are arranged in the left-right direction. In a front region of the second unit 32, the plate body 61 of the second unit 32 and the plate body 41 of the detection device body 40 are fastened together with the fastening members 38 such that a spacer 39 is disposed between the plate body 61 and the plate body 41.

The rear plate 63 abuts on the rear plate 43 of the detection device body 40 so that the second unit 32 is positioned with respect to the detection device body 40 in the front-rear direction. In addition, the projections 61E are inserted through the insertion holes 46E, and the plate body 61 and the plate body 41 are fastened together with the fastening members 38 with the spacer 39 disposed therebetween. Accordingly, the second unit 32 is positioned with respect to the detection device body 40 in the up-down and left-right directions.

The second unit 32 may be removed from the detection device body 40 by removing the fastening members 38. In other words, the second unit 32 is removably attached to the detection device body 40.

As illustrated in FIGS. 4 and 5, the substrate support 69 has a function of supporting the sensor substrates 95 (95E to 95H) described below. More specifically, as illustrated in FIG. 5, the substrate support 69 includes an attachment plate 69A and connection plates 69B. The attachment plate 69A is disposed above the plate body 61. The sensor substrates 95 are attached to the attachment plate 69A. The connection plates 69B extend downward from the attachment plate 69A and are connected to the plate body 61.

Opening-Closing Portion 70

Figure 10:
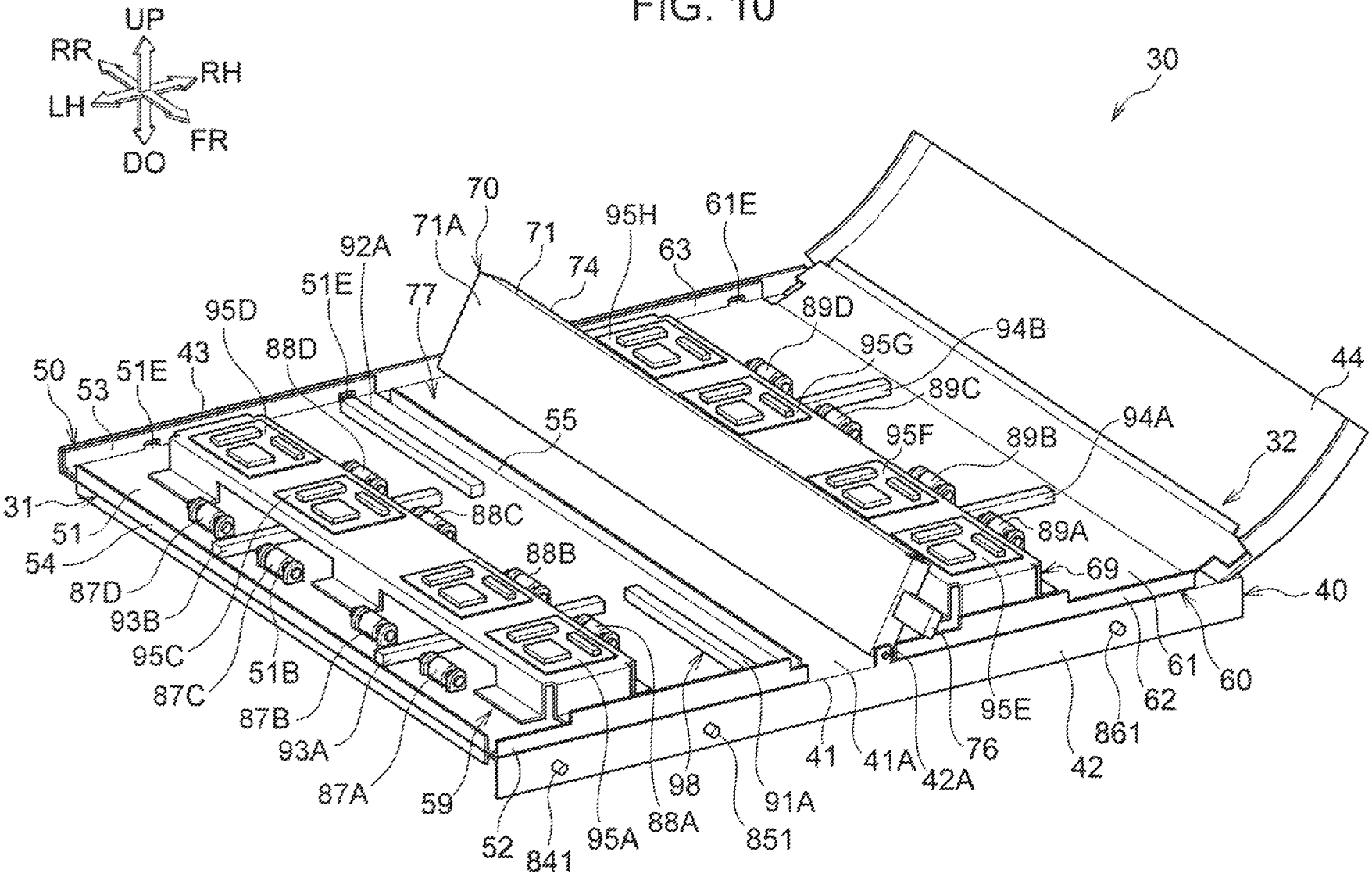
FIG. 10 is a perspective view illustrating the structure illustrated in FIG. 4 in which an opening-closing portion has been moved to an open position.

As illustrated in FIGS. 4 and 10, the opening-closing portion 70 has a function of covering and uncovering an opening 77 at which a transport path 80A (see FIG. 1) of the transport unit 80 is exposed. As illustrated in FIG. 4, the opening-closing portion 70 is disposed above the detection device body 40 and between the first unit 31 and the second unit 32. The opening-closing portion 70 is disposed between the sensors 91A and 92A provided in the first unit 31 and the sensors 91B and 92B provided in the second unit 32 in a region where the sensors 91 (91A and 91B), 92 (92A and 92B), 93 (93A and 93B), and 94 (94A and 94B) are not disposed. The opening-closing portion 70 is made of, for example, a metal material, such as a metal plate, a resin material, or other materials.

As illustrated in FIGS. 4 and 5, the opening-closing portion 70 includes a plate body 71, a front plate 72, a rear plate 73, a left plate 74, and a knob 76. The plate body 71 has the shape of a plate that extends in the front-rear and left-right directions and that has a thickness in the up-down direction. The lower surface of the plate body 71 serves as a transport path surface 71A (see FIG. 10).

The front plate 72 is a plate that extends upward from the front end of the plate body 71. The rear plate 73 is a plate that extends upward from the rear end of the plate body 71. The front plate 72 and the rear plate 73 each have the shape of a plate having a thickness in the front-rear direction. The left plate 74 is a plate that extends upward from the left end of the plate body 71. The left plate 74 has the shape of a plate having a thickness in the left-right direction.

As illustrated in FIGS. 4 and 10, the opening-closing portion 70 is supported by the detection device body 40 such that the opening-closing portion 70 is capable of covering and uncovering the opening 77 at which the transport path 80A (see FIG. 1) of the transport unit 80 is exposed. More specifically, the opening-closing portion 70 is movable between a closed position (position illustrated in FIG. 4) at which the opening 77 is covered and an open position (position illustrated in FIG. 10) at which the opening 77 is uncovered. More specifically, the front plate 72 and the rear plate 73 of the opening-closing portion 70 are rotatably supported by the support portion 42A and the rear plate 43, respectively, of the detection device body 40 at right ends thereof.

When the opening-closing portion 70 is at the closed position, the opening-closing portion 70 is disposed above the plate body 41 of the detection device body 40 and faces the plate body 41 with a gap therebetween. The knob 76 is provided on a front surface of the front plate 72 and projects forward from the front plate 72. An operator holds the knob 76 and moves the opening-closing portion 70 between the closed position and the open position.

The opening-closing portion 70 is opened and closed, for example, to remove the medium P when the medium P is jammed in the transport path 80A (see FIG. 1). The purpose of opening and closing the opening-closing portion 70 is not limited to this, and the opening-closing portion 70 may instead be opened and closed for various other purposes, for example, to clean the transport path surface 71A and the transport path surface 41A of the transport path 80A (see FIG. 1). It may be necessary to prevent the medium P and the image from being noticeably damaged. Whether or not the medium P and the image will be noticeably damaged depends on the curvature of the guide plate 44 and the stiffness of the medium P. There is also a possibility that the medium P will be noticeably damaged by foreign matter that has entered the transport path 80A. Therefore, the transport path 80A may be exposed and cleaned.

Summary of Transport Unit 80

The transport unit 80 illustrated in FIG. 1 has a transport passage 80B through which the medium P is transported. The transportation of the medium P is stopped in the transport passage 80B, and the medium P is pulled in a pulling direction along the transport passage 80B.

The transport passage 80B is a passage through which the medium P heated by the heating unit 19 is transported in the detection device 30, and is composed of the transport path 80A. The transport path 80A is a path defined by the transport path surfaces 41A, 51A, 61A, and 71A. As illustrated in FIG. 1, the transport path 80A constitutes a portion of the transport path 24 that extends from the heating unit 19 to the image forming unit 14.

In the transport unit 80, transportation of the medium P having the front image formed thereon is stopped. After the medium P is stopped (in a stationary state), the medium P is transported again toward the image forming unit 14 (more specifically, toward the transfer position TA). More specifically, in the transport unit 80, the medium P is transported in a leftward direction (transporting direction before the stoppage of the medium P is referred to as a "first transporting direction"), and then the leftward transportation of the medium P is stopped. After the medium P is stopped, the medium P is transported again in a rightward direction (transporting direction after the stoppage of the medium P is referred to as a "second transporting direction"). Thus, in the transport unit 80, after the medium P is stopped, the medium P is transported again in the second transporting direction that differs from the first transporting direction. More specifically, the first and second transporting directions are opposite directions. In other words, the transport unit 80 transports the medium P in a switchback manner. In the present exemplary embodiment, the leftward direction corresponds to the first transporting direction, and the rightward direction corresponds to the second transporting direction. In the transport unit 80, a single medium P is transported. In addition, the transport unit 80 stops the medium P at a predetermined stop position.

As described above, in the transport unit 80, the medium P is transported in the transporting direction, and the transportation of the medium P in the transporting direction is stopped in the transport passage 80B. Then, in the transport unit 80, the medium P stopped in the transport passage 80B is pulled in a direction along the transport passage 80B (hereinafter referred to as a pulling direction). The pulling direction is a direction including the first and second transporting directions.

As described above, the first and second transporting directions are opposite directions. Therefore, the upstream side in the first transporting direction may be regarded as the downstream side in the second transporting direction, and the downstream side in the first transporting direction may be regarded as the upstream side in the second transporting direction. Accordingly, in the detection device 30, components disposed at the upstream side in the first transporting direction may be regarded as components disposed at the downstream side in the second transporting direction, and components disposed at the downstream side in the first transporting direction may be regarded as components disposed at the upstream side in the second transporting direction.

In the description of the detection device 30, the "transporting direction" means the "first transporting direction". Therefore, in the description of the detection device 30, the "first transporting direction" may be referred to simply as the "transporting direction".

Structure of Transport Unit 80

Figure 16:
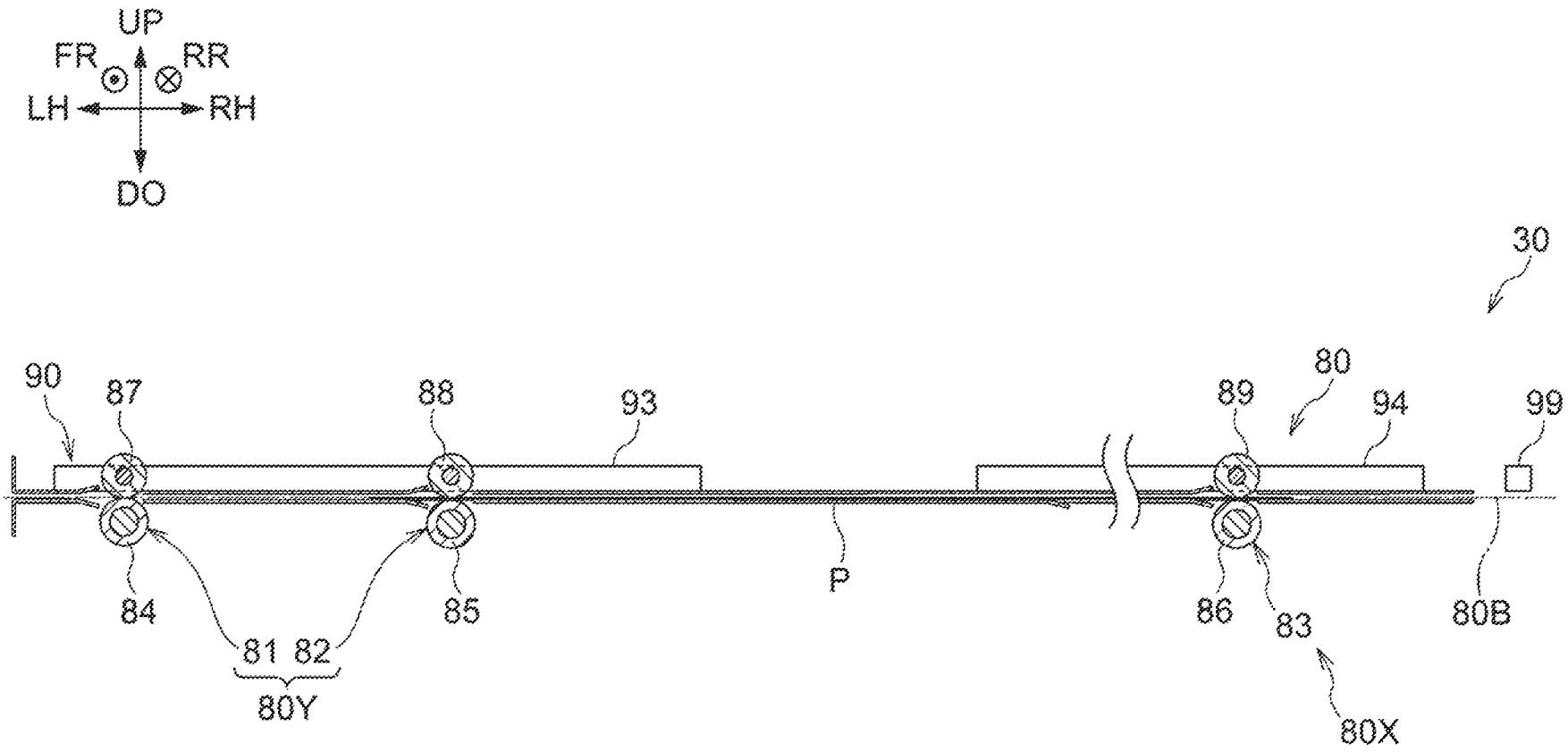
FIG. 16 is a side sectional view of the detection device according to the exemplary embodiment.
Figure 17:
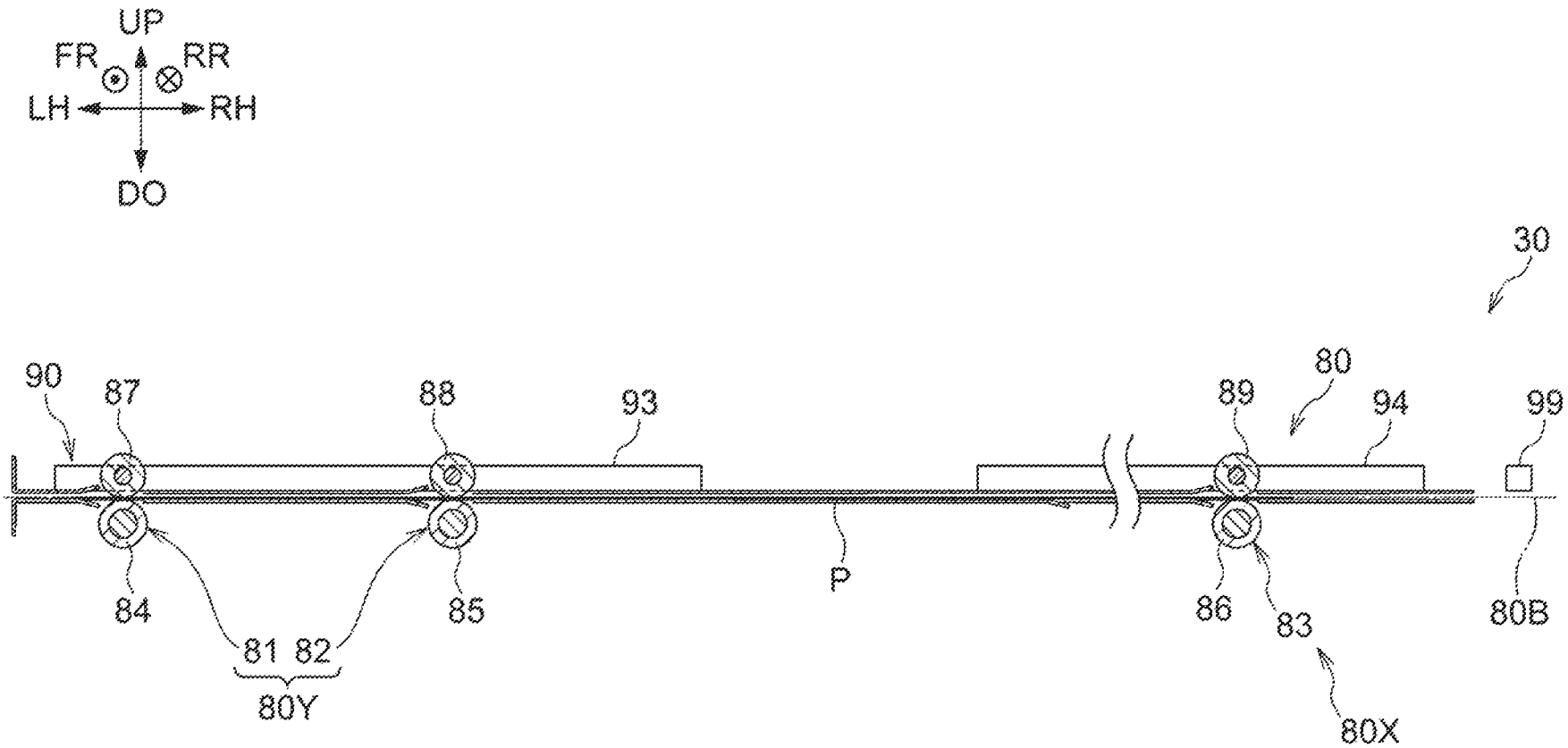
FIG. 17 is a side sectional view of the detection device according to the exemplary embodiment.

As illustrated in FIGS. 16 and 17, the transport unit 80 includes an upstream transport unit 80X and a downstream transport unit 80Y that is disposed downstream of the upstream transport unit 80X in the transporting direction. The upstream transport unit 80X transports the medium P in the first transporting direction and stops the transportation of the medium P in the transport passage 80B. The downstream transport unit 80Y transports the medium P in the first transporting direction and stops the transportation of the medium P in the transport passage 80B. In FIGS. 16 and 17, the transport path surfaces 51A, 61A, and 71A are integrated to simplify the drawings.

The upstream transport unit 80X includes a transport member 83. The transport member 83 is disposed in an upstream region of the detection device 30 in the transporting direction (more specifically, in the right region).

The downstream transport unit 80Y includes transport members 81 and 82. The transport members 81 and 82 are disposed downstream of the transport member 83 in the transporting direction (more specifically, on the left side of the transport member 83). More specifically, the transport member 82 is disposed upstream of the transport member 81 in the transporting direction and downstream of the transport member 83 in the transporting direction. The transport members 81, 82, and 83 each have a function of transporting the medium P in the first transporting direction (which corresponds to the leftward direction) and stopping the transportation of the medium P in the transport passage 80B. The transport members 81, 82, and 83 also have a function of pulling the medium P in the pulling direction along the transport passage 80B. The transport members 81, 82, and 83 also have a function of transporting the medium P in the second transporting direction (which corresponds to the rightward direction) along the transport passage 80B. The transport members 81 and 82 are examples of a downstream transport unit, and the transport member 83 is an example of an upstream transport unit. The transport member 81 is an example of a first transport unit, and the transport member 82 is an example of a second transport unit.

The transport members 81, 82, and 83 respectively include driving rollers 84, 85, and 86, which serve as rotating members that are rotated and that apply transporting force to the medium P, and driven rollers 87, 88, and 89, which serve as driven members that are driven by the driving rollers 84, 85, and 86.

Figure 11:
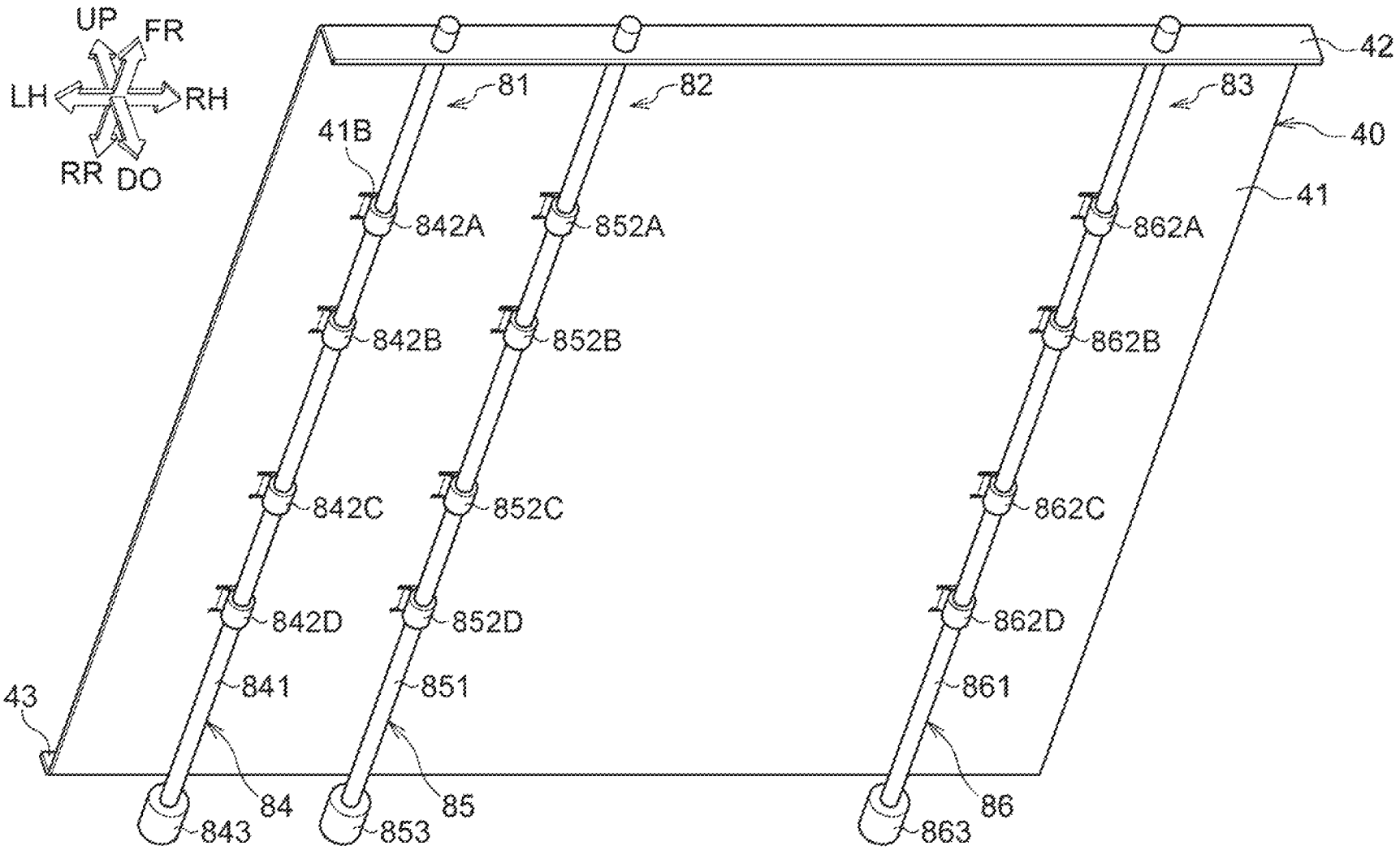
FIG. 11 is a perspective view of the detection device body of the detection device according to the exemplary embodiment viewed from below.

As illustrated in FIG. 11, the driving rollers 84, 85, and 86 respectively include shaft portions 841, 851, and 861; roller portions 842, 852, and 862; and connecting portions 843, 853, and 863. The shaft portions 841, 851, and 861 extend in the front-rear direction. One end (more specifically, front end) of each of the shaft portions 841, 851, and 861 in the axial direction is rotatably supported by the front plate 42 of the detection device body 40. The other end (more specifically, rear end) of each of the shaft portions 841, 851, and 861 in the axial direction is rotatably supported by a shaft support (not illustrated) provided on the plate body 41 of the detection device body 40.

The numbers of the roller portions 842, 852, and 862 are more than one, and the roller portions 842, 852, and 862 are arranged with intervals therebetween in the axial directions of the shaft portions 841, 851, and 861. The roller portions 842, 852, and 862 project upward through respective ones of the openings 41B in the plate body 41. More specifically, the roller portions 842, 852, and 862 of the driving rollers 84, 85, and 86 (more specifically, contact portions that come into contact with the medium P) project upward from the transport path surface 41A of the detection device body 40. In the present exemplary embodiment, the numbers of the roller portions 842, 852, and 862 are four, as indicated by the letters A, B, C, and D added to the reference numerals thereof in the drawings.

The connecting portions 843, 853, and 863 are respectively connected to connecting portions 743, 753, and 763 that are rotated by driving force supplied from drive sources 777 and 778, such as motors. The connecting portions 843, 853, and 863 and the connecting portions 743, 753, and 763 are composed of shaft couplings that are connected to each other in the axial direction. The driving force supplied from the drive source 777 is transmitted to the connecting portions 743 and 753 through transmission members (not illustrated), such as gears. Thus, the transport member 81, which includes the driving roller 84 and the driven rollers 87, and the transport member 82, which includes the driving roller 85 and the driven rollers 88, are rotated by the same drive source 777. The driving force supplied from the drive source 778 is transmitted to the connecting portion 763 through a transmission member (not illustrated), such as a gear. Thus, the transport member 83, which includes the driving roller 86 and the driven rollers 89, is rotated by the drive source 778. The control device 160 functions as a control unit that controls the operations of the drive sources 777 and 778.

The connecting portions 743, 753, and 763, the drive sources 777 and 778, and the control device 160 are provided, for example, in the image forming apparatus body 11 in the present exemplary embodiment. In other words, the connecting portions 743, 753, and 763, the drive sources 777 and 778, and the control device 160 are not components of the detection device 30 in the present exemplary embodiment. The connecting portions 843, 853, and 863 of the driving rollers 84, 85, and 86 are respectively connected to the connecting portions 743, 753, and 763 disposed in the image forming apparatus body 11. Accordingly, the driving force supplied from the drive sources 777 and 778 disposed in the image forming apparatus body 11 is transmitted to the roller portions 842, 852, and 862 through the shaft portions 841, 851, and 861, and the roller portions 842, 852, and 862 are rotated.

As illustrated in FIGS. 4 and 5, the numbers of the driven rollers 87, 88, and 89 are more than one. More specifically, the numbers of the driven rollers 87, 88, and 89 are the same as the numbers of the roller portions 842, 852, and 862, respectively. In the present exemplary embodiment, the numbers of the driven rollers 87, 88, and 89 are four, as indicated by the letters A, B, C, and D added to the reference numerals thereof in the drawings.

The driven rollers 87, 88, and 89 are disposed to face respective ones of the roller portions 842, 852, and 862. More specifically, the numbers of the driven rollers 87, 88, and 89 are more than one (four in the present exemplary embodiment), and the driven rollers 87, 88, and 89 are arranged in the front-rear direction. The letters A, B, C, and D are added to the reference numerals of the driven rollers 87, 88, and 89 such that the rollers denoted by the reference numerals with the letters A, B, C, and D added thereto are arranged in that order in the front-to-rear direction.

When viewed in a direction perpendicular to the image forming surface of the medium P, the driven rollers 87A and 87B are arranged with the sensor 93A described below disposed therebetween in the front-rear direction, and the driven rollers 88A and 88B are arranged with the sensor 93A described below disposed therebetween in the front-rear direction.

When viewed in the direction perpendicular to the image forming surface of the medium P, the roller portions 842A and 842B are also arranged with the sensor 93A described below disposed therebetween in the front-rear direction, and the roller portions 852A and 852B are also arranged with the sensor 93A described below disposed therebetween in the front-rear direction.

More specifically, a left portion of the sensor 93A described below is disposed between the driven rollers 87A and 87B and between the roller portions 842A and 842B in the front-rear direction. A right portion of the sensor 93A described below is disposed between the driven rollers 88A and 88B and between the roller portions 852A and 852B in the front-rear direction.

When viewed in the direction perpendicular to the image forming surface of the medium P, the driven rollers 87C and 87D are arranged with the sensor 93B described below disposed therebetween in the front-rear direction, and the driven rollers 88C and 88D are arranged with the sensor 93B described below disposed therebetween in the front-rear direction.

When viewed in the direction perpendicular to the image forming surface of the medium P, the roller portions 842C and 842D are also arranged with the sensor 93B described below disposed therebetween in the front-rear direction, and the roller portions 852C and 852D are also arranged with the sensor 93B described below disposed therebetween in the front-rear direction.

More specifically, a left portion of the sensor 93B described below is disposed between the driven rollers 87C and 87D and between the roller portions 842C and 842D in the front-rear direction. A right portion of the sensor 93B described below is disposed between the driven rollers 88C and 88D and between the roller portions 852C and 852D in the front-rear direction.

When viewed in the direction perpendicular to the image forming surface of the medium P, the driven rollers 89A and 89B are arranged with the sensor 94A described below disposed therebetween in the front-rear direction, and the roller portions 862A and 862B are arranged with the sensor 94A described below disposed therebetween in the front-rear direction.

When viewed in the direction perpendicular to the image forming surface of the medium P, the driven rollers 89C and 89D are arranged with the sensor 94B described below disposed therebetween in the front-rear direction, and the roller portions 862C and 862D are arranged with the sensor 94B described below disposed therebetween in the front-rear direction.

As described above, in the present exemplary embodiment, when viewed in the direction perpendicular to the image forming surface of the medium P, the driven rollers 87, 88, and 89 and the roller portions 842, 852, and 862 are arranged with the sensors 93 and 94 disposed therebetween as appropriate in the front-rear direction (i.e., the width direction of the medium P).

Figure 13:
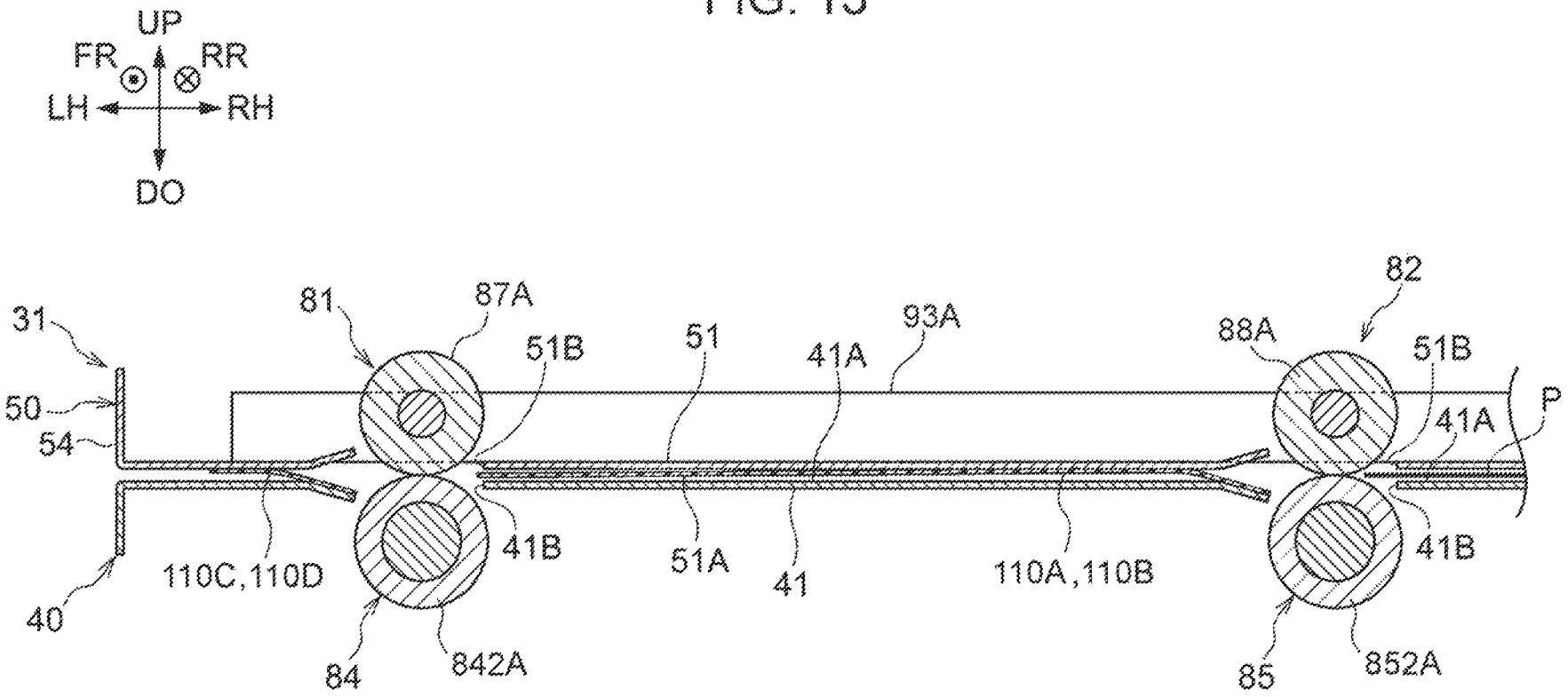
FIG. 13 is a sectional view of FIG. 6 taken along line XIII-XIII, and is also a sectional view of FIG. 12 taken along line XIII-XIII.

As illustrated in FIG. 5, the driven rollers 87 and 88 are disposed in the first unit 31. As illustrated in FIG. 13, the driven rollers 87 and 88 are rotatably supported by the plate body 51 such that the outer peripheral surfaces thereof (i.e., surfaces thereof that come into contact with the medium P) project downward through the openings 51B in the plate body 51 of the first unit 31. In other words, the outer peripheral surfaces of the driven rollers 87 and 88 project downward from the transport path surface 51A of the first unit 31, and are in contact with respective ones of the roller portions 842 and 852.

The driven rollers 89 are disposed in the second unit 32. More specifically, similarly to the driven rollers 87 and 88, the driven rollers 89 are rotatably supported by the plate body 61 such that the outer peripheral surfaces thereof (i.e., surfaces thereof that come into contact with the medium P) project downward through the openings 61B in the plate body 61 of the second unit 32. In other words, the outer peripheral surfaces of the driven rollers 89 project downward from the transport path surface 61A of the plate body 61, and are in contact with the roller portions 862.

In the transport unit 80, the driving rollers 84, 85, and 86 are rotated while the medium P is held between the driving rollers 84, 85, and 86 and the driven rollers 87, 88, and 89, so that transporting force is applied to the medium P and that the medium P is transported along the transport passage 80B.

In addition, in the transport unit 80, the medium P is transported in the first transporting direction or the second transporting direction along the transport passage 80B by switching the rotation directions of the transport members 81, 82, and 83. In addition, in the transport unit 80, the medium P is set to a state in which the transportation of the medium P is stopped and the medium P is pulled in the pulling direction along the transport passage 80B after being transported in the first transporting direction and before being transported in the second transporting direction. This state may hereinafter be referred to as a pulled state. The state in which the medium P is pulled includes not only a state in which both one and the other sides of the medium P that is stopped are not in contact with the transport passage but also a state in which at least one or the other side of the medium P that is stopped is not in contact with the transport passage. The operation of the transport unit 80 is controlled by the control device 160. The transporting operation performed by the transport unit 80 will be described below.

In addition, the transport unit 80 has the transport path surfaces 41A, 51A, 61A, and 71A that face one and the other surfaces of the medium P in the pulled state (see FIG. 1). The transport path surface 41A, which is the upper surface of the plate body 41 of the detection device body 40 as described above (see FIGS. 5 and 13), faces the lower surface of the medium P in the pulled state and guides the lower surface of the medium P.

The transport path surface 41A is a flat surface that extends over the entire area of the medium P. More specifically, the transport path surface 41A is a flat surface that extends over the entire area of the medium P having a maximum size that may be used in the image forming apparatus 10. Still more specifically, the transport path surface 41A is larger than the medium P having the maximum size in both the transporting direction and the width direction. The transport path surface 41A may include regions having projections and recesses. For example, the transport path surface 41A may have projections in regions where members such as the reflection plates 97 are arranged and regions where members such as the roller portions 842, 852, and 862 project. In addition, for example, the transport path surface 41A may have recesses in regions where holes, such as the openings 416B, grooves, and dents are formed. In addition, the transport path surface 41A may have regions in which at least recesses or projections are formed by forming ribs or drawing the metal plate to reduce the contact area between the transport path surface 41A and the medium P. Thus, the expression "flat surface" includes flat surfaces having regions where projections and recesses are present.

The transport path surface 51A, which is the lower surface of the plate body 51 of the first unit 31 as described above (see FIGS. 7A, 7B, and 13), faces the upper surface of the medium P in the pulled state and guides the upper surface of the medium P. The transport path surface 61A, which is the lower surface of the plate body 61 of the second unit 32 as described above (see FIGS. 7A and 7B), faces the upper surface of the medium P in the pulled state and guides the upper surface of the medium P. The transport path surface 71A, which is the lower surface of the plate body 71 of the opening-closing portion 70 as described above (see FIG. 10), faces the upper surface of the medium P in the pulled state and guides the upper surface of the medium P.

A passage surface composed of the transport path surfaces 51A, 61A, and 71A and disposed above the medium P in the pulled state is a flat surface that extends over the entire area of the medium P. More specifically, the passage surface is a flat surface that extends over the entire area of the medium P having the maximum size that may be used in the image forming apparatus 10.

The transport members 81 and 82 have a function of transporting the medium P as described above, but may also be regarded as support portions that support the medium P transported by the transport member 83. More specifically, the driving rollers 84 and 85 support the lower surface of the medium P with the roller portions 842 and 852 that project upward from the transport path surface 41A of the detection device body 40. The driven rollers 87 and 88 press the medium P against the driving rollers 84 and 85 with the outer peripheral surfaces thereof that project downward from the transport path surface 51A of the first unit 31.

Thus, in the transport unit 80, the driving rollers 84 and 85 support the lower surface of the medium P at a position above the transport path surface 41A of the detection device body 40 (i.e., at a position separated from the transport path surface 41A).

The transport members 81 and 82 are disposed at positions corresponding to media P having different transporting-direction dimensions. More specifically, the transport member 81 is disposed at a position such that the transport member 81 is capable of supporting a downstream edge portion of a medium P having a maximum size (more specifically, a maximum transporting-direction dimension) that may be used in the image forming apparatus 10 in the transporting direction. The transport member 82 is disposed at a position such that the transport member 82 is capable of supporting a downstream edge portion of a medium P having a minimum size (more specifically, a minimum transporting-direction dimension) that may be used in the image forming apparatus 10 in the transporting direction.

In the transport unit 80, the distance between the transport member 82 of the downstream transport unit 80Y and the upstream transport unit 80X (more specifically, the transport member 83) is greater than the distance between the transport members 81 and 82 of the downstream transport unit 80Y.

Trailing Edge Sensor 99

The trailing edge sensor 99 is a sensing unit that senses the trailing edge portion of the medium P. The trailing edge sensor 99 is disposed upstream of the transport member 83 in the transporting direction. In other words, the trailing edge sensor 99 senses the trailing edge portion of the medium P at a location upstream of the transport member 83 in the transporting direction.

More specifically, the trailing edge sensor 99 is a non-contact sensor that senses the trailing edge portion of the medium P without coming into contact with the medium P. Still more specifically, the trailing edge sensor 99 is an optical sensor that uses light emitted toward the medium P. Still more specifically, the trailing edge sensor 99 is a reflective optical sensor that senses the trailing edge portion of the medium P by sensing light emitted toward and reflected by the medium P. The trailing edge sensor 99 may instead be a transmissive optical sensor.

In the present exemplary embodiment, as described below, components of the transport unit 80 are operated with reference to the time at which the trailing edge portion of the medium P is sensed by the trailing edge sensor 99.

Control Device 160

Figure 18:
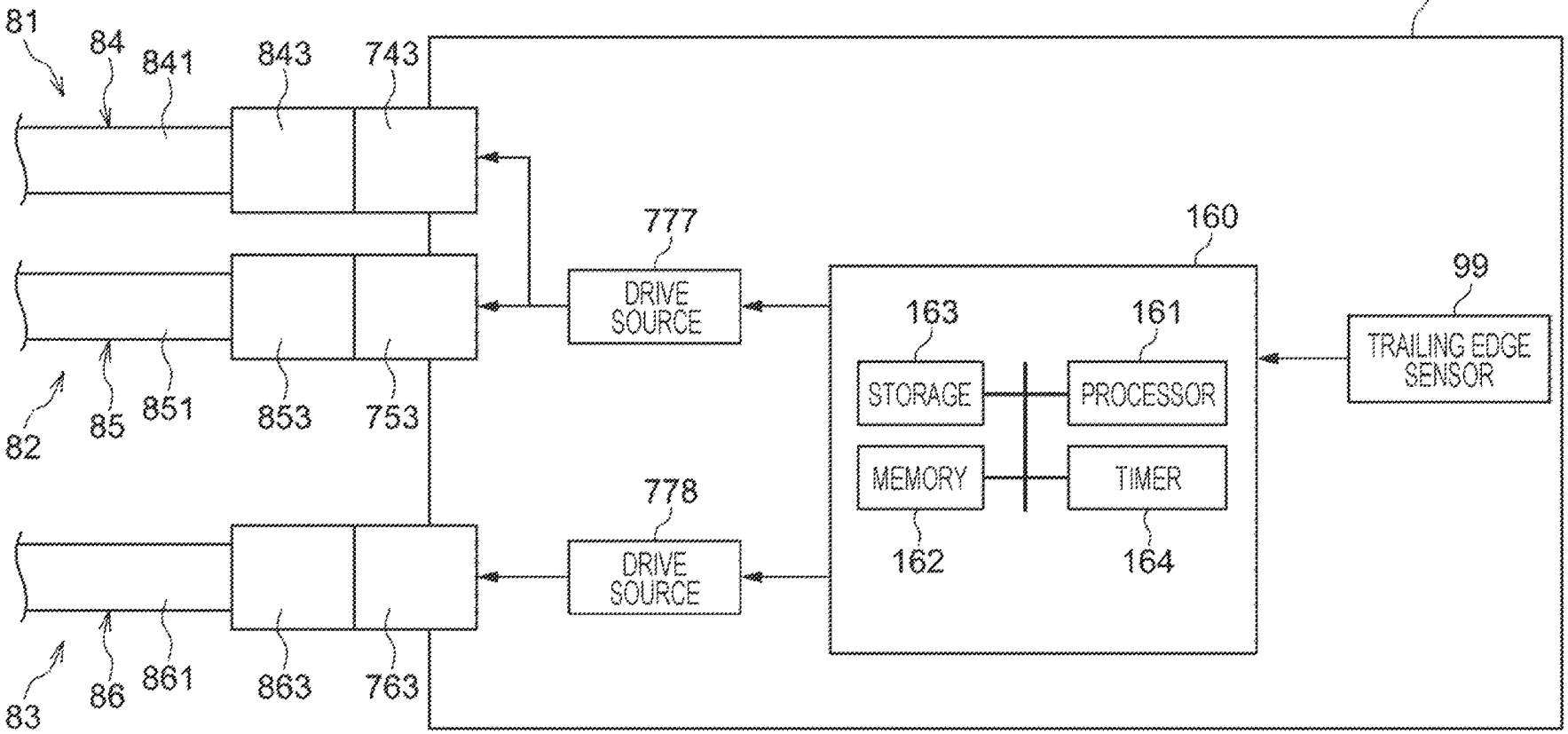
FIG. 18 is a block diagram illustrating an example of a hardware configuration of another control device according to the exemplary embodiment.

The structure of the control device 160 will now be described. The control device 160 has a control function of controlling the operation of the image forming apparatus 10 including the detection device 30. In the present exemplary embodiment, the control device 160 controls the operation of the transport unit 80 included in the detection device 30. More specifically, as illustrated in FIG. 18, the control device 160 includes a processor 161, a memory 162, a storage 163, and a timer 164.

The term "processor" refers to hardware in a broad sense. Examples of the processor 161 include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

The storage 163 stores various programs including a control program 163A (see FIG. 19) and various data. The storage 163 may be realized as a recording device, such as a hard disk drive (HDD), a solid state drive (SSD), or a flash memory.

The memory 162 is a work area that enables the processor 161 to execute various programs, and temporarily stores various programs or various data when the processor 161 performs a process. The processor 161 reads various programs including the control program 163A into the memory 162 from the storage 163, and executes the programs by using the memory 162 as a work area. The timer 164 is a measurement unit used to measure first, second, and third elapsed times described below.

Figure 19:
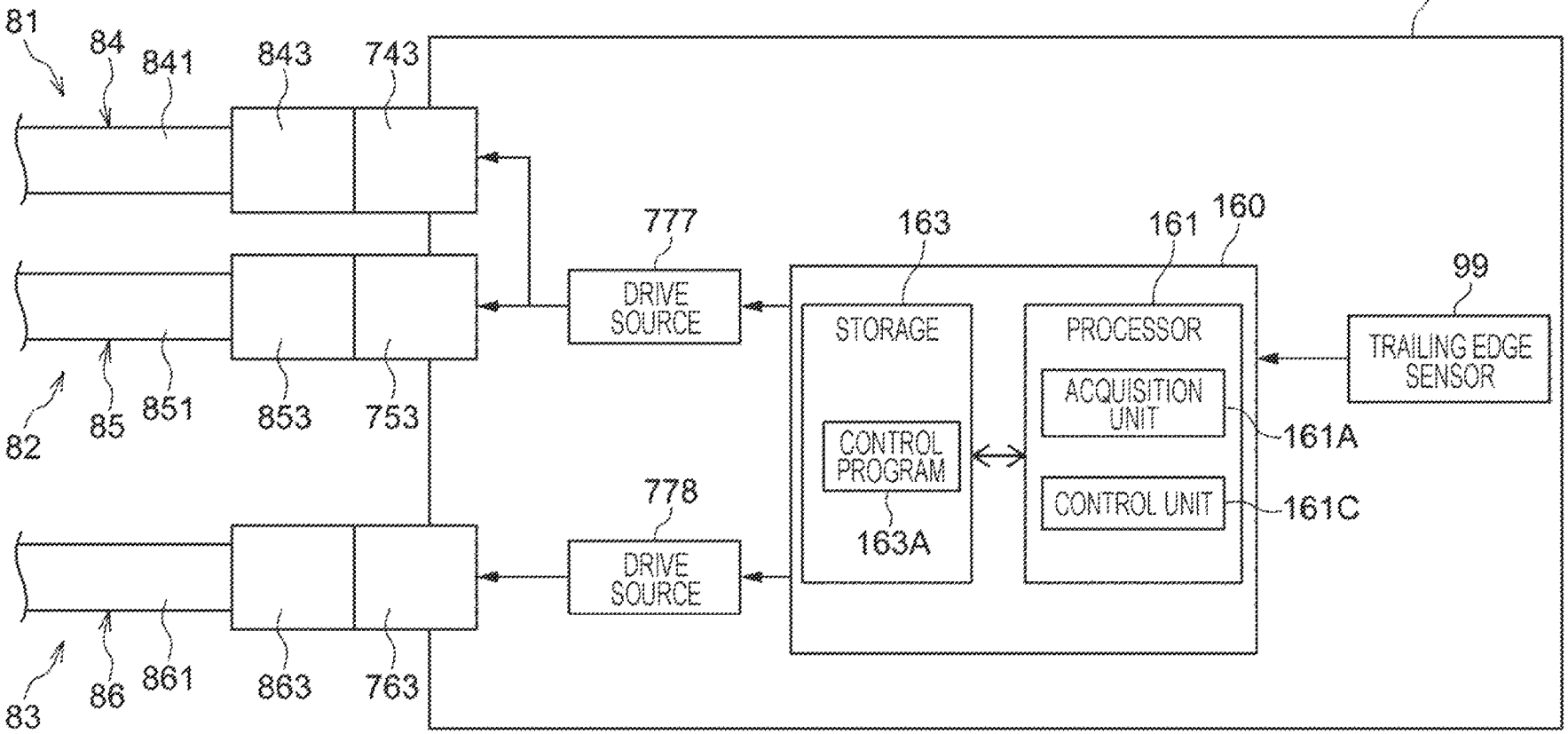
FIG. 19 is a block diagram illustrating an example of a functional configuration of a processor included in the other control device according to the exemplary embodiment.

In the control device 160, the processor 161 executes the control program 163A to realize various functions. A functional configuration realized by cooperation of the processor 161, which serves as a hardware resource, and the control program 163A, which serves as a software resource, will now be described. FIG. 19 is a block diagram illustrating the functional configuration of the processor 161.

Referring to FIG. 19, in the control device 160, the processor 161 executes the control program 163A to function as an acquisition unit 161A and a control unit 161C. The acquisition unit 161A acquires detection information obtained by the trailing edge sensor 99 that detects the trailing edge portion of the medium P.

The control unit 161C controls the transport unit 80 (more specifically, the drive sources 777 and 778) to execute a transporting operation described below.

Figure 20:
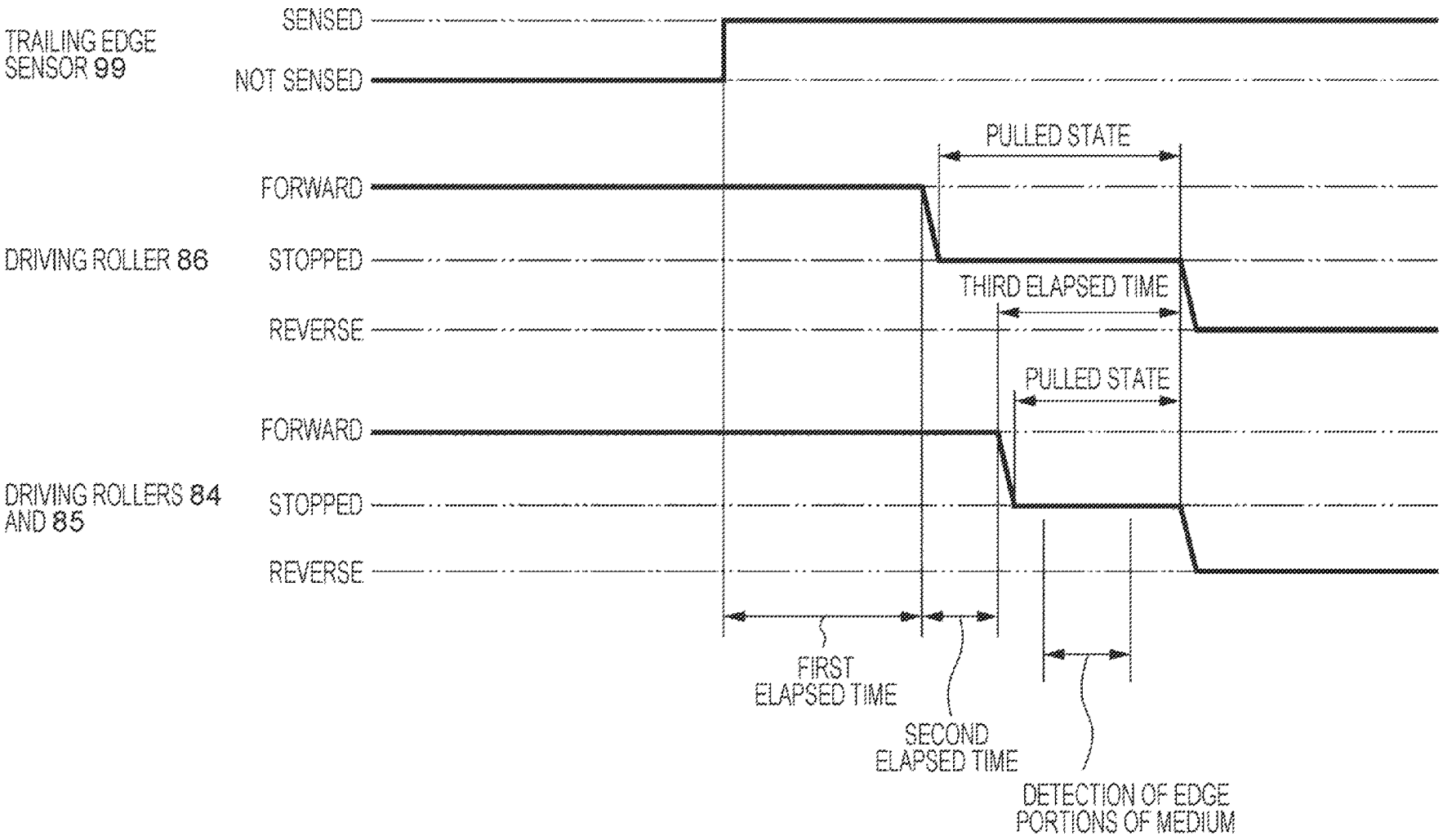
FIG. 20 is a timing chart of the detection device according to the exemplary embodiment.

Referring to FIG. 20, the transport unit 80 operates so that the driving rollers 84, 85, and 86 are driven to rotate in a forward direction thereof (counterclockwise in FIG. 16) and that the driven rollers 87, 88, and 89 are rotated in a forward direction thereof (clockwise in FIG. 16). Accordingly, the medium P is transported in the first transporting direction (which corresponds to the leftward direction).

Next, after a first elapsed time from the detection of the trailing edge portion of the medium P by the trailing edge sensor 99, the driving roller 86 and the driven rollers 89 stop to rotate (more specifically, start a rotation stopping process).

Next, after a second elapsed time from the stoppage of rotation of the driving roller 86 and the driven rollers 89 (more specifically, from the start of the rotation stopping process), the driving rollers 84 and 85 and the driven rollers 87 and 88 stop to rotate (more specifically, start a rotation stopping process). Accordingly, the medium P is stopped. Since the rotations of the driving roller 86 and the driven rollers 89 and the rotations of the driving rollers 84 and 85 and the driven rollers 87 and 88 are stopped at different times, the medium P is pulled in the pulling direction. Thus, the transportation of the medium P is stopped and the medium P is pulled in the pulling direction in the transport passage 80B.

Then, after a third elapsed time from the stoppage of rotation of the driving rollers 84 and 85 (more specifically, from the start of the rotation stopping process), the driving rollers 84, 85, and 86 are rotated in a reverse direction thereof (clockwise in FIG. 16), and the driven rollers 87, 88, and 89 are rotated in a reverse direction thereof (counterclockwise in FIG. 16). Accordingly, the medium P is transported in the second transporting direction (which corresponds to the rightward direction).

As described above, in the transport unit 80, the transport members 81, 82, and 83 (driving rollers 84, 85, and 86 and driven rollers 87, 88, and 89) transport the medium P in the first transporting direction, and then stop the transportation of the medium P. The transport members 81 and 82 stop transporting the medium P after the transport member 83 stops transporting the medium P, so that the medium P is pulled in the pulling direction by the transport members 81, 82, and 83. Then, as described below, the leading/trailing edge detection unit 90 and the side edge detection unit 98 detect the edge portions (more specifically, the leading and trailing edge portions and a pair of side edge portions) of the medium P in the pulled state.

Since the transport members 81 and 82 are driven by the same drive source 777, the transport member 81 rotates (in forward and reverse directions) and stops rotating together with the transport member 82.

As described above, in the present exemplary embodiment, the rotation of the transport member 83 is stopped with reference to the time at which the trailing edge portion of the medium P is sensed by the trailing edge sensor 99. Accordingly, the transport member 83 stops transporting the medium P so that the amount by which the trailing edge of the medium P projects upstream from the transport member 83 in the transporting direction is substantially constant irrespective of the transporting-direction dimension of the medium P. The transport members 81, 82, and 83 restart the transportation of the medium P from the edge portion that projects by the substantially constant amount (i.e., the upstream edge portion in the transporting direction (more specifically, the right edge portion)).

FIG. 16 illustrates a stop position at which the medium P having the minimum size is stopped in the transport passage 80B, and FIG. 17 illustrates a stop position at which the medium P having the maximum size is stopped in the transport passage 80B.

When the medium P having the minimum size is at the stop position, an upstream portion of the medium P in the transporting direction is held between the driving roller 86 and the driven rollers 89, and a downstream portion of the medium P in the transporting direction is held between the driving roller 85 and the driven rollers 88. Therefore, the medium P having the minimum size is pulled between the transport member 82 (driving roller 85 and driven rollers 88) and the transport member 83 (driving roller 86 and driven rollers 89).

When the medium P having the maximum size is at the stop position, an upstream portion of the medium P in the transporting direction is held between the driving roller 86 and the driven rollers 89, and a downstream portion of the medium P in the transporting direction is held between the driving roller 84 and the driven rollers 87. Therefore, the medium P having the maximum size is pulled between the transport member 81 (driving roller 84 and driven rollers 87) and the transport member 83 (driving roller 86 and driven rollers 89).

The medium P having the maximum size is an example of the media in the case where "a transporting-direction dimension of the medium is greater than or equal to a predetermined length", and at least has the maximum transporting-direction dimension. The medium P having the minimum size is an example of the medium in the case where "a transporting-direction dimension of the medium is less a predetermined length", and at least has the minimum transporting-direction dimension.

Although the control device 160 is disposed in the image forming apparatus 10, the control device 160 is not limited to this. For example, the control device 160 may instead be disposed in the detection device 30 or in another device that is disposed outside the image forming apparatus 10. The location of the control device 160 is not limited.

Leading/Trailing Edge Detection Unit 90

The leading/trailing edge detection unit 90 has a function of detecting the leading and trailing edge portions of the medium P while the transportation of the medium P is stopped and while the medium P is pulled in the pulling direction. The leading/trailing edge detection unit 90 is an example of a detection unit.

As illustrated in FIGS. 5 and 6, the leading/trailing edge detection unit 90 includes the sensors 93 and 94, the sensor substrates 95, wires 96 (see FIG. 6), and the reflection plates 97 (see FIG. 5).

As illustrated in FIGS. 5 and 6, the numbers of the sensors 93 and 94 are more than one. More specifically, the sensors 93 and 94 are provided in pairs (the numbers thereof are two), as indicated by the letters A and B added to the reference numerals thereof in the drawings.

The sensors 93 are sensing units that sense the leading edge portion of the medium P. The sensors 94 are sensing units that sense the trailing edge portion of the medium P. The sensors 93 and 94 are non-contact sensors that sense the edge portions of the medium P without coming into contact with the medium P. More specifically, the sensors 93 and 94 are optical sensors that use light emitted toward the medium P. Still more specifically, the sensors 93 and 94 are line sensors which each extend in the transporting direction and include plural sensing elements (more specifically, light emitting elements and light receiving elements) arranged in the transporting direction. Still more specifically, the sensors 93 and 94 are, for example, contact image sensors (CISs). The sensors 93 and 94 may instead be line sensors other than contact image sensors.

The sensing elements of the sensors 93 and 94 arranged in the transporting direction form detection regions. The lengths of the detection regions in the transporting direction are equal to or less than the transporting-direction dimensions of the sensors 93 and 94. The sensors 93 and 94 determine the positions of the edge portions of the medium P based on boundaries between the sensing elements in a sensing state and the sensing elements in a non-sensing state in the detection regions thereof. Then, position information represented by the coordinates of the determined positions (more specifically, the numbers of pixels counted from the downstream ends of the detection regions in the transporting direction) is transmitted to, for example, the control device 160.

The sensors 93 are arranged in a downstream region of the detection device 30 in the transporting direction (more specifically, a left region of the detection device 30). The sensors 93 are positioned to face the downstream edge portion of the medium P in the transporting direction when the medium P is in the pulled state. More specifically, when viewed in the direction perpendicular to the image forming surface of the medium P, the sensors 93 are arranged to cross the downstream edge portion of the medium P in the transporting direction in the longitudinal direction thereof when the medium P is in the pulled state. The sensors 93 sense the downstream edge portion of the medium P. Still more specifically, when viewed in the direction perpendicular to the image forming surface of the medium P, the sensors 93 are arranged such that the detection regions thereof cross the downstream edge portion of the medium P in the transporting direction in the longitudinal direction thereof when the medium P is stopped at the predetermined position and is in the pulled state. In other words, the sensors 93 are arranged such that the downstream edge portion of the medium P in the transporting direction is positioned between one and the other ends of the detection region of each sensor 93 in the longitudinal direction thereof when the medium P is stopped at the predetermined position and is in the pulled state.

The sensors 94 are arranged in an upstream region of the detection device 30 in the transporting direction (more specifically, a right region of the detection device 30). The sensors 94 are positioned to face the upstream edge portion of the medium P in the transporting direction when the medium P is in the pulled state. More specifically, when viewed in the direction perpendicular to the image forming surface of the medium P, the sensors 94 are arranged to cross the upstream edge portion of the medium P in the transporting direction in the longitudinal direction thereof when the medium P is in the pulled state. The sensors 94 sense the upstream edge portion of the medium P. Still more specifically, when viewed in the direction perpendicular to the image forming surface of the medium P, the sensors 94 are arranged such that the detection regions thereof cross the upstream edge portion of the medium P in the transporting direction in the longitudinal direction thereof when the medium P is stopped at the predetermined position and is in the pulled state. In other words, the sensors 94 are arranged such that the upstream edge portion of the medium P in the transporting direction is positioned between one and the other ends of the detection region of each sensor 94 in the longitudinal direction thereof when the medium P is stopped at the predetermined position and is in the pulled state.

More specifically, the sensors 93A and 94A are arranged next to each other in the left-right direction in a front region of the detection device 30. The sensors 93B and 94B are arranged next to each other in the left-right direction in a rear region of the detection device 30.

The numbers of the sensor substrates 95, the wires 96, and the reflection plates 97 included in the leading/trailing edge detection unit 90 are more than one. More specifically, the numbers of the sensor substrates 95, the wires 96, and the reflection plates 97 are equal to the number of the sensors 93 and 94. In the leading/trailing edge detection unit 90, the numbers of the wires 96 and the reflection plates 97 are four. In addition, the number of the sensor substrates 95 is also four, as indicated by the letters B, C, F, and G added to the reference numeral thereof.

The four sensor substrates 95 are driving substrates that drive respective ones of the four sensors 93 and 94. The four sensor substrates 95 are disposed close to respective ones of the four sensors 93 and 94. More specifically, each of the sensors 93 and 94 is driven by one of the four sensor substrates 95 that is closest thereto. In other words, the sensors 93A, 93B, 94A, and 94B are driven by the sensor substrates 95B, 95C, 95F, and 95G, respectively.

The four wires 96 are connection lines that electrically connect the four sensor substrates 95 to the respective ones of the four sensors 93 and 94. The four wires 96 are not bundled together, and are arranged separately from each other. In other words, the four wires 96 are arranged such that none of the wires 96 extends along the other wires 96. The four wires 96 are arranged so as not to cross each other. The four reflection plates 97 are arranged on the transport path surface 41A of the plate body 41 of the detection device body 40 to face respective ones of the four sensors 93 and 94. In consideration of a case in which the medium P is a white paper sheet, for example, the reflection plates 97 are colored in black, which has a relatively large difference in reflectance from white.

Side Edge Detection Unit 98

The side edge detection unit 98 has a function of detecting the side edge portions of the medium P when the leading/trailing edge detection unit 90 detects the leading and trailing edge portions. In other words, the side edge detection unit 98 detects the side edge portions of the medium P in the pulled state. As illustrated in FIGS. 5 and 6, the side edge detection unit 98 includes the sensors 91 and 92, the sensor substrates 95, the wires 96 (see FIG. 6), and the reflection plates 97 (see FIG. 5). The side edge detection unit 98 is an example of a side-edge-portion detection unit.

As illustrated in FIGS. 5 and 6, the numbers of the sensors 91 and 92 are more than one. More specifically, the sensors 91 and 92 are provided in pairs (the numbers thereof are two), as indicated by the letters A and B added to the reference numerals thereof in the drawings.

The sensors 91 are sensing units that sense one side edge portion (side edge portion adjacent to the front of the apparatus) of the medium P. The sensors 92 are sensing units that sense the other side edge portion (side edge portion adjacent to the rear of the apparatus) of the medium P. The sensors 91 and 92 are non-contact sensors that sense the edge portions of the medium P without coming into contact with the medium P. More specifically, the sensors 91 and 92 are optical sensors that use light emitted toward the medium P. Still more specifically, the sensors 91 and 92 are line sensors which each extend in the width direction and include plural sensing elements (more specifically, light emitting elements and light receiving elements) arranged in the width direction. Still more specifically, the sensors 91 and 92 are, for example, contact image sensors (CISs). The sensors 91 and 92 may instead be line sensors other than contact image sensors.

The sensing elements of the sensors 91 and 92 arranged in the width direction form detection regions. The lengths of the detection regions in the width direction are equal to or less than the width-direction dimensions of the sensors 91 and 92. The sensors 91 and 92 determine the positions of the edge portions of the medium P based on boundaries between the sensing elements in a sensing state and the sensing elements in a non-sensing state in the detection regions thereof. Then, position information represented by the coordinates of the determined positions (more specifically, the numbers of pixels counted from the rear ends of the detection regions) is transmitted to, for example, the control device 160.

The sensors 91 are arranged in a front region of the detection device 30. The sensors 91 are positioned to face a first side edge portion (one edge portion in the width direction) of the medium P when the medium P is in the pulled state. More specifically, when viewed in the direction perpendicular to the image forming surface of the medium P, the sensors 91 are arranged to cross the first side edge portion of the medium P in the longitudinal direction thereof when the medium P is in the pulled state. The sensors 91 sense the first side edge portion. Still more specifically, when viewed in the direction perpendicular to the image forming surface of the medium P, the sensors 91 are arranged such that the detection regions thereof cross the first side edge portion of the medium P in the longitudinal direction thereof when the medium P is stopped at the predetermined position and is in the pulled state. In other words, the sensors 91 are arranged such that the first side edge portion of the medium P is positioned between one and the other ends of the detection region of each sensor 91 in the longitudinal direction thereof when the medium P is stopped at the predetermined position and is in the pulled state.

The sensors 92 are arranged in a rear region of the detection device 30. The sensors 92 are positioned to face a second side edge portion (other edge portion in the width direction) of the medium P when the medium P is in the pulled state. More specifically, when viewed in the direction perpendicular to the image forming surface of the medium P, the sensors 92 are arranged to cross the second side edge portion of the medium P in the longitudinal direction thereof when the medium P is in the pulled state. The sensors 92 sense the second side edge portion. Still more specifically, when viewed in the direction perpendicular to the image forming surface of the medium P, the sensors 92 are arranged such that the detection regions thereof cross the second side edge portion of the medium P in the longitudinal direction thereof when the medium P is stopped at the predetermined position and is in the pulled state. In other words, the sensors 92 are arranged such that the second side edge portion of the medium P is positioned between one and the other ends of the detection region of each sensor 92 in the longitudinal direction thereof when the medium P is stopped at the predetermined position and is in the pulled state.

More specifically, the sensors 91A and 92A are arranged next to each other in the front-rear direction in a downstream region of the detection device 30 in the transporting direction (more specifically, in the first unit 31). The sensors 91B and 92B are arranged next to each other in the front-rear direction in an upstream region of the detection device 30 in the transporting direction (more specifically, in the second unit 32).

In the present exemplary embodiment, the sensors 91 and 92 are disposed between the sensors 93 and 94 in side view. More specifically, the sensors 91 and 92 are disposed upstream of the sensors 93 and downstream of the sensors 94 in the transporting direction. Here, "side view" means a view in a direction from one side toward the other side of the medium P in the width direction.

The numbers of the sensor substrates 95, the wires 96, and the reflection plates 97 included in the side edge detection unit 98 are more than one. More specifically, the numbers of the sensor substrates 95, the wires 96, and the reflection plates 97 are equal to the number of the sensors 91 and 92. In the side edge detection unit 98, the numbers of the wires 96 and the reflection plates 97 are four. In addition, the number of the sensor substrates 95 is also four, as indicated by the letters A, D, E, and H added to the reference numeral thereof.

The four sensor substrates 95 are driving substrates that drive respective ones of the four sensors 91 and 92. The four sensor substrates 95 are disposed close to respective ones of the four sensors 91 and 92. More specifically, each of the sensors 91 and 92 is driven by one of the four sensor substrates 95 that is closest thereto. In other words, the sensors 91A, 92A, 91B, and 92B are driven by the sensor substrates 95A, 95D, 95E, and 95H, respectively.

The four wires 96 are connection lines that electrically connect the four sensor substrates 95 to the respective ones of the four sensors 91 and 92. The four wires 96 are not bundled together, and are arranged separately from each other. In other words, the four wires 96 are arranged such that none of the wires 96 extends along the other wires 96. The four wires 96 are arranged so as not to cross each other. The four reflection plates 97 are arranged on the transport path surface 41A of the plate body 41 of the detection device body 40 to face respective ones of the four sensors 91 and 92. In consideration of a case in which the medium P is a white paper sheet, for example, the reflection plates 97 are colored in black, which has a relatively large difference in reflectance from white.

In the present exemplary embodiment, the sensor substrates 95A, 95B, 95C, and 95D are attached to the attachment plate 59A of the substrate support 59 and arranged in that order in the rearward direction. The sensor substrates 95E, 95F, 95G, and 95H are attached to the attachment plate 69A of the substrate support 69 and arranged in that order in the rearward direction.

In addition, in the present exemplary embodiment, the sensors 91A, 92A, 93A, and 93B and the sensor substrates 95A, 95B, 95C, and 95D are provided in the first unit 31. The wires 96 that electrically connect the sensors 91A, 92A, 93A, and 93B to the sensor substrates 95A, 95B, 95C, and 95D, respectively, are also provided in the first unit 31.

In addition, in the present exemplary embodiment, the sensors 91B, 92B, 94A, and 94B and the sensor substrates 95E, 95F, 95G, and 95H are provided in the second unit 32. The wires 96 that electrically connect the sensors 91B, 92B, 94A, and 94B to the sensor substrates 95E, 95F, 95G, and 95H, respectively, are also provided in the second unit 32. Thus, the sensors 91 to 94 are provided in the first unit 31 and the second unit 32, and sense the edge portions of the medium P in the pulled state from above the medium P. Accordingly, adhesion of foreign matter, such as paper dust, to the sensors 91 to 94 is reduced compared to a case in which the sensors 91 to 94 sense the edge portions of the medium P in the pulled state from below the medium P.

Pressing Members 110

Figure 12:
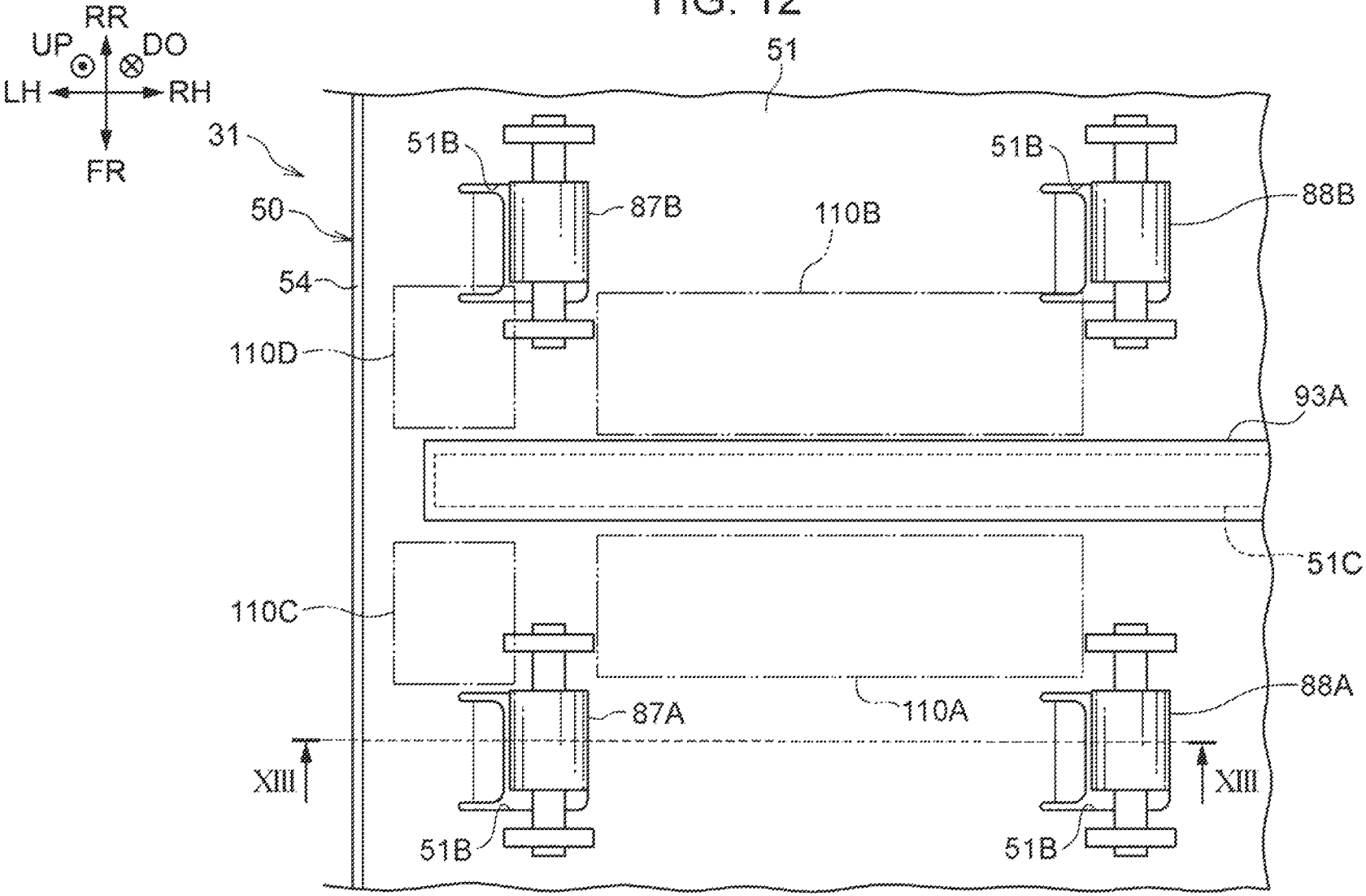
FIG. 12 is an enlarged plan view of a portion of the structure of the detection device according to the exemplary embodiment.

The pressing members 110 illustrated in FIGS. 12 and 13 are members that press an edge portion of the medium P in the pulled state. Here, to press an edge portion of the medium P means to limit the movement of the edge portion of the medium P from above and below the medium P.

As illustrated in FIGS. 12 and 13, plural pressing members 110 are provided. More specifically, in the present exemplary embodiment, four pressing members 110 are provided, as indicated by the letters A, B, C, and D added to the reference numeral thereof in FIG. 12. The pressing members 110 are composed of plate-shaped elastic members, such as resin films.

As illustrated in FIG. 13, the pressing members 110A and 110B are disposed between the transport members 81 and 82 in side view. In addition, as illustrated in FIG. 12, the pressing members 110A and 110B are arranged such that the sensor 93A is disposed therebetween in the front-rear direction when viewed in the direction perpendicular to the image forming surface of the medium P.

As illustrated in FIG. 13, the pressing members 110C and 110D are disposed downstream of the transport member 81 in the transporting direction in side view. In addition, as illustrated in FIG. 12, the pressing members 110C and 110D are arranged such that the sensor 93A is disposed therebetween in the front-rear direction when viewed in the direction perpendicular to the image forming surface of the medium P.

The pressing members 110A, 110B, 110C, and 110D are attached to the transport path surface 41A of the detection device body 40 at upstream end portions thereof in the transporting direction (i.e., right end portions thereof), and downstream portions thereof in the transporting direction (i.e., left portions thereof) are pressed against the transport path surface 51A of the first unit 31 by elastic force thereof. Thus, the pressing members 110A, 110B, 110C, and 110D retain an edge portion (more specifically, a downstream edge portion) of the medium P in the pulled state by pressing the medium P transported between the transport path surface 51A and themselves against the transport path surface 51A.

Although not illustrated in FIGS. 12 and 13 and other drawings, in the present exemplary embodiment, additional pressing members 110 are arranged in a configuration similar to that described above such that the sensor 93B is disposed therebetween in the front-rear direction when viewed in the direction perpendicular to the image forming surface of the medium P.

As described above, in the present exemplary embodiment, the pressing members 110 are arranged such that the sensors 93 are disposed therebetween in the front-rear direction as appropriate when viewed in the direction perpendicular to the image forming surface of the medium P.

Pressing Members 120

The pressing members 120 illustrated in FIG. 6 are examples of a support portion, and support the medium P whose side edge portions are detected by the side edge detection unit 98. More specifically, the pressing members 120 press the side edge portions of the medium P in the pulled state. Here, to press the side edge portions of the medium P means to limit the movement of the side edge portions of the medium P from above and below the medium P.

As illustrated in FIG. 6, plural pressing members 120 are provided. More specifically, in the present exemplary embodiment, four pressing members 120 are provided, as indicated by the letters A, B, C, and D added to the reference numeral thereof in FIG. 6. The pressing members 120 are composed of plate-shaped elastic members, such as resin films.

The pressing members 120A, 120B, 120C, and 120D are disposed downstream of the transport member 83 and upstream of the transport member 82 in the transporting direction.

The pressing member 120A is disposed upstream of the sensor 92A in the transporting direction and extends along the sensor 92A. The length of the pressing member 120A in the front-rear direction is substantially equal to the length of the sensor 92A in the front-rear direction.

The pressing member 120B is disposed upstream of the sensor 92B in the transporting direction and extends along the sensor 92B. The length of the pressing member 120B in the front-rear direction is substantially equal to the length of the sensor 92B in the front-rear direction. The pressing members 120A and 120B are disposed behind the sensors 93B and 94B.

The pressing member 120C is disposed upstream of the sensor 91A in the transporting direction and extends along the sensor 91A. The length of the pressing member 120C in the front-rear direction is substantially equal to the length of the sensor 91A in the front-rear direction.

The pressing member 120D is disposed upstream of the sensor 91B in the transporting direction and extends along the sensor 91B. The length of the pressing member 120D in the front-rear direction is substantially equal to the length of the sensor 91B in the front-rear direction. The pressing members 120C and 120D are disposed in front of the sensors 93A and 94A.

The pressing members 120A, 120B, 120C, and 120D are attached to the transport path surface 41A of the detection device body 40 at upstream end portions thereof in the transporting direction (i.e., right end portions thereof), and downstream portions thereof in the transporting direction (i.e., left portions thereof) are pressed against the transport path surface 51A of the first unit 31 by elastic force thereof. Thus, the pressing members 120A, 120B, 120C, and 120D retain the side edge portions of the medium P in the pulled state by pressing the medium P transported between the transport path surface 51A and themselves against the transport path surface 51A. Thus, the side edge portions of the medium P are supported.

The sensors 91A, 91B, 92A, and 92B detect the side edge portions of the medium P while the side edge portions are supported by the pressing members 120A, 120B, 120C, and 120D.

Although the pressing members 120A, 120B, 120C, and 120D extend in the front-rear direction in the present exemplary embodiment, each of the pressing members 120A, 120B, 120C, and 120D may instead be composed of plural members that are separated from each other in the front-rear direction.

Control Function of Control Device 160 for Controlling Detection Device 30

Figure 14:
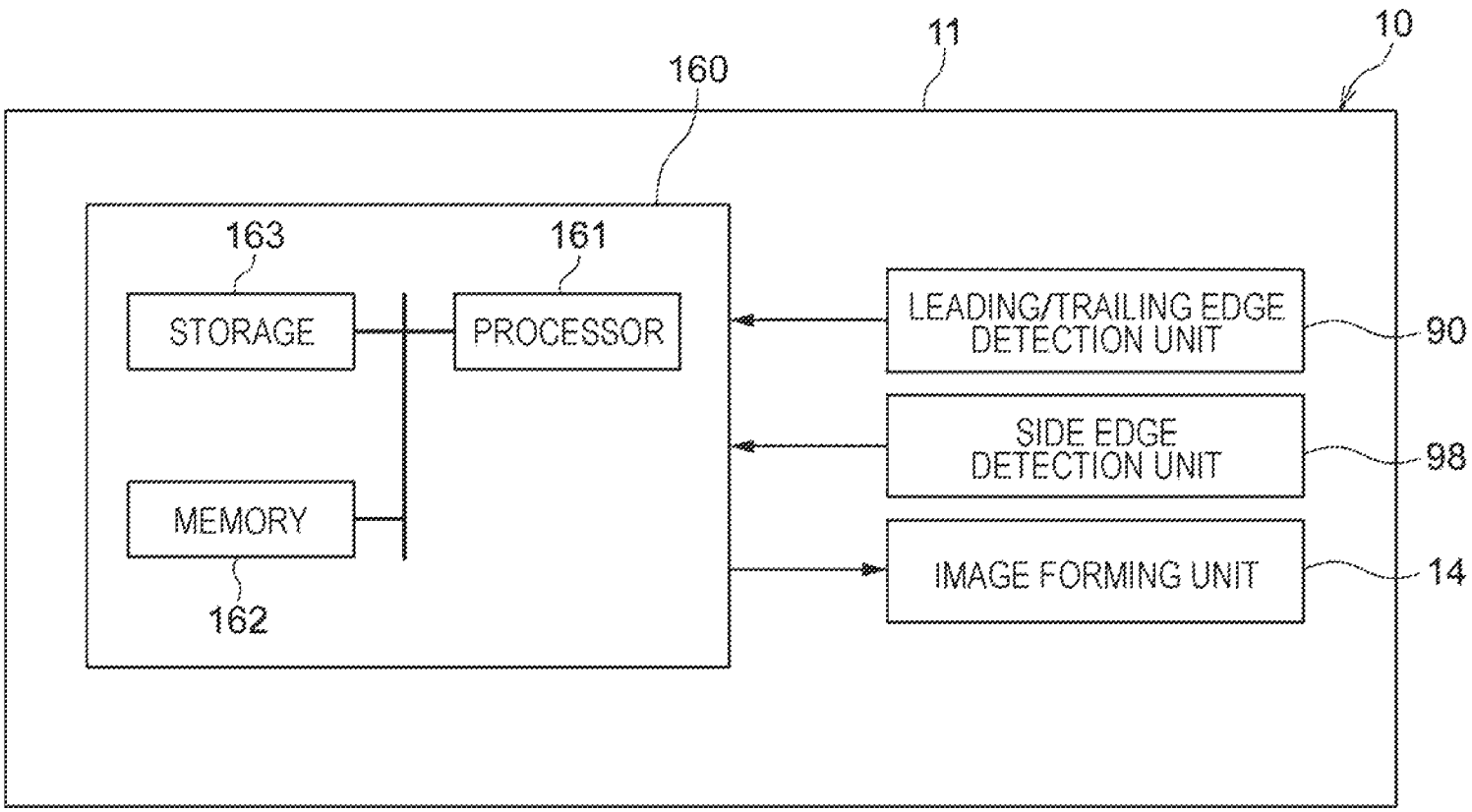
FIG. 14 is a block diagram illustrating an example of a hardware configuration of a control device according to the exemplary embodiment.
Figure 15:
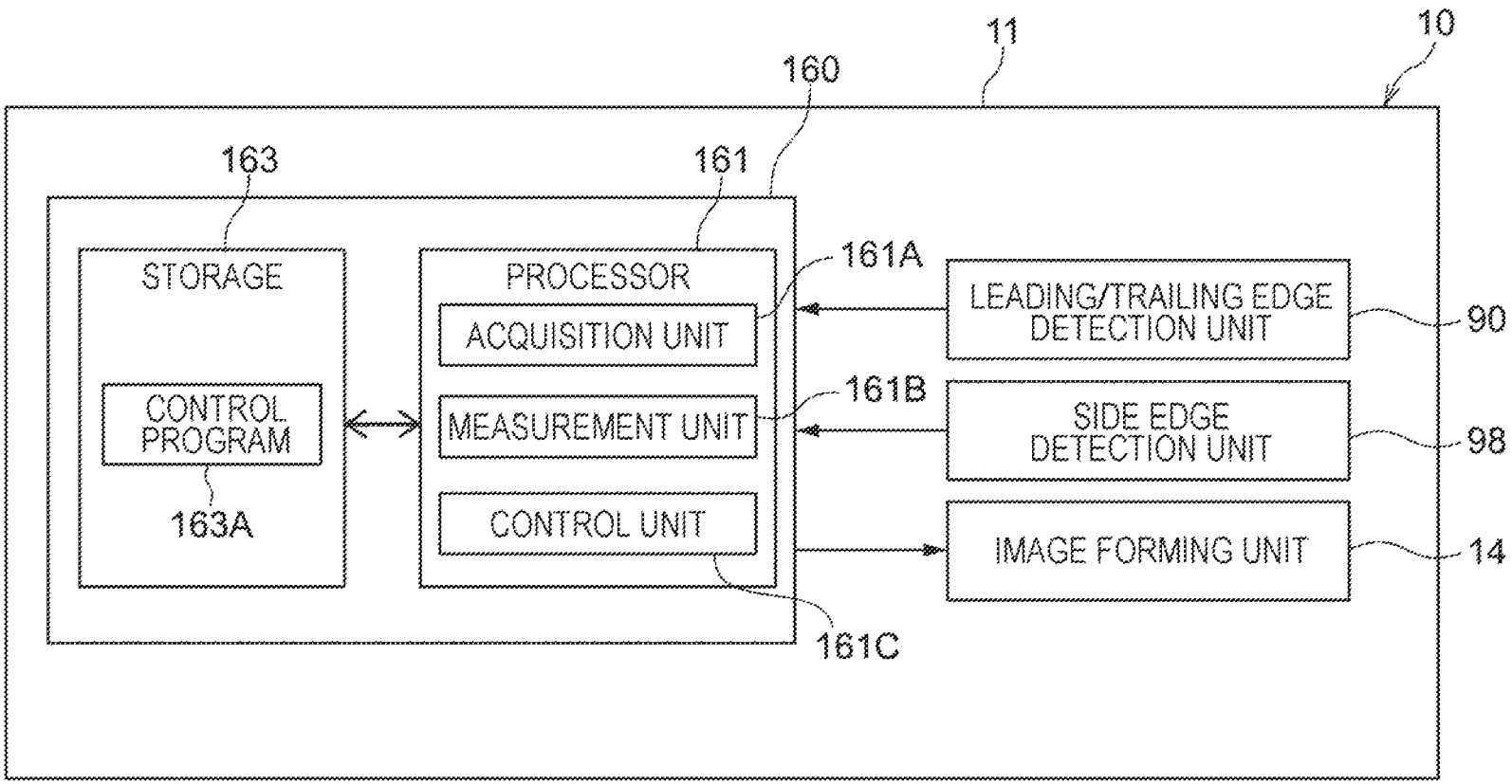
FIG. 15 is a block diagram illustrating an example of a functional configuration of a processor included in the control device according to the exemplary embodiment.

A control function of the control device 160 for controlling the operation of the detection device 30 will now be described. FIGS. 14 and 15 illustrate components of the control device 160 that provide the control function for controlling the operation of the detection device 30. More specifically, as described above, the control device 160 includes the processor 161, the memory 162, and the storage 163 (see FIG. 14).

In the control device 160, the processor 161 executes the control program 163A to realize various functions. A functional configuration realized by cooperation of the processor 161, which serves as a hardware resource, and the control program 163A, which serves as a software resource, will now be described. FIG. 15 is a block diagram illustrating the functional configuration of the processor 161.

As illustrated in FIG. 15, in the control device 160, the processor 161 executes the control program 163A to function as the acquisition unit 161A, a measurement unit 161B, and the control unit 161C.

The acquisition unit 161A acquires detection information obtained by the leading/trailing edge detection unit 90 and the side edge detection unit 98 that detect the edge portions of the medium P. The detection information includes position information representing the positions of the edge portions of the medium P. More specifically, the position information of the leading and trailing edge portions of the medium P represents positions in the transporting direction, and the position information of the side edge portions of the medium P represents positions in the width direction of the medium P.

More specifically, for example, the sensors 93 and 94 determine the positions of the edge portions of the medium P based on the boundaries between the sensing elements in a sensing state and the sensing elements in a non-sensing state in the detection regions thereof. Then, the acquisition unit 161A acquires position information represented by the coordinates of the determined positions (more specifically, the numbers of pixels counted from the downstream ends of the detection regions in the transporting direction).

In addition, for example, the sensors 91 and 92 determine the positions of the edge portions of the medium P based on the boundaries between the sensing elements in a sensing state and the sensing elements in a non-sensing state in the detection regions thereof. Then, the acquisition unit 161A acquires position information represented by the coordinates of the determined positions (more specifically, the numbers of pixels counted from the rear ends of the detection regions).

The measurement unit 161B determines the transporting-direction dimension and the width-direction dimension of the medium P based on the position information acquired by the acquisition unit 161A. More specifically, for example, the measurement unit 161B determines the transporting-direction dimension of the medium P as follows.

Figure 21:
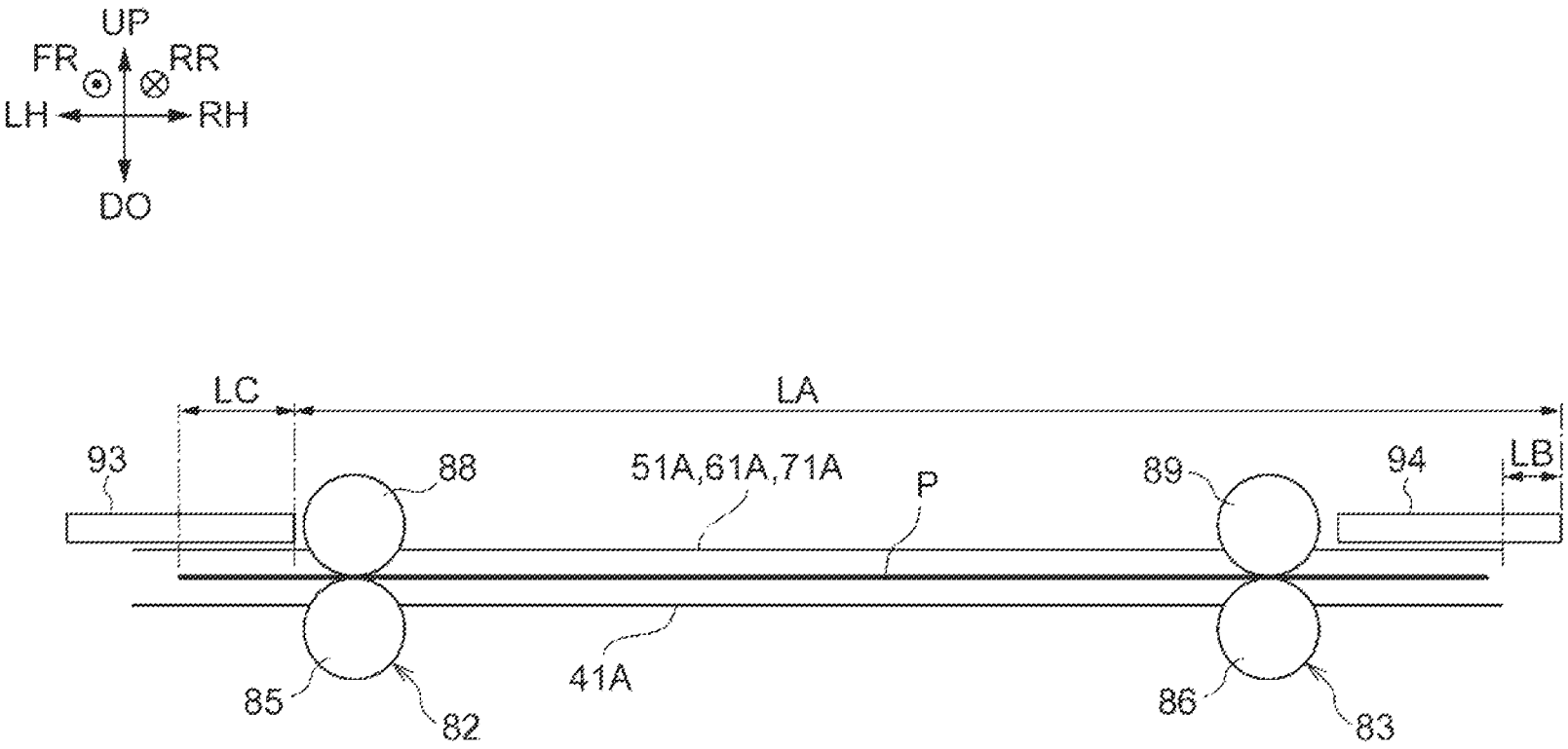
FIG. 21 is a conceptual diagram used to describe a method for measuring a transporting-direction dimension of a medium with the detection device according to the exemplary embodiment.
Figure 23:
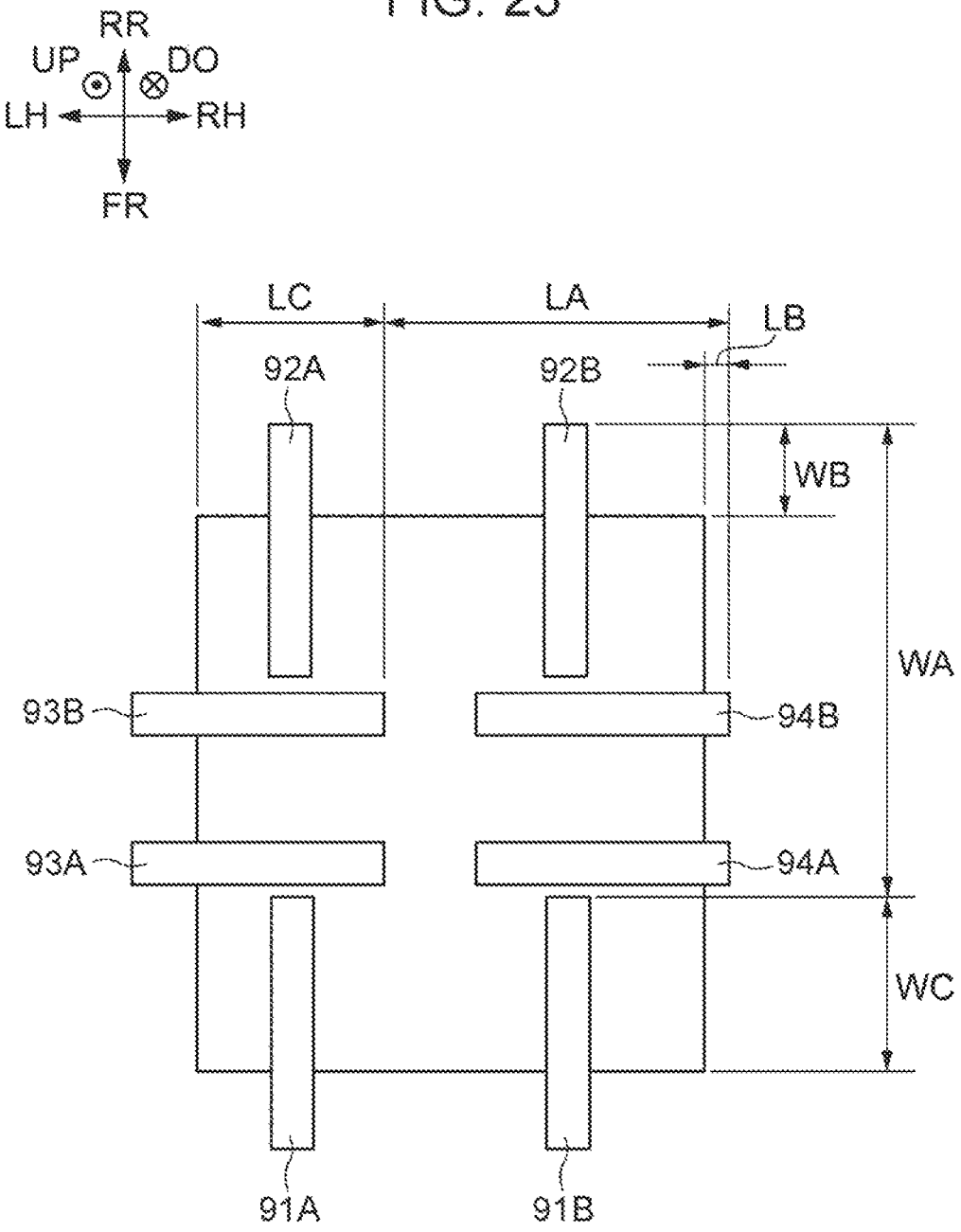
FIG. 23 is a conceptual diagram used to describe a method for measuring a transporting-direction dimension and a width-direction dimension of the medium with the detection device according to the exemplary embodiment.

For example, referring to FIGS. 21 and 23, the measurement unit 161B determines a distance LB from the trailing edge portion of the medium P to the upstream end portion (i.e., right end portion) of the detection region of each sensor 94 based on the position information.

Figure 22:
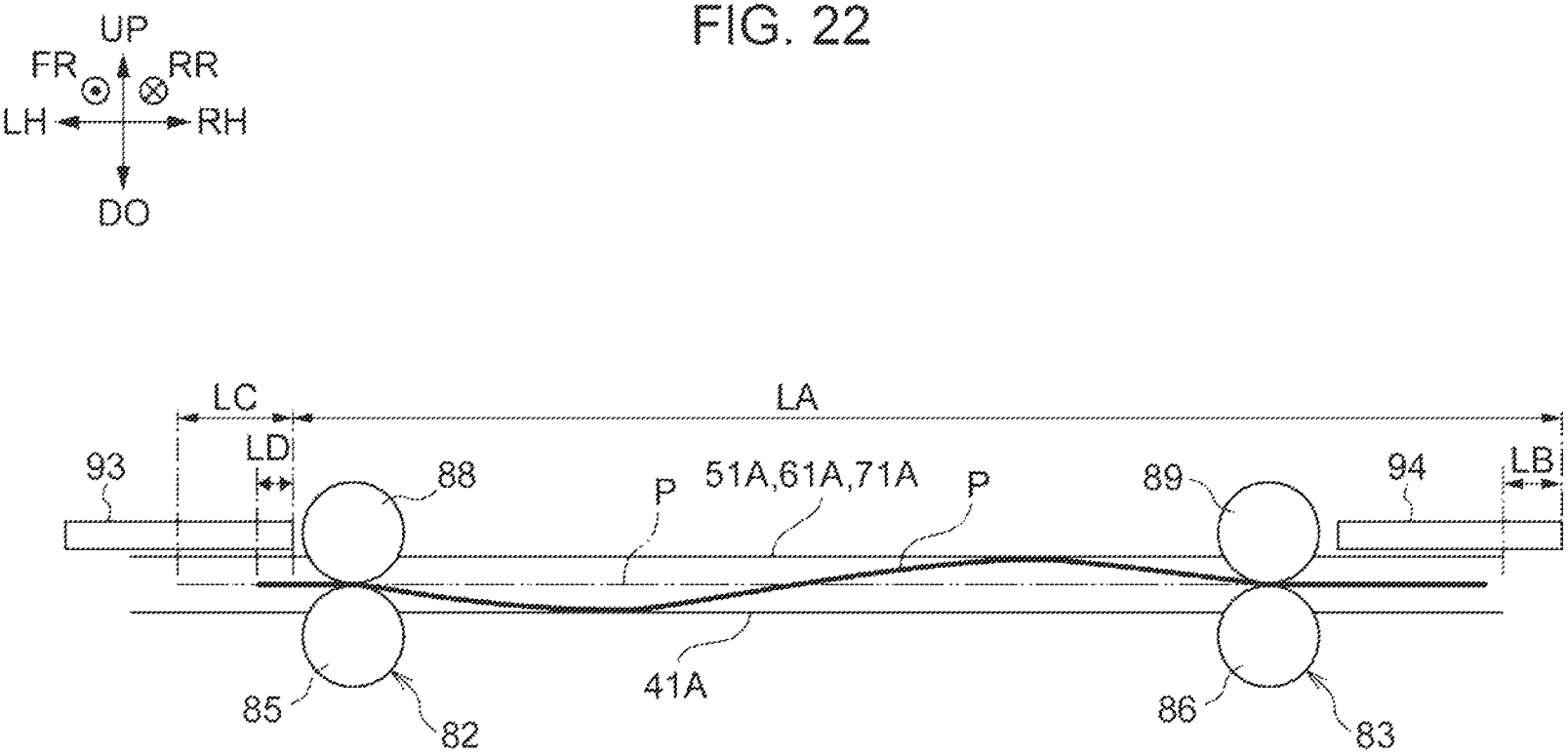
FIG. 22 is a diagram illustrating the medium in a bent state in the structure illustrated in FIG. 21.

More specifically, the distance LB is determined from Equation (1) given below based on the overall number of pixels P1 (pixels/mm) in the sensing elements of each sensor 94 and the number of pixels P2 (pixels) in a range from the upstream end portion of the detection region of the sensor 94 in the transporting direction to the trailing edge portion of the medium P. FIGS. 21 to 23 are conceptual diagrams, and structural components (transport members 82 and 83 and sensors 91 to 94) are illustrated schematically.

$$LB=P2\div P1 \quad \text{Equation (1)}$$

In addition, for example, the measurement unit 161B determines a distance LC from the leading edge portion of the medium P to the upstream end portion (i.e., right end portion) of the detection region of each sensor 93 based on the position information.

More specifically, the distance LC is determined from Equation (2) given below based on the overall number of pixels P3 (pixels/mm) in the sensing elements of each sensor 93 and the number of pixels P4 (pixels) in a range from the upstream end portion of the detection region of the sensor 93 in the transporting direction to the leading edge portion of the medium P.

$$LC=P4\div P3 \quad \text{Equation (2)}$$

A distance LA from the upstream end portion (i.e., right end portion) of each sensor 94 to the upstream end portion (i.e., right end portion) of each sensor 93 is known. The measurement unit 161B determines a transporting-direction dimension L1 of the medium P from Equation (3) given below.

$$L1=LA+LC-LB \quad \text{Equation (3)}$$

In addition, for example, the measurement unit 161B determines the width-direction dimension of the medium P as follows.

For example, referring to FIG. 23, the measurement unit 161B determines a distance WB from one side edge portion (i.e., edge portion adjacent to the rear of the apparatus) of the medium P to the rear end portion (i.e., end portion adjacent to the rear of the apparatus) of the detection region of each sensor 92 based on the position information.

More specifically, the distance WB is determined from Equation (4) given below based on the overall number of pixels P5 (pixels/mm) in the sensing elements of each sensor 92 and the number of pixels P6 (pixels) in a range from the rear end portion of the detection region of the sensor 92 to the side edge portion of the medium P.

$$WB=P6\div P5 \quad \text{Equation (4)}$$

In addition, for example, the measurement unit 161B determines a distance WC from the other side edge portion (i.e., edge portion adjacent to the front of the apparatus) of the medium P to the rear end portion (i.e., end portion adjacent to the rear of the apparatus) of the detection region of each sensor 91 based on the position information.

More specifically, the distance WB is determined from Equation (5) given below based on the overall number of pixels P7 (pixels/mm) in the sensing elements of each sensor 91 and the number of pixels P8 (pixels) in a range from the rear end portion of the detection region of the sensor 91 to the side edge portion of the medium P.

$$WC=P8\div P7 \quad \text{Equation (5)}$$

A distance WA from the rear end portion of each sensor 92 to the rear end portion of each sensor 91 is known. The measurement unit 161B determines a width-direction dimension W1 of the medium P from Equation (6) given below.

$$W1=WA+WC-WB \quad \text{Equation (6)}$$

The measurement unit 161B determines the size of the medium P from the transporting-direction dimension and the width-direction dimension of the medium P determined as described above.

In the present exemplary embodiment, the transporting-direction dimension L1 is measured at one and the other sides of the medium P in the width direction based on the sensing results obtained by the sensors 93B and 94B arranged next to each other in the left-right direction in a rear region of the detection device 30 and the sensing results obtained by the sensors 93A and 94A arranged next to each other in the left-right direction in a front region of the detection device 30.

When, for example, the medium P is a paper sheet, the transporting-direction dimension L1 at one side of the medium P in the width direction may differ from that at the other side due to a cutting error. Since the transporting-direction dimension L1 is measured at one and the other sides of the medium P in the width direction, the cutting error may be determined. The transporting-direction dimension of the medium P may be determined as, for example, the average, minimum, or maximum value of the transporting-direction dimensions L1 at one and the other sides of the medium P in the width direction.

In addition, in the present exemplary embodiment, the width-direction dimension W1 is measured at the downstream and upstream sides of the medium P in the transporting direction based on the sensing results obtained by the sensors 91A and 92A arranged next to each other in the front-rear direction in a left region of the detection device 30 and the sensing results obtained by the sensors 91B and 92B arranged next to each other in the front-rear direction in a right region of the detection device 30.

When, for example, the medium P is a paper sheet, the width-direction dimension W1 at the downstream side of the medium P in the transporting direction may differ from that at the upstream side due to a cutting error. Since the width-direction dimension W1 is measured at the downstream and upstream sides of the medium P in the transporting direction, the cutting error may be determined. The width-direction dimension of the medium P may be determined as, for example, the average, minimum, or maximum value of the width-direction dimensions W1 at the downstream and upstream sides of the medium P in the transporting direction.

In addition, in the present exemplary embodiment, for example, skewing (i.e., inclination) of the medium P may be determined based on displacements between the positions determined by the sensors 91A, 92A, 93A, 94A and the positions determined by the sensors 91B, 92B, 93B, and 94B. The inclination of the medium P may be corrected before determining the transporting-direction dimension and the width-direction dimension of the medium P.

Based on the size of the medium P measured by the measurement unit 161B, the control unit 161C adjusts an image to be formed on the medium P whose edge portions have been detected. More specifically, after the edge portions of the medium P are detected by the detection device 30, the control unit 161C adjusts a back image to be formed on the detected medium P based on the size of the medium P measured by the measurement unit 161B. For example, when the size of the medium P measured by the measurement unit 161B is smaller than the size specified as the size of the medium P on which the image is to be formed, the control unit 161C controls the image forming unit 14 to reduce the size of the back image formed by the image forming unit 14.

Although the control device 160 is disposed in the image forming apparatus 10, the control device 160 is not limited to this. For example, the control device 160 may instead be disposed in the detection device 30 or in another device that is disposed outside the image forming apparatus 10. The location of the control device 160 is not limited.

Position of Detection Device 30

As described above, the detection device 30 is disposed in the image forming apparatus body 11. More specifically, the detection device 30 is disposed above the medium storage unit 12 in the vertical direction. As described above, the detection device 30 has a flat shape that extends in the front-rear and left-right directions (more specifically, horizontal directions), and is therefore space-saving in the up-down direction.

The detection device 30 including the transport unit 80 is disposed at a position at which the transportation of the medium P is stopped in the image forming apparatus 10 in which the detection device 30 is disposed. Still more specifically, the detection device 30 is disposed on the transport path 24, which is one of the transport paths of the image forming apparatus 10 on which the transportation of the medium P is stopped to change the direction in which the medium P is transported. The transport path 24 is a transport path on which the medium P is stopped to reverse the medium P.

The medium P is reversed by performing a switchback operation on the transport path 24. The switchback operation is an operation of moving the medium P back and forth along the same path. In other words, the switchback operation is an operation of changing the direction of the medium P.

As described above, the transport path 24 is a transport path along which the medium P is transported from the heating unit 19 to the image forming unit 14. The detection device 30 is disposed on the transport path 24 at a location upstream of the supply position 25A, at which a new medium P is fed toward the image forming unit 14, in the transporting direction.

In addition, in the present exemplary embodiment, as described above, the medium storage unit 12, the image forming unit 14, and the heating unit 19 are disposed in section 18A of the housing 18. The detection device 30 is disposed in section 18B of the housing 18. Thus, the detection device 30 including the leading/trailing edge detection unit 90 and the heating unit 19 are disposed in different sections 18A and 18B of the housing 18.

In addition, in the present exemplary embodiment, as described above, the detection device 30 including the leading/trailing edge detection unit 90 is disposed downstream of the heating unit 19 in the transporting direction. Therefore, the leading/trailing edge detection unit 90 detects the leading and trailing edge portions of the medium P while the transportation of the medium P is stopped and while the medium P is in the pulled state after the medium P has been heated and before an image is formed on the medium P again.

In addition, in the present exemplary embodiment, the detection device 30 including the leading/trailing edge detection unit 90 is disposed below the heating unit 19.

Operations of Present Exemplary Embodiment

As described above, in the detection device 30, the leading/trailing edge detection unit 90 detects the leading and trailing edge portions of the medium P while the transportation of the medium P is stopped and while the medium P is pulled in the pulling direction.

If the leading and trailing edge portions of the medium P are detected by a detection unit including, for example, sensors while the medium P is being transported along the transport passage 80B (comparative example 1), the position of the medium P easily varies because the medium P is moved. Therefore, it may be difficult to accurately detect the leading and trailing edge portions of the medium P.

If, for example, the leading and trailing edge portions of the medium P are detected while the transportation of the medium P is simply stopped (comparative example 2), as illustrated in FIG. 22, the medium P may be bent such that the leading and trailing edge portions are moved toward each other. In such a case, the relative position between the leading and trailing edge portions cannot be accurately determined. More specifically, in FIG. 22, the distance LC will incorrectly be determined as a distance LD.

In contrast, according to the present exemplary embodiment, as described above, the leading/trailing edge detection unit 90 detects the leading and trailing edge portions of the medium P while the transportation of the medium P is stopped and while the medium P is pulled in the pulling direction. Therefore, unlike comparative example 1 and comparative example 2, the leading and trailing edge portions of the medium P may be detected while bending and wrinkling of the medium P in the transporting direction are reduced. In other words, according to the present exemplary embodiment, compared to comparative example 1 and comparative example 2, the leading and trailing edge portions of the medium P are less likely to be detected while being shifted toward each other in the transporting direction of the medium P. Furthermore, according to the present exemplary embodiment, compared to comparative example 1 and comparative example 2, the leading and trailing edge portions of the medium P may be detected while the shape of the medium P is closer to a planar shape. In FIG. 22, the medium P in a bent state is shown by the solid line, and the medium P in a pulled state is shown by the two-dot chain line. In addition, in FIG. 22, a transport path surface composed of the transport path surfaces 51A, 61A, and 71A and provided above the medium P is simplified. The medium P in a bent state is in contact with the transport path surfaces 51A, 61A, and 71A disposed thereabove and the transport path surface 41A disposed therebelow.

In the present exemplary embodiment, the medium P is pulled in the pulling direction by the transport members 81, 82, and 83 that transport the medium P in the first transporting direction and stop the transportation of the medium P in the transport passage 80B.

In the present exemplary embodiment, the transport members 81 and 82 stop transporting the medium P after the transport member 83 stops transporting the medium P, so that the medium P is pulled in the pulling direction by the transport members 81, 82, and 83.

In the present exemplary embodiment, the downstream transport unit 80Y includes the transport member 81 and the transport member 82 disposed upstream of the transport member 81 in the transporting direction.

In the present exemplary embodiment, the medium P having the minimum size is pulled by the transport member 82 and the transport member 83, and the medium P having the maximum size is pulled by the transport member 81 and the transport member 83.

In addition, in the present exemplary embodiment, the transport members 81 and 82 are rotated by the same drive source 777.

In the present exemplary embodiment, a pair of transport units having a short distance therebetween (more specifically, the transport members 81 and 82) are driven by the same drive source, and a pair of transport units having a long distance therebetween (more specifically, the transport members 82 and 83) are driven by different drive sources.

In the present exemplary embodiment, the transport member 83 stops transporting the medium P so that the amount by which the trailing edge of the medium P projects upstream from the transport member 83 in the transporting direction is substantially constant irrespective of the transporting-direction dimension of the medium P. The transport members 81, 82, and 83 restart the transportation of the medium P from the edge portion that projects by the substantially constant amount (i.e., the upstream edge portion in the transporting direction (more specifically, the right edge portion)).

A configuration in which the amount by which the trailing edge of the medium P projects upstream from the transport member 83 in the transporting direction differs depending on the medium P and in which the transportation of the medium P is restarted from the projecting edge portion is hereinafter referred to as configuration A. In configuration A, since the amount of projection varies, when the transportation is restarted, the time required for the medium P to reach a transport unit, such as a transport roller, disposed downstream of the transport member 83 in the transporting direction also varies. To operate in accordance with such variations, transportation control of the transport unit may become complex. In contrast, in the present exemplary embodiment, the transportation of the medium P is stopped so that the amount by which the medium P projects upstream from the transport member 83 in the transporting direction is substantially constant irrespective of the length of the medium P in the transporting direction.

In the present exemplary embodiment, the medium P whose side edge portions are detected by the side edge detection unit 98 is supported by the support members 120. A configuration in which the support members 120 that support the side edge portions of the medium P when the side edge portions are detected are not provided is hereinafter referred to as configuration B. In configuration B, the positions of the side edge portions of the medium P easily vary. In contrast, in the present exemplary embodiment, the medium P whose side edge portions are detected by the side edge detection unit 98 is supported by the support members 120. Therefore, variations in the positions of the side edge portions of the medium P are reduced compared to the case of configuration B, and the side edge portions of the medium P may be detected while bending and wrinkling of the medium P in the width direction are reduced.

The pressing members 120A, 120B, 120C, and 120D are disposed upstream of the sensors 92A, 92B, 91A, and 91B, respectively, in the transporting direction and extend along the sensors 92A, 92B, 91A, and 91B, respectively.

In the present exemplary embodiment, the leading/trailing edge detection unit 90 detects the leading and trailing edge portions of the medium P while the transportation of the medium P is stopped and while the medium P is in a pulled state after the medium P is heated and before an image is formed on the medium P again.

In the present exemplary embodiment, the detection device 30 including the leading/trailing edge detection unit 90 and the heating unit 19 are disposed in different sections 18A and 18B of the housing 18.

In the present exemplary embodiment, the detection device 30 including the leading/trailing edge detection unit 90 is disposed below the heating unit 19.

Modifications of Structure for Pulling Medium P

In the present exemplary embodiment, the medium P is pulled in the pulling direction by the transport members 81, 82, and 83 that transport the medium P in the first transporting direction and stop the transportation of the medium P in the transport passage 80B. However, the structure for pulling the medium P is not limited to this. For example, the transport members 81, 82, and 83 may serve to transport the medium P and stop the transportation of the medium P, and the medium P may be pulled by a separate pulling unit. The pulling unit may be, for example, a transport member, such as a transport roller or a transport belt, or a unit that pulls the medium P by suction.

In addition, in the present exemplary embodiment, the transport members 81 and 82 stop transporting the medium P after the transport member 83 stops transporting the medium P, so that the medium P is pulled in the pulling direction by the transport members 81, 82, and 83. However, the structure for pulling the medium P is not limited to this. For example, the transport members 81, 82, and 83 may stop transporting the medium P simultaneously, and then the transport members 81 and 82 and/or the transport member 83 may operate to pull the medium. When the transport members 81 and 82 operate, the driving rollers 84 and 85 rotate in the forward direction. When the transport member 83 operates, the driving roller 86 rotates in the reverse direction.

Modifications of Upstream Transport Unit 80X and Downstream Transport Unit 80Y In the present exemplary embodiment, the downstream transport unit 80Y includes the transport member 81 and the transport member 82 disposed upstream of the transport member 81 in the transporting direction. However, the downstream transport unit 80Y is not limited to this. For example, the downstream transport unit 80Y may include only one transport unit, such as a transport member. More specifically, for example, the downstream transport unit 80Y may instead include only the transport member 82. In this structure, the media P of all sizes including the minimum size and the maximum size are pulled by the transport member 82 and the transport member 83.

As described above, in the present exemplary embodiment, the medium P having the minimum size and the medium P having the maximum size may be pulled by the same transport units, such as transport members. Alternatively, the downstream transport unit 80Y may instead include three or more transport units, such as transport members.

In addition, although the upstream transport unit 80X includes only the transport member 83 in the present exemplary embodiment, the upstream transport unit 80X may instead include plural transport units, such as transport members. In such a case, for example, the downstream transport unit 80Y may include one transport unit, and the upstream transport unit 80X may include a first transport unit and a second transport unit disposed upstream of the first transport unit in the transporting direction (hereinafter referred to as a first configuration). In the first configuration, the medium P may be pulled by the first transport unit and the downstream transport unit 80Y when the transporting-direction dimension thereof is less than a predetermined length, and be pulled by the second transport unit and the downstream transport unit 80Y when the transporting-direction dimension thereof is greater than or equal to the predetermined length.

In the first configuration, for example, the trailing edge sensor 99 may be replaced by a leading edge sensor that serves as a sensing unit that senses the leading edge portion of the medium P, and the medium P may be stopped with reference to the time at which the leading edge portion of the medium P is sensed by the leading edge sensor. When, the medium P is stopped with reference to the time at which the leading edge portion of the medium P is sensed by the leading edge sensor, the downstream transport unit 80Y may stop transporting the medium P so that the amount by which the leading edge of the medium P projects downstream from the downstream transport unit 80Y in the transporting direction is substantially constant irrespective of the transporting-direction dimension of the medium P.

In a modification in which the detection device 30 is disposed downstream of the transport path 80A and upstream of the transfer position TA in the transporting direction, the transport members 81, 82, and 83 may restart the transportation of the medium P from the edge portion that projects by the substantially constant amount (i.e., the downstream edge portion in the transporting direction).

Variation in Pulling Force Applied by Transport Members 81, 82, and 83

The transport members 81, 82, and 83 may change the pulling force in accordance with the characteristics of the medium P. More specifically, the transport members 81, 82, and 83 may change the pulling force in accordance with the type of the medium P. Examples of the type of the medium P include types regarding thickness, such as thin paper, plain paper, and cardboard paper, and types regarding presence or absence of coating, such as coated paper and non-coated paper. Examples of characteristics of the medium P include the type, rigidity, thickness, basis weight, size, weight, temperature, and moisture content of the medium P.

More specifically, for example, the transport members 81, 82, and 83 may apply a first pulling force to the medium P of a first type and a second pulling force greater than the first pulling force to a medium of a second type having a rigidity greater than that of the medium P of the first type.

The pulling force is changed by changing the second elapsed time (i.e., time difference) from the stoppage of rotation of the transport member 83 to the stoppage of rotation of the transport members 81 and 82. The pulling force increases as the second elapsed time increases.

In the structure in which the pulling force is changed in accordance with the type of each medium P as described above, plural types of media P are transported along the transport passage 80B. The detection device 30 (more specifically, the leading/trailing edge detection unit 90) detects the leading and trailing edge portions of each of the plural types of media Pin the transport passage 80B while the transportation of the medium P is stopped and while the medium P is a pulled state. The detection device 30 changes the pulling force in accordance with the type of each medium P. The image forming unit 14 forms an image on each of the plural types of media P based on the detection result obtained by the detection device 30.

In addition, in this example, the detection device 30 changes the pulling force in accordance with the type of each medium P.

Modifications of Images Formed on Medium P

In the present exemplary embodiment, the front image, which serves as the first image, is formed on one side of the medium P, and the back image, which serves as the second image, is formed on the other side of the medium P. However, the images are not limited to this. The second image may instead be formed on the side of the medium P on which the first image is formed.

In addition, in the present exemplary embodiment, the front image, which serves as the first image, and the back image, which serves as the second image, are formed by the same image forming unit 14. However, the front image and the back image may instead be formed by different image forming units.

In addition, the first image may be an image formed by another unit (for example, an image forming unit provided separately from the image forming unit 14 in the image forming apparatus 10 or an image forming apparatus other than the image forming apparatus 10) in place of or in addition to an image formed by the image forming unit 14. The first image may be any image formed on the medium P before the edge portions of the medium P are sensed.

Modifications of Transport Unit 80

Although the connecting portions 743, 753, and 763 that are respectively connected to the connecting portions 843, 853, and 863 of the driving rollers 84, 85, and 86, the drive sources 777 and 778, and the control device 160 are disposed in the image forming apparatus body 11 in the present exemplary embodiment, the arrangement thereof is not limited to this. The connecting portions 743, 753, and 763, the drive sources 777 and 778, and the control device 160 may instead be disposed in the detection device 30.

Although the transport members 81 and 82 are rotated by the same drive source 777 in the present exemplary embodiment, the transport members 81 and 82 are not limited to this. For example, the transport members 81 and 82 may instead be rotated by different drive sources.

In addition, in the present exemplary embodiment, the transport member 83 stops transporting the medium P so that the amount by which the trailing edge of the medium P projects upstream from the transport member 83 in the transporting direction is substantially constant irrespective of the transporting-direction dimension of the medium P. However, the transport member 83 is not limited to this. For example, the amount by which the trailing edge of the medium P projects upstream from the transport member 83 in the transporting direction may differ depending on the medium P.

Although the driving rollers 84, 85, and 86 are used as rotating members in the present exemplary embodiment, the rotating members are not limited to this. The rotating members may instead be, for example, rollers, belts, or wheels that are used individually or in combination with each other. When a belt is used as a rotating member, the belt is wrapped around plural rollers and rotated by driving force received from the rollers. The rotating members may be members that are not driven to rotate as long as the rotating members rotate.

Although the driven rollers 87, 88, and 89 are used as driven members in the present exemplary embodiment, the driven members are not limited to this. The driven members may instead be, for example, rollers, belts, or wheels, and any members that are driven by the rotating members may be used.

In addition, in the present exemplary embodiment, the driving rollers 84, 85, and 86, which serve as the rotating members, are arranged in the detection device body 40, and the driven rollers 87, 88, and 89, which serve as the driven members, are arranged in the first unit 31 and the second unit 32 disposed above the detection device body 40. However, the arrangement of the rotating members and the driven members is not limited to this. For example, the driven members, such as the driven rollers 87, 88, and 89, may be arranged in the detection device body 40, and the rotating members, such as the driving rollers 84, 85, and 86, may be arranged in the first unit 31 and the second unit 32.

In addition, although the driven rollers 87, 88, and 89 and the roller portions 842, 852, and 862 are arranged with the sensors 93 and 94 disposed therebetween in the front-rear direction (i.e., the width direction of the medium P) as appropriate when viewed in the direction perpendicular to the image forming surface of the medium P in the present exemplary embodiment, the arrangement thereof is not limited to this. For example, the driven rollers 87, 88, and 89 and the roller portions 842, 852, and 862 may instead be arranged with the sensors 93 and 94 disposed therebetween in the transporting direction as appropriate when viewed in the direction perpendicular to the image forming surface of the medium P. Alternatively, the driven rollers 87, 88, and 89 and the roller portions 842, 852, and 862 may be arranged such that the sensors 93 and 94 are not disposed therebetween.

Although the first transporting direction is leftward and the second transporting direction is rightward in the present exemplary embodiment, the first and second transporting directions are not limited to this. The first and second transporting directions may be various other directions, such as forward, rearward, upward, and downward directions.

Although the second transporting direction is a direction opposite to the first transporting direction, the second transporting direction is not limited to this. For example, the second transporting direction may be any direction that crosses the first transporting direction as long as the second transporting direction differs from the first transporting direction. When the second transporting direction is a direction that crosses the first transporting direction, the detection device 30 may be configured to reverse the medium P by a Mobius turn method. The Mobius turn method is a method of reversing the medium P by turning the medium P plural times so that the orientation of the medium P is changed in steps of 90 degrees when viewed in the direction perpendicular to the image forming surface of the medium P. The second transporting direction may instead be, for example, the same as the first transporting direction.

Modifications of Pressing Members 110

In the present exemplary embodiment, the pressing members 110 are arranged such that the sensors 93 are disposed therebetween in the front-rear direction as appropriate when viewed in the direction perpendicular to the image forming surface of the medium P. However, the pressing members 110 are not limited to this. The pressing members 110 may instead be arranged such that the sensors 93 are disposed therebetween in the transporting direction as appropriate when viewed in the direction perpendicular to the image forming surface of the medium P. Alternatively, the pressing members 110 may be arranged such that the sensors 93 are not disposed therebetween. For example, the pressing members 110 may be positioned to face the sensors 93 within areas in which sensing by the sensors 93 is not affected, or be arranged at positions shifted from the positions at which the pressing members 110 face the sensors 93.

In the present exemplary embodiment, the pressing members 110 press the downstream edge portion of the medium P sensed by the sensors 93. However, the pressing members 110 may instead be configured to press one side edge portion, the other side edge portion, and the upstream edge portion of the medium P sensed by the sensors 91, 92, and 94, respectively, instead of or in addition to the downstream edge portion of the medium P sensed by the sensors 93. The pressing members 110 are required only to press the edge portions of the medium P that are sensed. Therefore, when the medium P has an edge portion that is not sensed, no pressing members 110 are required for that edge portion.

In addition, the pressing members 110 are not limited to plate-shaped elastic members, such as resin films. The pressing members 110 may be any members that provide a support above the transport path surface 41A of the detection device body 40, and examples thereof include projections, such as ribs; driving, driven, or non-rotating rollers; belts; rollers; or wheels. The support for the medium P may instead support the medium P by blowing gas, such as air, or by suction.

Modifications of Pressing Members 120

In the present exemplary embodiment, the pressing members 120A, 120B, 120C, and 120D are disposed upstream of the sensors 92A, 92B, 91A, and 91B, respectively, in the transporting direction and extend along the sensors 92A, 92B, 91A, and 91B, respectively. However, the pressing members 120A, 120B, 120C, and 120D are not limited to this. For example, the pressing members 120A, 120B, 120C, and 120D may instead be disposed downstream of the sensors 92A, 92B, 91A, and 91B, respectively, in the transporting direction.

In addition, an example of the support portion is not limited to the pressing members 120. The support portion may be any portion capable of supporting the medium P having the side edge portions to be detected by the side edge detection unit 98, and examples thereof include projections, such as ribs; driving, driven, or non-rotating rollers; belts; rollers; or wheels. An example of the support portion may instead support the medium P by blowing gas, such as air, or by suction.

In addition, in the present exemplary embodiment, the pressing members 120 for supporting the medium P having the side edge portions to be detected by the side edge detection unit 98 may be omitted.

Modifications of Opening-Closing Portion 70

In the present exemplary embodiment, the opening-closing portion 70 is disposed between the sensors 91A and 92A and the sensors 91B and 92B in a region where the sensors 91 to 94 are not disposed. However, the opening-closing portion 70 is not limited to this. For example, the opening-closing portion 70 may be disposed in a region where the sensors 93 and 94 are not disposed and configured to be opened and closed together with the sensors 91 and 92. In this case, the positioning accuracy of the opening-closing portion 70 needs to be such that the sensing accuracies of the sensors 91 and 92 are not affected.

Alternatively, the detection device 30 may instead be structured such that the opening-closing portion 70 is not provided and the opening 77 at which the transport path 80A (see FIG. 1) of the transport unit 80 is exposed cannot be covered and uncovered.

Modifications of Leading/Trailing Edge Detection Unit 90 and Side Edge Detection Unit 98

Although reflective optical sensors are used as the sensors 91 to 94 in the present exemplary embodiment, the sensors 91 to 94 are not limited to this. For example, the sensors 91 to 94 may instead be transmissive optical sensors. The sensors 91 to 94, which serve as sensing units, may sense the edge portions of the medium P by coming into contact with the edge portions of the medium P, and various sensing units may be used. The sensing units that sense the edge portions of the medium P by coming into contact with the edge portions of the medium P may be, for example, sensing units including contact members (for example, guide members) that come into contact with the side edge portions of the medium P. The sensors 91 to 94 may instead be cameras that sense the edge portions of the medium P by capturing images of the medium P. Also when the lengths of the medium P are determined from the images captured by the cameras, the edge portions of the medium P may be regarded as being sensed because the lengths are distances between the edge portions of the medium P.

In the present exemplary embodiment, the sensors 91 to 94 are arranged to cross the edge portions of the medium P in the longitudinal directions thereof while the medium P is in the pulled state when viewed in the direction perpendicular to the image forming surface of the medium P. However, the sensors 91 to 94 are not limited to this. For example, the sensors 91 to 94 may instead be arranged to cross the edge portions of the medium P in transverse directions thereof. Alternatively, sensors having no longitudinal directions (for example, sensors having a square shape when viewed in the direction perpendicular to the image forming surface of the medium P) may be used as the sensors 91 to 94.

In the present exemplary embodiment, the leading/trailing edge detection unit 90 and the side edge detection unit 98 are structured such that the edge portions of the medium P are each sensed by plural sensors. However, the leading/trailing edge detection unit 90 and the side edge detection unit 98 are not limited to this. For example, the edge portions of the medium P may each be sensed by a single sensor.

In addition, although the sensors 91 to 94 are provided in the first unit 31 and the second unit 32 in the present exemplary embodiment, the arrangement thereof is not limited to this. For example, the sensors 91 and 93 may be provided in the detection device body 40, and the sensors 92 and 94 may be provided in the first unit 31 and the second unit 32.

In addition, although the leading/trailing edge detection unit 90 and the side edge detection unit 98 are both provided in the present exemplary embodiment, it is only necessary that at least the leading/trailing edge detection unit 90 be provided.

The leading/trailing edge detection unit 90 may instead be configured to detect the leading and trailing edge portions of the medium P in the pulled state when the medium P has the maximum size with the maximum transporting-direction dimension, but not when the medium P has the minimum size with the minimum transporting-direction dimension. In this case, for example, the leading/trailing edge detection unit 90 detects the leading and trailing edge portions of the medium P in the pulled state when the medium P has a size other than the minimum size, such as the maximum size, and not when the medium P has the minimum size.

In addition, in this case, for example, the size of the medium P is measured at a location upstream of the detection device 30 in the transporting direction, and whether the leading and trailing edge portions of the medium P are to be detected by the leading/trailing edge detection unit 90 is determined based on the measurement result.

In this case, the leading/trailing edge detection unit 90 does not detect the leading and trailing edge portions of the medium P when the medium P has the minimum size with the minimum transporting-direction dimension.

Modifications of Position of Detection Device 30

In the present exemplary embodiment, the detection device 30 is disposed in the image forming apparatus body 11. However, the position of the detection device 30 is not limited to this. The detection device 30 may instead be disposed outside the image forming apparatus body 11. When the detection device 30 is disposed outside the image forming apparatus body 11, the detection device 30 may be disposed directly on the image forming apparatus body 11 or be disposed indirectly on the image forming apparatus body 11 with another device, for example, disposed therebetween. The detection device 30 may instead be disposed in another device that is disposed on the image forming apparatus body 11. The detection device 30 may operate in association with or in response to the operation of components in the image forming apparatus body 11.

Although the detection device 30 including the leading/trailing edge detection unit 90 and the heating unit 19 are disposed in different sections 18A and 18B of the housing 18 in the present exemplary embodiment, the arrangement thereof is not limited to this. For example, the detection device 30 including the leading/trailing edge detection unit 90 and the heating unit 19 may instead be disposed in the same section of the housing 18.

Although the detection device 30 including the leading/trailing edge detection unit 90 is disposed below the heating unit 19 in the present exemplary embodiment, the position thereof is not limited to this. The detection device 30 including the leading/trailing edge detection unit 90 may instead be disposed above the heating unit 19.

In the present exemplary embodiment, the detection device 30 is disposed on the transport path 24 at a location upstream of the supply position 25A, at which a new medium P is supplied toward the image forming unit 14, in the transporting direction (more specifically, on the transport path 80A). However, the position of the detection device 30 is not limited to this. For example, in place of or in addition to the detection device 30 disposed on the transport path 24 (more specifically, on the transport path 80A), a detection device 30 may be disposed downstream of the transport path 80A and upstream of the supply position 25A in the transporting direction. In this structure, for example, the detection device 30 is disposed at a position at which the medium P is stopped to provide an interval between the medium P and another medium P that is supplied from the medium storage unit 12 to the supply position 25A. In this structure, the medium P having a front image formed thereon and transported in a first transporting direction is stopped and pulled by the transport unit 80. After the medium P is stopped, the medium P is transported again in a second transporting direction, which is the same as the first transporting direction, toward the image forming unit 14 (more specifically, toward the transfer position TA). In this structure, the detection device 30 disposed on the transport path 80A may be omitted, and the transport path 24 may be structured as a transport path that does not reverse the medium P. In this structure, a second image is formed on one side (front side) of the medium P on which a front image, which serves as a first image, is formed. Thus, the second image may be an image formed on a side on which the first image is formed.

In addition, for example, in place of or in addition to the detection device 30 disposed on the transport path 24 (more specifically, on the transport path 80A), a detection device 30 may be disposed downstream of the supply position 25A in the transporting direction. In this structure, for example, the detection device 30 is disposed at a position at which the medium P is stopped to adjust the time at which the medium P is transported to the image forming unit 14 (more specifically, transfer position TA). In this structure, the transport unit 80 operates so that, for example, the medium P having a front image formed thereon and transported in a first transporting direction is stopped and pulled. After the medium P is stopped, the medium P is transported again in a second transporting direction, which is the same as the first transporting direction, toward the image forming unit 14 (more specifically, toward the transfer position TA).

Configuration Including Feeding Mechanism 250 with Suction Unit 252

Figure 24:
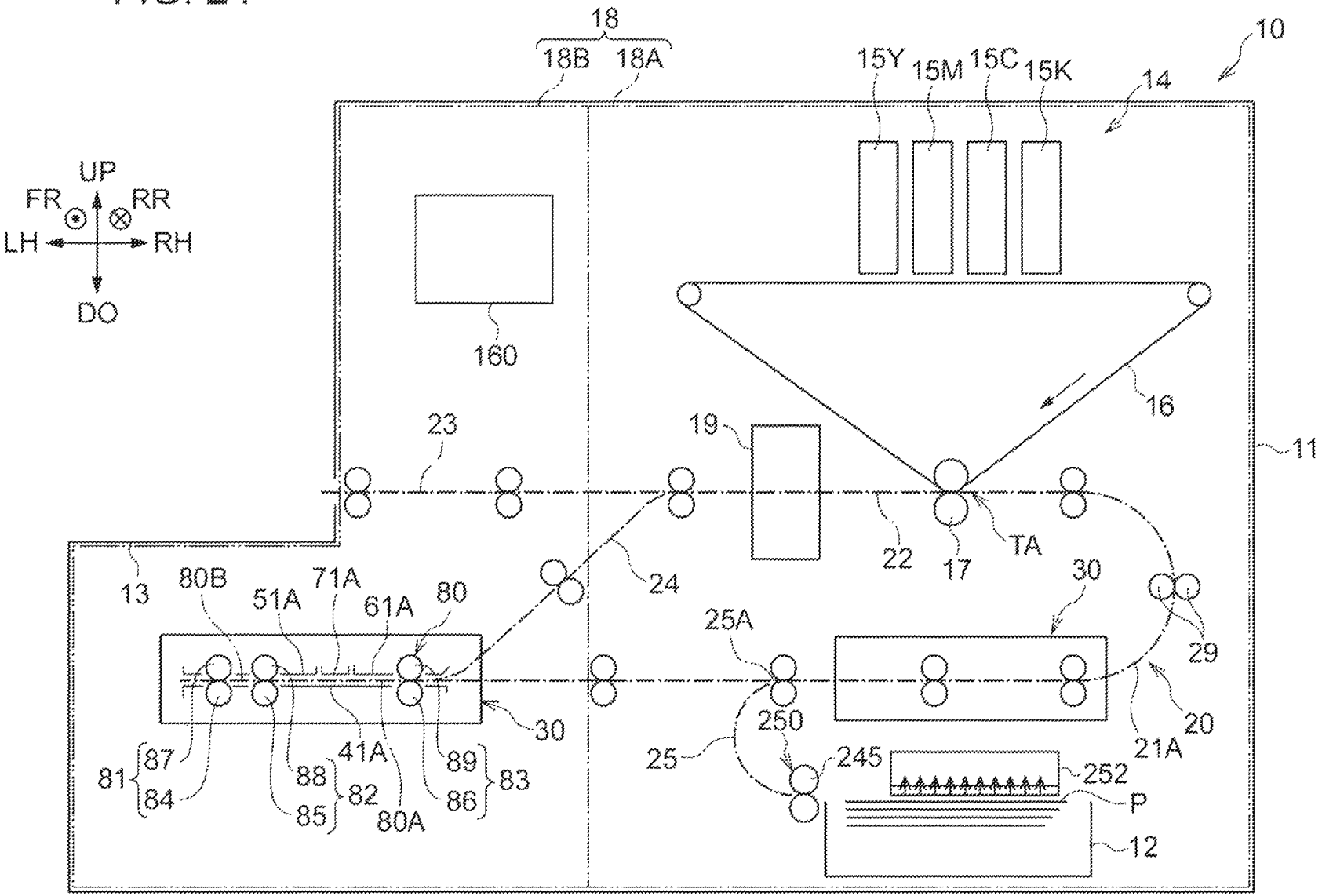
FIG. 24 is a schematic diagram illustrating the structure of an image forming apparatus including a feeding mechanism having a suction unit.

As illustrated in FIG. 24, the media P stored in the medium storage unit 12 may be fed by a feeding mechanism 250 including a suction unit 252. As illustrated in FIGS. 24 and 25, the feeding mechanism 250 includes the suction unit 252 that picks up each medium P from the medium storage unit 12 by suction and feed rollers 245 that feed the medium P picked up by the suction unit 252 by suction. The feed rollers 245 are an example of a feeding unit.

Figure 25A:
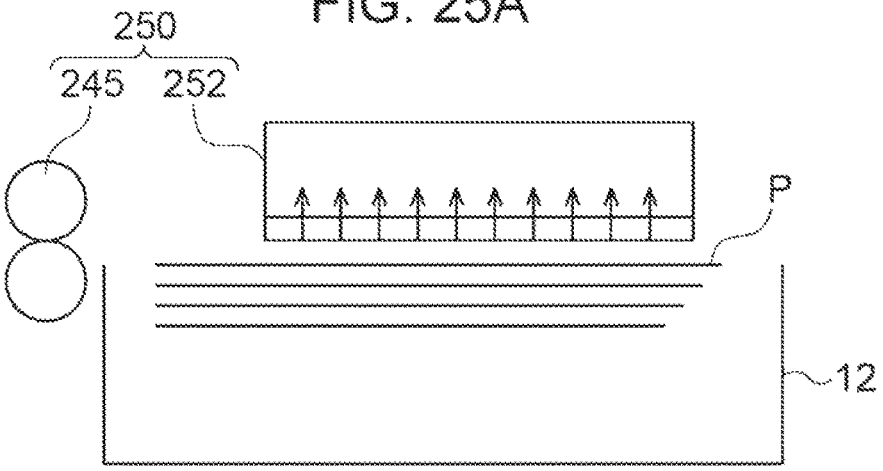
FIGS. 25A, 25B, and 25C are schematic diagrams illustrating the structure of the feeding mechanism having the suction unit.
Figure 25B:
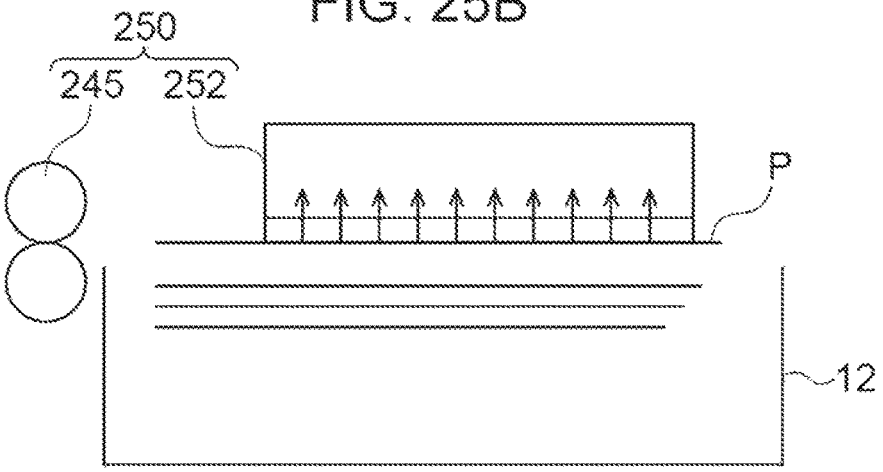
Figure 25C:
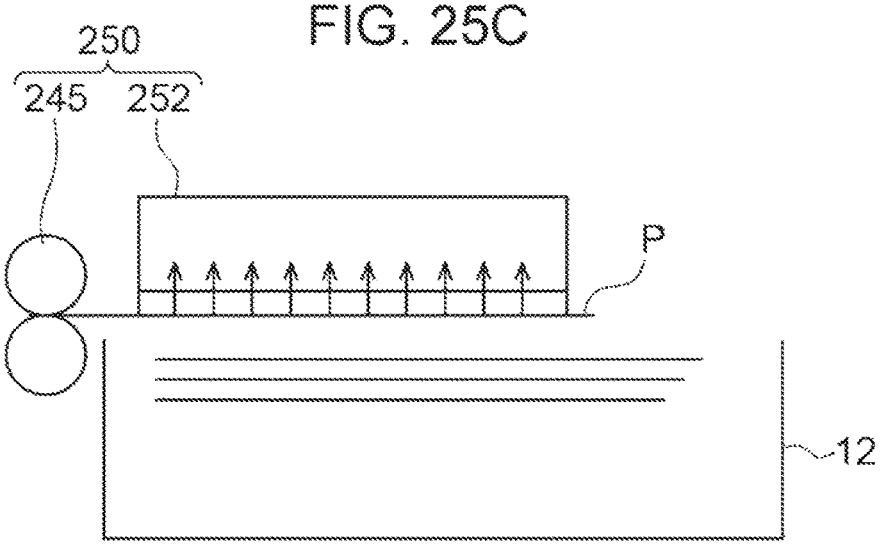

As illustrated in FIGS. 25A and 25B, in the feeding mechanism 250, the suction unit 252 disposed above the medium storage unit 12 holds the medium P on the lower surface thereof by suction. Then, as illustrated in FIG. 25C, the suction unit 252 moves toward the feed rollers 245 so that the medium P is received by the feed rollers 245. The feed rollers 245 rotate to feed the medium P. The medium P fed by the feed rollers 245 is transported from the medium storage unit 12 to the image forming unit 14 along the transport passage 21A.

Referring to FIG. 24, in this structure, in addition to or in place of the detection device 30 disposed in section 18B of the housing 18, another detection device 30 may be provided, for example, on the transport passage 21A. In such a case, the leading/trailing edge detection unit 90 included in this detection device 30 detects the leading and trailing edge portions of the medium P in the pulled state in the transport passage 21A along which the medium P fed from the feed rollers 245 is transported. The image forming unit 14 forms an image on the medium detected by the leading/trailing edge detection unit 90. In addition, the leading/trailing edge detection unit 90 detects the leading and trailing edge portions of the medium P while the leading and trailing edge portions of the medium P are disposed between the feed rollers 245 and the image forming unit 14 after passing the feed rollers 245.

The present disclosure is not limited to the above-described exemplary embodiment, and various modifications, alterations, and improvements are possible without departing from the spirit of the present disclosure. For example, the above-described modifications may be applied in combinations with each other as appropriate.

In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

The programs used in the above embodiments may be provided in a state such that they are stored in a computer readable storage medium. Examples of the computer readable storage medium include magnetic storage media (e.g., magnetic tape, magnetic disks (HDD: Hard Disk Drive, FDD: Flexible Disk Drive), optical storage media (e.g., optical discs (CD: Compact Disc, DVD: Digital Versatile Disk)), magneto-optical storage media, and semiconductor memories. The programs may also be stored in an external server, such as a cloud server, and downloaded through a communication line, such as the Internet.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A detection device comprising:

a transport passage along which a medium is transported; and a detection unit that detects a leading edge portion and a trailing edge portion of the medium in the transport passage while transportation of the medium is stopped and while the medium is pulled in a pulling direction along the transport passage.

2. The detection device according to claim 1, further comprising:

an upstream transport unit that transports the medium along the transport passage in a transporting direction and stops the transportation of the medium; and a downstream transport unit that transports the medium along the transport passage in the transporting direction and stops the transportation of the medium, the downstream transport unit being disposed downstream of the upstream transport unit in the transporting direction, wherein the upstream transport unit and the downstream transport unit pull the medium in the pulling direction.

3. The detection device according to claim 2, wherein the downstream transport unit transports the medium together with the upstream transport unit and stops transporting the medium after the upstream transport unit stops transporting the medium, so that the medium is pulled in the pulling direction by the upstream transport unit and the downstream transport unit when the transportation of the medium is stopped.

4. The detection device according to claim 3, wherein the upstream transport unit or the downstream transport unit includes:

a first transport unit, and a second transport unit that is disposed upstream of the first transport unit in the transporting direction.

5. The detection device according to claim 4, wherein the downstream transport unit includes the first transport unit and the second transport unit, wherein the second transport unit pulls the medium together with the upstream transport unit when a transporting-direction dimension of the medium is less than a predetermined length, and wherein the first transport unit pulls the medium together with the upstream transport unit when the transporting-direction dimension of the medium is greater than or equal to the predetermined length.

6. The detection device according to claim 5, wherein the first transport unit and the second transport unit are rollers that are rotated by same drive source.

7. The detection device according to claim 4, wherein the first transport unit and the second transport unit are rollers that are rotated by same drive source.

8. The detection device according to claim 3, wherein the upstream transport unit or the downstream transport unit changes a pulling force by which the medium is pulled in accordance with characteristics of the medium.

9. The detection device according to claim 2, wherein the upstream transport unit or the downstream transport unit includes:

a first transport unit, and a second transport unit that is disposed upstream of the first transport unit in the transporting direction.

10. The detection device according to claim 9, wherein the downstream transport unit includes the first transport unit and the second transport unit, wherein the second transport unit pulls the medium together with the upstream transport unit when a transporting-direction dimension of the medium is less than a predetermined length, and wherein the first transport unit pulls the medium together with the upstream transport unit when the transporting-direction dimension of the medium is greater than or equal to the predetermined length.

11. The detection device according to claim 10, wherein the first transport unit and the second transport unit are rollers that are rotated by same drive source.

12. The detection device according to claim 9, wherein the first transport unit and the second transport unit are rollers that are rotated by same drive source.

13. The detection device according to claim 9, wherein the upstream transport unit or the downstream transport unit changes a pulling force by which the medium is pulled in accordance with characteristics of the medium.

14. The detection device according to claim 2, wherein the upstream transport unit or the downstream transport unit changes a pulling force by which the medium is pulled in accordance with characteristics of the medium.

15. The detection device according to claim 2, wherein the upstream transport unit or the downstream transport unit stops transporting the medium so that an amount by which an edge portion of the medium projects from the upstream transport unit or the downstream transport unit is substantially constant irrespective of a transporting-direction dimension of the medium, and the transportation of the medium is restarted from the edge portion that projects by the substantially constant amount.

16. The detection device according to claim 2, wherein the detection unit detects the leading edge portion and the trailing edge portion of the medium while the transportation of the medium is stopped and while the medium is pulled in the pulling direction when a transporting-direction dimension of the medium is greater than or equal to a predetermined length, and does not detect the leading edge portion and the trailing edge portion of the medium when the transporting-direction dimension of the medium is less than the predetermined length.

17. The detection device according to claim 1, further comprising:

a side-edge-portion detection unit that detects a side edge portion of the medium when the detection unit detects the leading edge portion and the trailing edge portion; and a support portion that supports the side edge portion of the medium detected by the side-edge-portion detection unit.

18. The detection device according to claim 17, wherein the support portion is disposed upstream of the side-edge-portion detection unit in the transporting direction and extends along the side-edge-portion detection unit.

19. An image forming apparatus comprising:

an image forming unit that forms an image on a medium;

a heating unit that heats the medium on which the image has been formed;

a transport passage along which the medium that has been heated is transported; and a detection unit that detects a leading edge portion and a trailing edge portion of the medium in the transport passage while transportation of the medium is stopped and while the medium is pulled in a pulling direction along the transport passage, wherein the detection unit detects the leading edge portion and the trailing edge portion after the medium is heated.

20. A non-transitory computer readable medium storing a program causing a computer to execute a process comprising:

detecting a leading edge portion and a trailing edge portion of a medium in a transport passage, along which the medium is transported, while transportation of the medium is stopped and while the medium is pulled in a pulling direction along the transport passage.

21. A detection device comprising:

a transport passage along which a medium is transported;

a detection unit that detects a leading edge portion and a trailing edge portion of the medium in the transport passage while transportation of the medium is stopped and while the medium is pulled in a pulling direction along the transport passage;

an upstream transport unit that transports the medium along the transport passage in a transporting direction and stops the transportation of the medium; and a downstream transport unit that transports the medium along the transport passage in the transporting direction and stops the transportation of the medium, the downstream transport unit being disposed downstream of the upstream transport unit in the transporting direction, wherein the upstream transport unit and the downstream transport unit pull the medium in the pulling direction.

22. The detection device according to claim 21, wherein the downstream transport unit transports the medium together with the upstream transport unit and stops transporting the medium after the upstream transport unit stops transporting the medium, so that the medium is pulled in the pulling direction by the upstream transport unit and the downstream transport unit when the transportation of the medium is stopped.

23. The detection device according to claim 22, wherein the upstream transport unit or the downstream transport unit includes:

a first transport unit, and a second transport unit that is disposed upstream of the first transport unit in the transporting direction.

24. The detection device according to claim 23, wherein the downstream transport unit includes the first transport unit and the second transport unit, wherein the second transport unit pulls the medium together with the upstream transport unit when a transporting-direction dimension of the medium is less than a predetermined length, and wherein the first transport unit pulls the medium together with the upstream transport unit when the transporting-direction dimension of the medium is greater than or equal to the predetermined length.

25. The detection device according to claim 21, wherein the upstream transport unit or the downstream transport unit includes:

a first transport unit, and a second transport unit that is disposed upstream of the first transport unit in the transporting direction.

26. The detection device according to claim 25, wherein the downstream transport unit includes the first transport unit and the second transport unit, wherein the second transport unit pulls the medium together with the upstream transport unit when a transporting-direction dimension of the medium is less than a predetermined length, and wherein the first transport unit pulls the medium together with the upstream transport unit when the transporting-direction dimension of the medium is greater than or equal to the predetermined length.

27. A detection device comprising:

a transport passage along which a medium is transported;

a transport unit that transports the medium along the transport passage in a transporting direction; and a detection unit that detects a leading edge portion and a trailing edge portion of the medium in the transport passage after the medium is pulled in a direction along the transport passage in a state in which the transport unit stops transporting the medium.

28. The detection device according to claim 27, further comprising:

a side-edge-portion detection unit that detects a side edge portion of the medium when the detection unit detects the leading edge portion and the trailing edge portion; and a support portion that supports the side edge portion of the medium detected by the side-edge-portion detection unit.

29. The detection device according to claim 28, wherein the support portion is disposed upstream of the side-edge-portion detection unit in the transporting direction and extends along the side-edge-portion detection unit.

30. The detection device according to claim 27, further comprising;

a pulling unit that pulls the medium in the direction along the transport passage.

* * * * *